United States Patent [19]

Gano

[11] 4,154,298

[45] May 15, 1979

[54] WELL TUBING HANGER

[75] Inventor: John C. Gano, Carrollton, Tex.

[73] Assignee: Otis Engineering Corporation, Dallas, Tex.

[21] Appl. No.: 853,385

[22] Filed: Nov. 21, 1977

Related U.S. Application Data

[62] Division of Ser. No. 708,843, Jul. 26, 1976, Pat. No. 4,077,472.

[51] Int. Cl.[2] ..... E21B 23/02; E21B 43/01

[52] U.S. Cl. ..... 166/85; 166/243; 166/341; 166/348

[58] Field of Search ..... 166/0.5, 75 R, 85, 89, 166/125, 217, 207, 208, 237, 313, 314, 315

[56] References Cited

U.S. PATENT DOCUMENTS

| | | | |
|---|---|---|---|
| 3,012,608 | 12/1961 | McLaren, Jr. | 166/125 X |
| 3,603,401 | 9/1971 | Nelson et al. | 166/313 |
| 3,771,603 | 11/1973 | Crowe | 166/314 |
| 3,847,215 | 11/1974 | Herd | 166/315 X |

*Primary Examiner*—Stephen J. Novosad
*Attorney, Agent, or Firm*—H. Mathews Garland

[57] ABSTRACT

A well system and method for completing petroleum oil and gas wells having special application to extreme environmental settings such as platform, sub sea, and floating vessel operations, and frozen regions such as the Arctic. The system effectively defines a downhole wellhead including weight supporting apparatus in which the tubing hanger is supported and a pack-off with the casing for minimizing the effects of structural damage at the surface end of the well system. The system includes a tubing hanger releasably lockable in a casing at a downhole location and having sealing means for sealing the annulus within the casing around the hanger, a ball valve package lock releasably lockable in the tubing hanger, tubing strings connected with the ball valve package lock and extending upwardly therefrom, including tubing valves, a safety joint connected with the tubing strings above the valves, tubing strings connected with the safety joint extending upwardly to a tubing head at the wellhead, control fluid conduits connected from the tubing head through the safety joint to the ball valve package lock and tubing hanger for manipulation of the system during various phases of operation, and a composite handling string for running and pulling the well system including either of a slip joint or a hydraulic stop and orienting tool.

5 Claims, 69 Drawing Figures

WELL TUBING HANGER

This is a divisional application of application Ser. No. 708,843 filed July 26, 1976, now U.S. Pat. No. 4,077,472.

This invention relates to well systems and more particularly relates to a tubing hanger in well completion systems.

Generally, previously available well systems located in offshore and other remote areas such as in the frozen areas of the Arctic utilize platform or surface mounted structure including an entire casing program which is supported at the platform or at the surface end of the well system. Such systems normally do not include a downhole tubing hanger and, if included, such hanger does not have a pack-off between the hanger and the casing closing the annulus around the hanger. Such systems also normally include all of the traditional christmas tree functions at the platform or surface elevation using such structure as master valves and the like. The substantial weight of tubing in such systems is supported at the platform rather than at a downhole location. When the tubing strings are hung downhole, the tubing string sections from the hanger up are normally run and pulled separately. Operating between fixed points presents spacing-out problems, flange locating problems at the wellhead at the surface end of the well, and similar procedural difficulties which are compounded offshore especially when operating from a floating vessel. Likewise, equipment orientation is not provided for and along with the spacing-out problems remote handling of such tubing strings is not possible. With regard to the spacing-out problems, extremely accurate measurements are normally necessary such as, for example, accuracy within the range of 1 to 2 inches between the surface end of the well at the platform and a downhole tubing hanger. Since the distances involved may be on the order of several thousand feet, such accuracy is extremely difficult to maintain. Additionally, such tubing systems extending from the hanger down through the packers must be run and pulled as single units; and, thus, major well workovers are necessary in order to retrieve the valves when required. Such prior systems are extremely difficult to handle from a floating vessel. With the weight supporting and pack-off functions being performed at the platform in offshore wells and at the surface in other wells such as in Arctic areas, the systems are extremely vulnerable to damage which can result in a loss of control of wells, damaging the environment, and wastage of substantial product. With all of the required equipment at the surface, substantial height is required at the Christmas tree level. Thus, prior systems are highly vulnerable to storm damage, ship damage, earthquake damage, commercial fishing damage, and other occurances which result in forces being applied to the surface end of a well system sufficient to render it inoperable.

The well system disclosed including the tubing hanger of the present invention solves many of the existing problems discussed above for protecting and controlling wells which are subject to extreme environmental conditions and in the installation and service of completion equipment in such wells. The present system effectively moves the pack-off and weight supporting functions normally at the wellhead downhole to a safe depth. The system permits installation and retrieval from floating vessels and other remote locations due to both orienting and spacing-out capabilities of the equipment involved. The requirements for diver assistance at the ocean bottom level in offshore wells is frequently eliminated in the present system. The very accurate distance measurements required in the prior art are not necessary in the present system which permits variations of as much as 6 to 12 inches which have been found permissible in certain specific prototypes; and it has been determined that substantially more tolerance can be built into the system. The present system provides several break points along its length permitting it to be installed and retrieved in defined equipment groupings of lesser length and complexity than possible with the prior art systems. For example, the system may be broken at the tubing hanger of the present invention and at the safety joint, both of which have profiles compatible with handling tools used for running and pulling the equipment. The generous spacing-out capabilities of the present system including the features of the slip joint and the hydraulic stop and orienting tool in the composite string permit operation from floating vessels. In the present system, the pack-off with the casing at the tubing hanger of the invention provides annulus control at this downhole location and permits plugging the well at the hanger. A third tubing string may be used connected into the tubing hanger to communicate with the annulus below the hanger so that, effectively, the normal wellhead pack-off is moved downwardly in the well to a safe depth below the potential damage area under the various conditions discussed above. Effectively, the traditional platform system at the wellhead is moved to a depth below the mudline. The weight of the tubing strings below the tubing hanger of the invention is supported from the downhole tubing hanger rather than from the well platform level. The master valve functions are moved downhole from the platform level to the tubing strings in the vicinity of the tubing hanger providing master valve operation below the mudline level rather than at the usual wellhead level. The rather high physical profile of the usual Christmas tree is substantially lowered by moving these master valve functions downhole. With respect to orientation and spacing-out capabilities of the system, the features of a number of the components of the system provide maximum flexibility. The tubing hanger may be grossly oriented. Each successive unit in the system is self-orienting to the previously installed unit to which it couples, extending from the tubing hanger upwardly through the blowout preventer stack. Units of the system which specifically have orienting capabilities include the slip joint, the hydraulic stop and orienting tool, the tubing head, the safety joint, and the tubing hanger of the invention and in the stab seal arrangements in some of the units.

The tubing head in the system is different from prior art tubing heads in that it serves solely as an interface between the wellhead and the tubing strings below the wellhead by providing fluid communication and not requiring weight supporting and pack-off functions. While at the tubing head there is some mechanical loading due to temperature changes and the like, the substantial weight supporting functions normal to such a head are not present in the system of the present invention. The slip joint and hydraulic stop employed in the composite string used in handling the system allows the transfer of weight from a floating vessel to a blowout preventer stack at the ocean floor along with providing some orientation function at the level of the blowout preventer stack. The safety joint employed in the present system provides a known profile which may be reentered by a handling for servicing and refitting the well in the event of damage which causes a parting of the system at the safety joint. By locating the master valve function downhole below the mudline, the valves may be changed with full control over the well in that the well may be killed and plugged through the full-bore opening tubing valves with the plugs being placed below the valves. The well may be fully killed even in the case of a failure of the master valves. A kill fluid may be pumped down into the well for such purpose; and, alternatively, the valves may be locked open and plugs placed below the valves to shut the well in.

The equipment used in combination in the system is particularly adaptable to connection together and handling is selective groupings fo shipping and operating purposes. For example, one combination of the system may include the lower half section of the safety joint and the package lock coupled together by the tubing strings including the valves and the operating fluid control lines running between the safety joint and the package lock. A second grouping may include the upper half section of the safety joint and the tubing head connected together by the appropriate tubing strings and control fluid lines. The tubing hanger of the present invention is a still further separate component. These combinations may be factory assembled, shipped, installed and pulled in such preassembled combinations.

It is a particularly important object of the present invention to provide a new and improved tubing hanger for a well.

It is another object of the invention to provide a tubing hanger in a well system wherein a wellhead is effectively established in a well at a downhole location by providing a pack-off and weight supporting apparatus which normally is at the surface end at the normal wellhead location.

It is another object of the invention to provide a tubing hanger in a well system wherein the tubing hanger is secured at a downhole location which may be substantially below the mudline or in an offshore well or a potential damage point in wells located in such remote areas as the Arctic.

It is another object of the invention to provide a tubing hanger in a well system wherein a master valve package is located in a downhole position above a pack-off point in the well.

It is another object of the invention to provide a tubing hanger in a well system wherein the weight of casing and of well tubing is removed from a surface platform or wellhead and relocated downhole at the tubing hanger which may be below the mudline.

It is another object of the invention to provide a tubing hanger in a well system wherein well tubing is packed-off at the tubing hanger located substantially below the mudline in a well.

It is another object of the invention to provide a tubing hanger in a well system which presents improved possibilities of keeping a damaged well under control by locating the pack-off point in the well below the mudline.

It is another object of the invention to provide a tubing hanger in a well system which is especially adapted to offshore and Arctic locations.

It is another object of the invention to provide a tubing hanger in a well system and method wherein an entire well completion may be accomplished through a blowout preventer stack.

It is another object of the invention to provide a tubing hanger in a well system wherein a valve package and a competent pressure bulkhead are in place in the well when the blowout preventer stack is removed.

It is another object of the invention to provide a tubing hanger in a well completion system and method which may be installed and retrieved from a floating vessel.

It is another object of the invention to provide a tubing hanger in a well system of the character described which provides for annulus control at the tubing hanger.

It is another object of the invention to provide a tubing hanger in a well system of the character described which permits shutting in the well below the tubing hanger for replacement of the tubing valves above the hanger.

It is another object of the invention to provide a tubing hanger in a well system and method of the character described wherein the profile of the Christmas tree is substantially lowered by moving the master valve function downhole.

It is another object of the invention to provide a tubing hanger in a well system and method of the character described wherein the various functional units of the system are adapted to rotational orientation at each unit is coupled with a previously installed unit of the system.

It is another object of the invention to provide a tubing hanger in a well system and method of the character described wherein a major portion of the weight of the system when operating from a floating vessel is transferred to an ocean-bottom location.

In accordance with the present invention there is provided a tubing hanger to be interconnected in a well system in a well bore at a depth below the mudline in an offshore well and below a probable damage area in other wells such as the Arctic wells. The tubing hanger has means to seal off with the casing hanger at the upper end of the tubing strings providing the downhole tubing-annulus pack-off. The tubing hanger includes internal orienting structure for orienting a valve package lock telescoped into the hanger in the system disclosed and external lock means to releasably lock the hanger in a casing landing nipple.

The foregoing objects and advantages of the invention will be better understood from the following detailed description of a preferred embodiment thereof taken in conjunction with the accompanying drawings wherein:

FIGS. 1A, 1B, and 1C taken together constitute a schematic view in longitudinal section and elevation of one form of well system including a tubing hanger of the invention;

Figure 2:
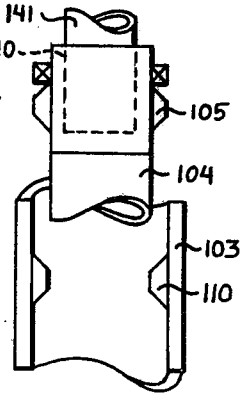
FIG. 2 is a fragmentary schematic view in section and elevation showing a preliminary step in the installation of the system of the invention wherein a string of inner casing is being lowered for hanging within a larger string of outer casing.
Figure 4:
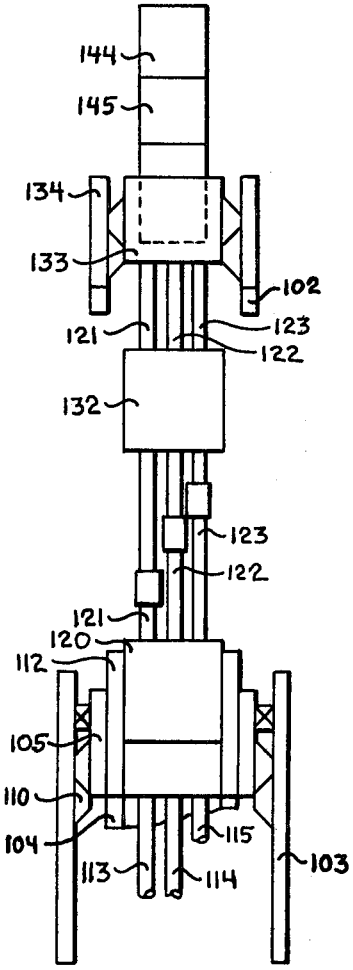
FIG. 4 is a schematic view in section and elevation illustrating the procedure of running into the well bore an assembly comprising a valve package lock, tube strings including valves, a safety joint, and a tubing head for securing the valve package lock into the tubing hanger of the invention and setting the tubing head within a wellhead housing.
Figures 6A, 6B:
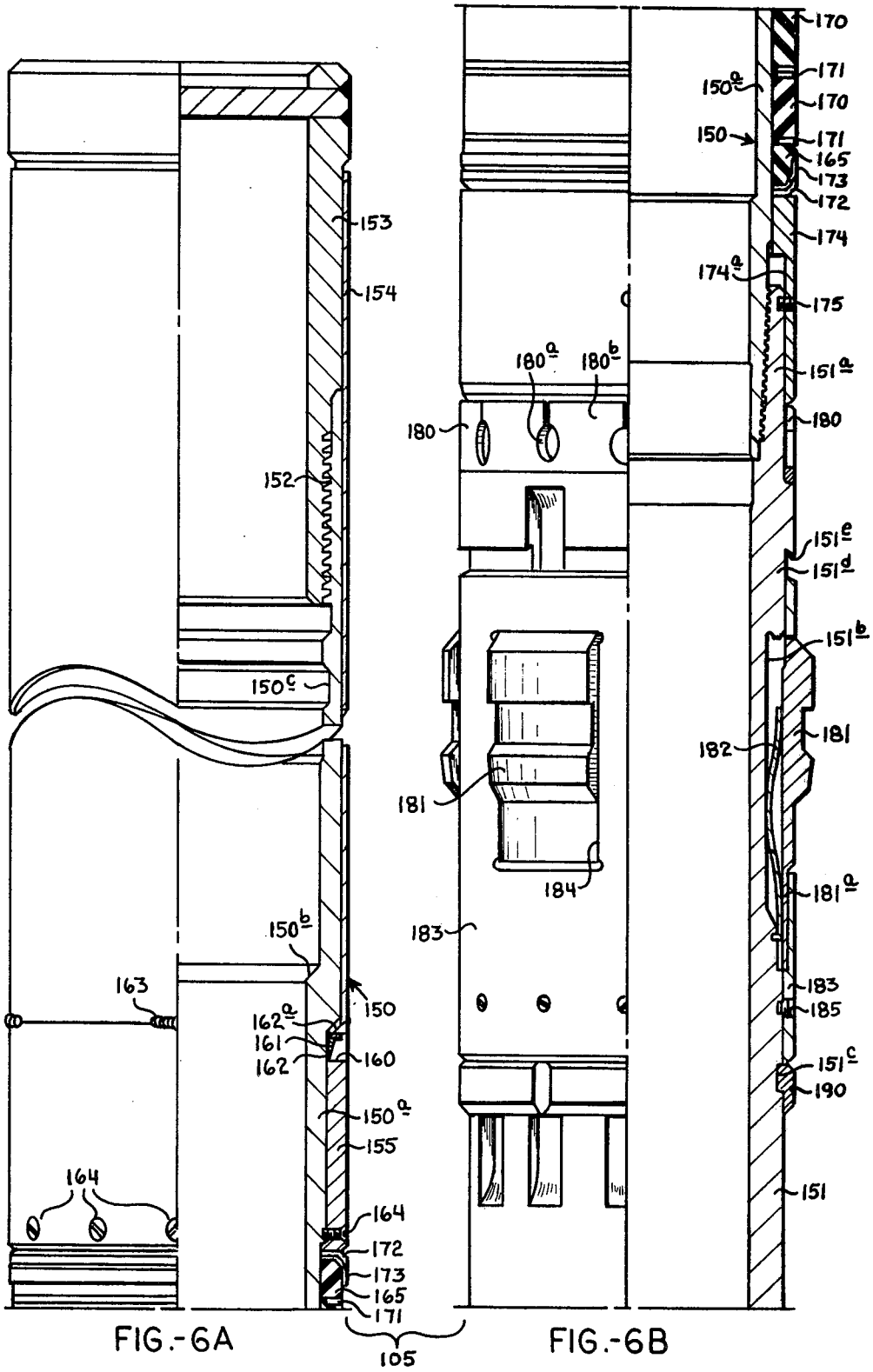
Figure 6C:
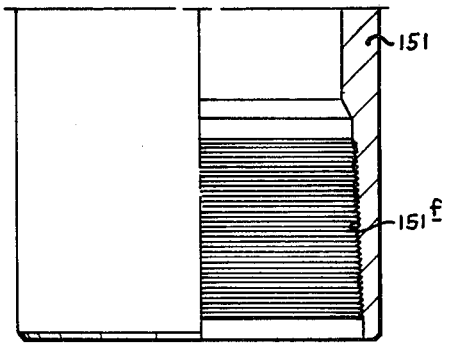
Figure 7A:
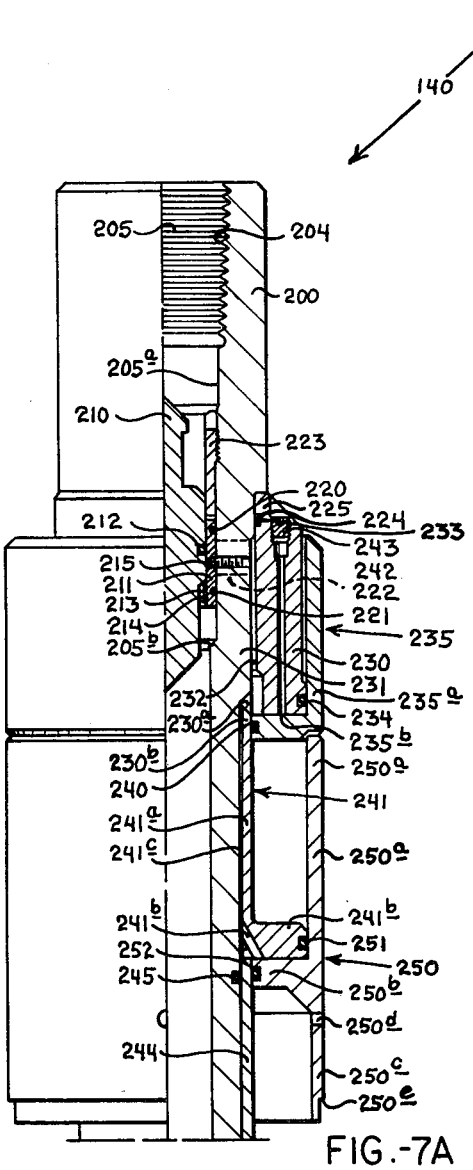
Figure 7B:
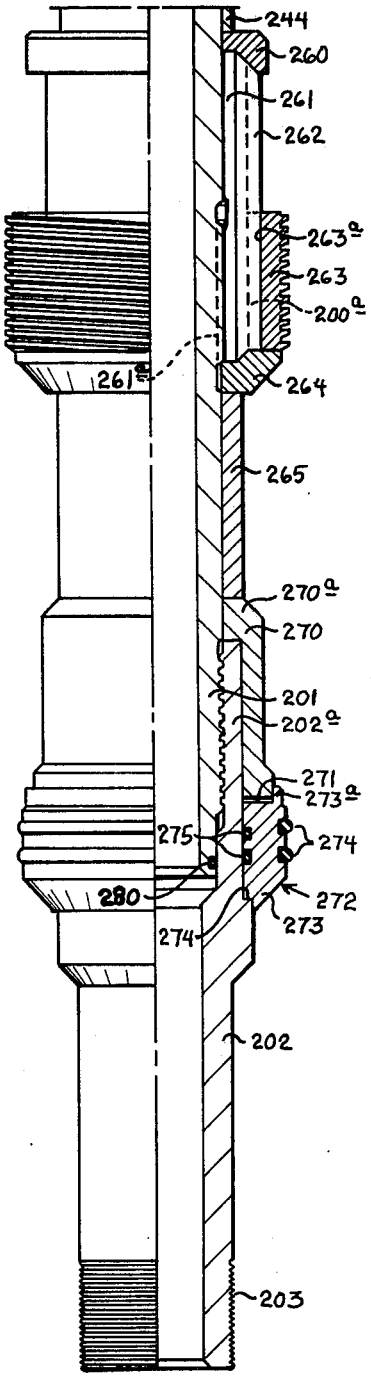
Figure 8A:
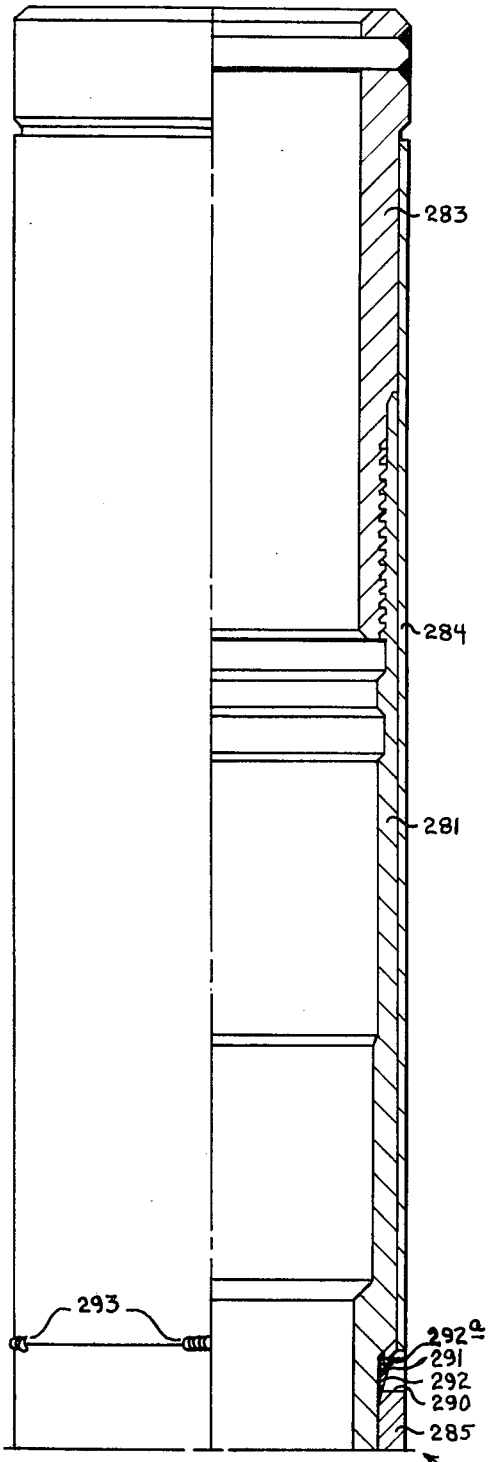
Figure 8B:
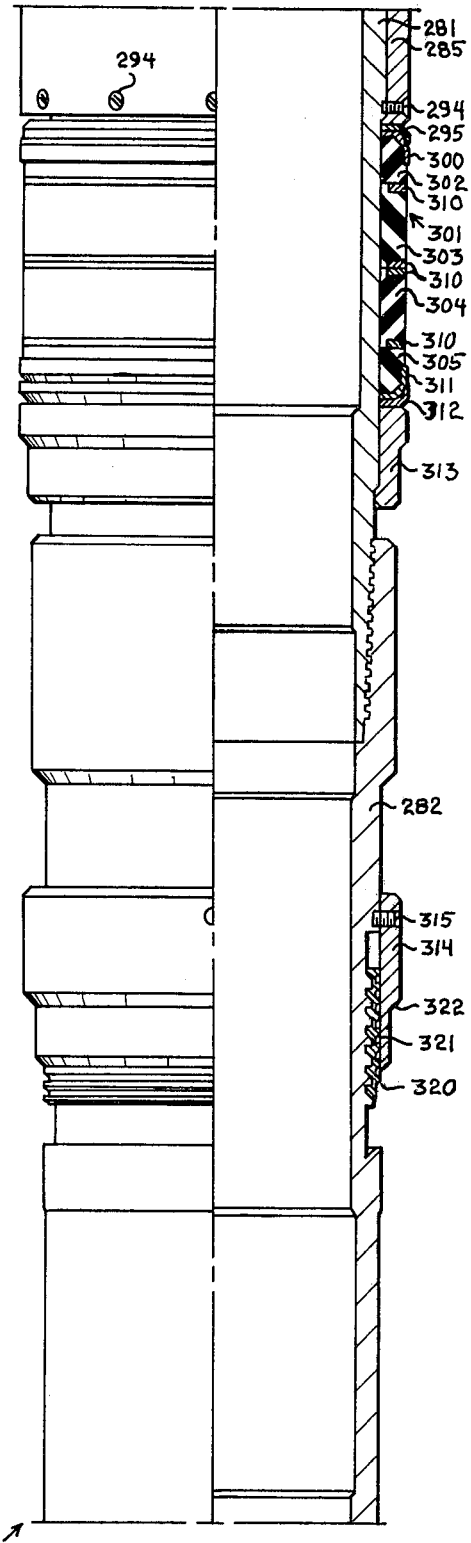
Figure 8C:
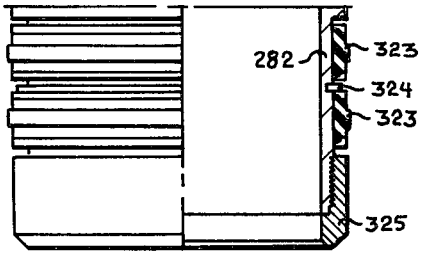
Figure 9A:
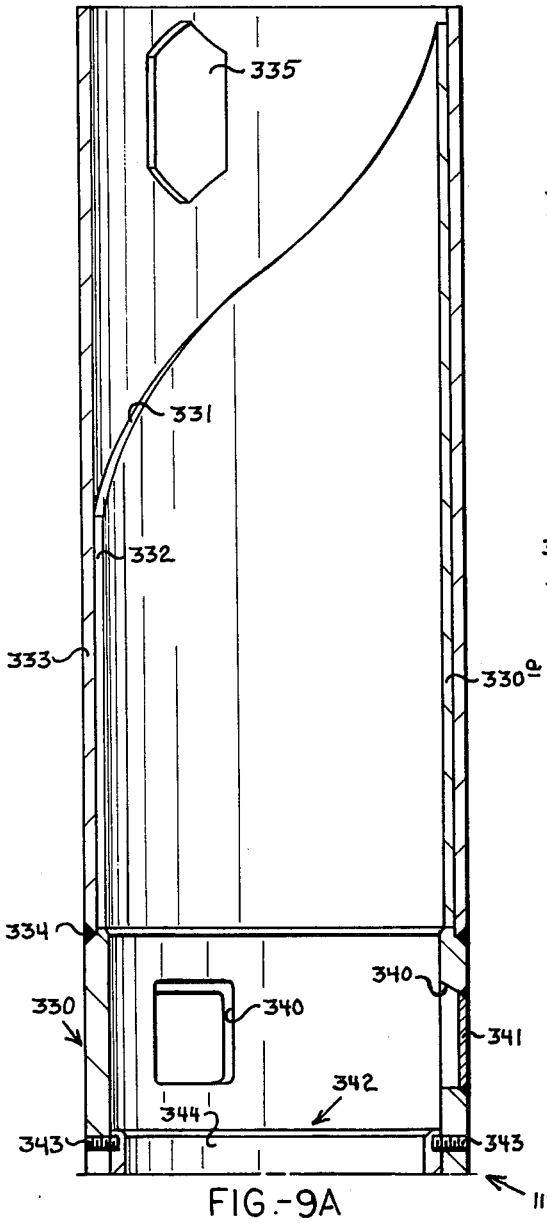
Figure 9B:
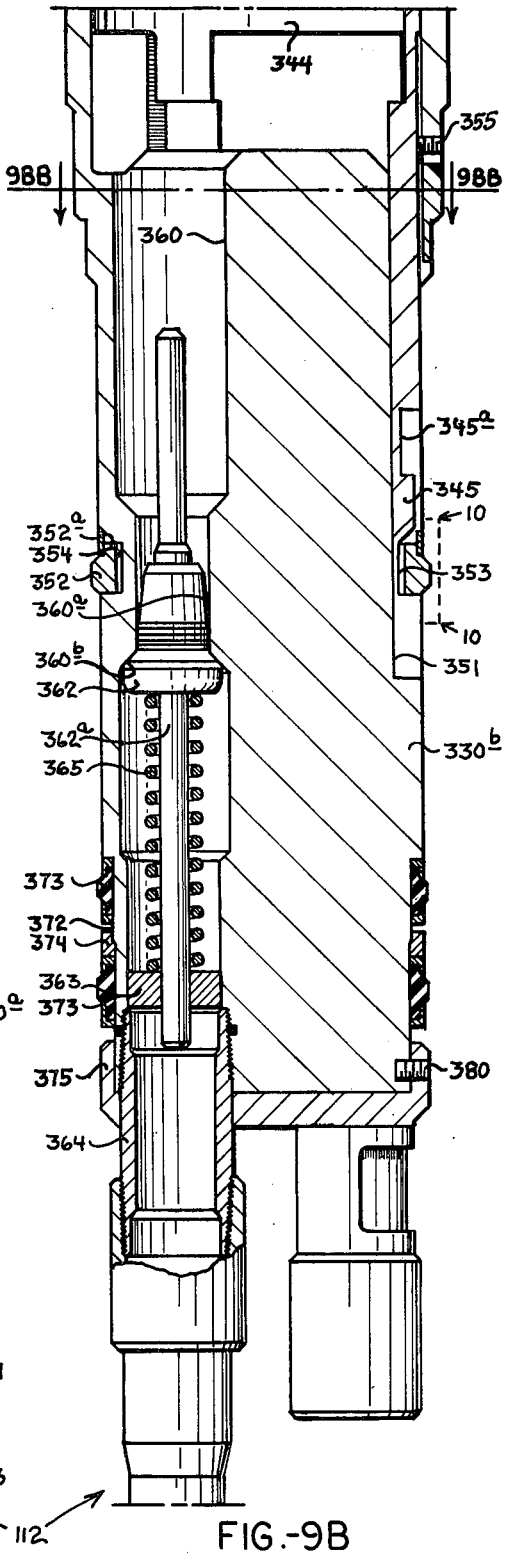
Figure 9C:
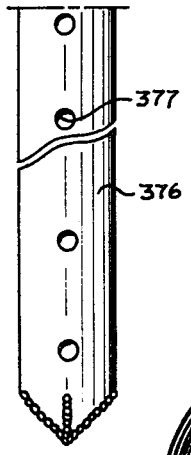
Figure 10:
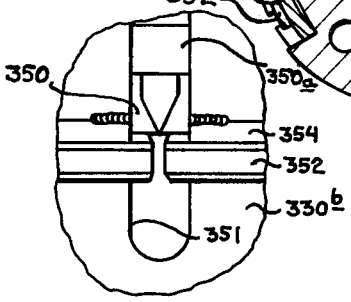

FIGS. 6A, 6B, and 6C taken together constitute a longitudinal view in section and elevation of a casing hanger and packer employed in the system and illustrated schematically during an installation step in FIG. 2;

FIGS. 7A and 7B taken together constitute a longitudinal view in section and elevation of a packer and hanger running tool used for the installation of the casing hanger and packer illustrated in FIG. 2;

FIGS. 8A, 8B, and 8C taken together constitute a longitudinal view in section and elevation of an emergency seal unit employed in the system in the event of the failure of the seal on the casing hanger illustrated in FIGS. 1 and 6A—6B;

FIGS. 9A, 9B, and 9C taken together constitute a longitudinal view in section and elevation of a tubing hanger of the invention as represented sechematically in FIG. 4 as seen along a vertical plane intersecting the tool through the flow passage and check valve leading to the annulus;

FIG. 9BB is a view in section along the line 9BB—9BB of FIG. 9B;

FIG. 10 is a side view in elevation as seen along the line 10—10 of FIG. 9B showing the structure for expanding a locking ring around the tubing hanger.

Figure 11B:
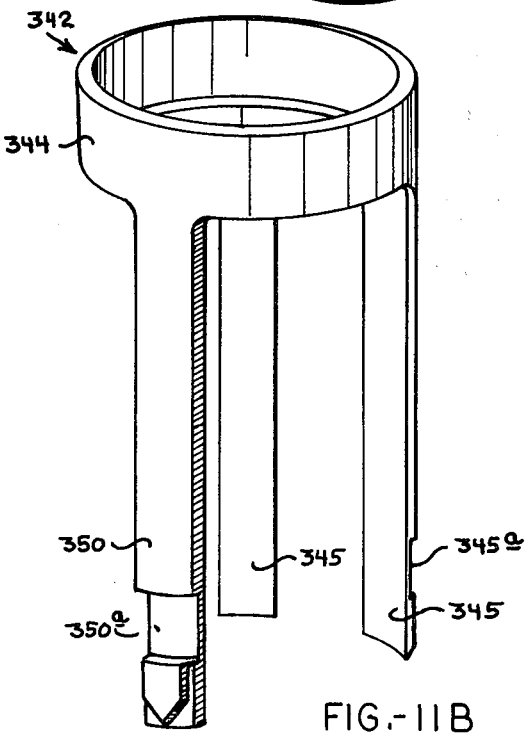
Figure 11A:
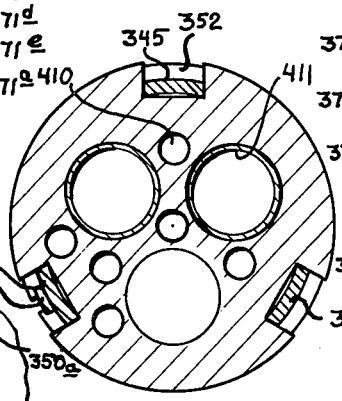
Figure 11:
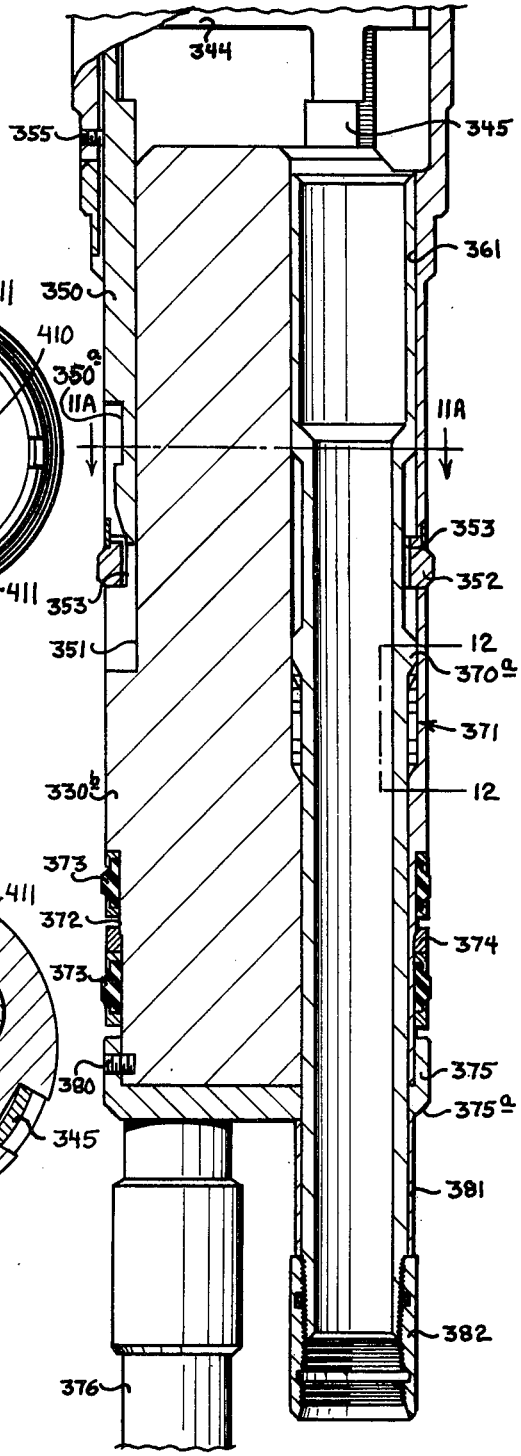

FIG. 11 is a fragmentary view in section and elevation taken along a lower portion of the tubing hanger illustrated in FIGS. 9A and 9B as seen along a vertical plane intersecting one of the flow passages to one of the tubing strings supported from the hanger;

FIG. 11A is a view in section along the line 11A—11A of FIG. 11.

FIG. 11B is a perspective view of the locking finger collet of the tubing hanger of FIGS. 9A through 11A, inclusive.

Figure 3:
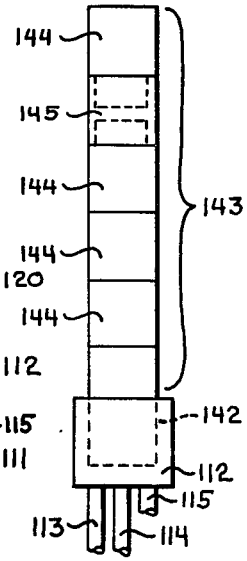
FIG. 3 is a schematic view in elevation illustrating the lowering of plurality of tubing strings supported from a tubing hanger of the invention handled by a composite handling string for securing the tubing hanger within the casing hanger illustrated in FIG. 2 to support the tubing strings in a well bore.
Figure 20:
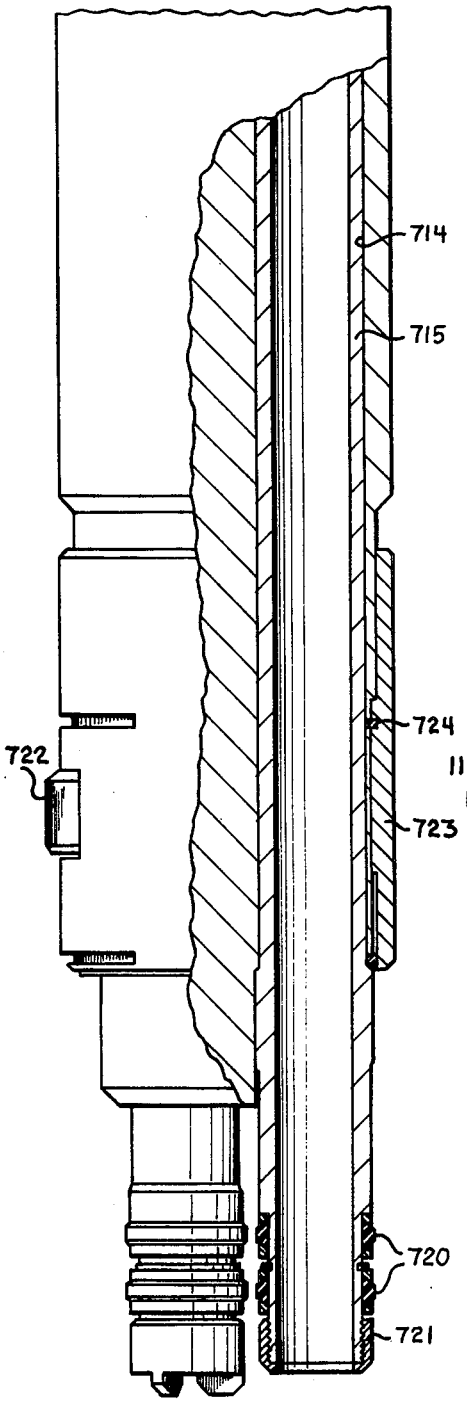
Figure 5:
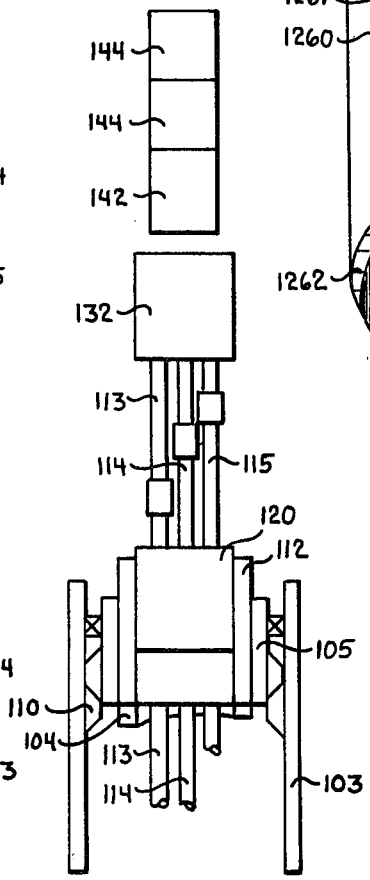
FIG. 5 is a schematic view in section and elevation illustrating a step of retrieving a portion of the well system including a safety joint, tubing strings containing the valves, and the valve package lock by means of the composite handling string after a well failure causing damage resulting in a parting of the tubing system at the safety joint.
Figure 36C:
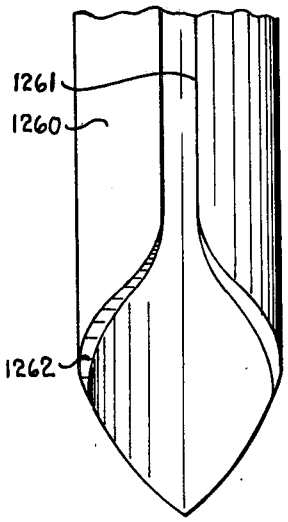
Figure 23A:
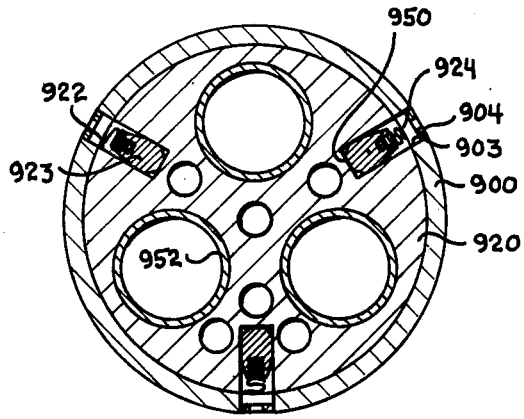
Figure 38:
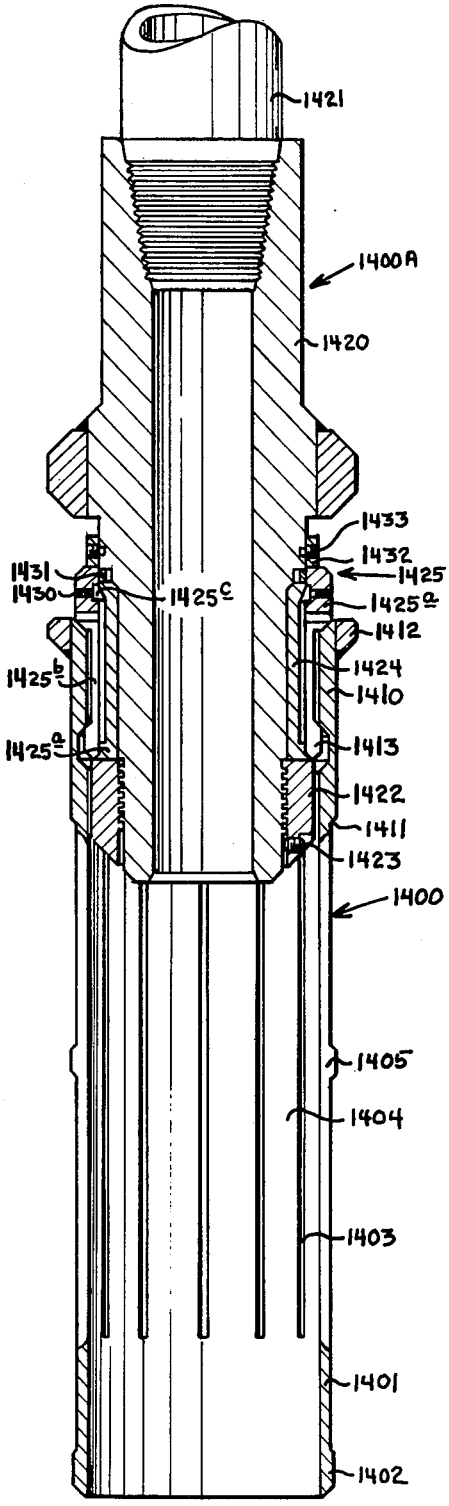
Figure 9B:
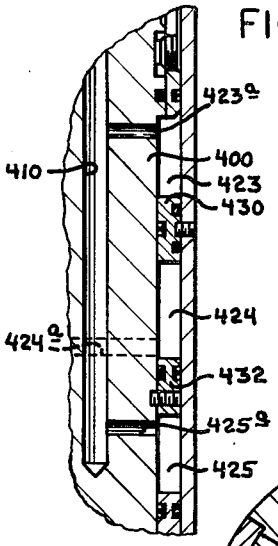
Figure 9B:
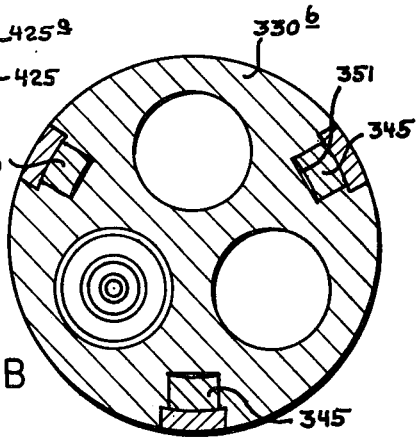
Figure 13A:
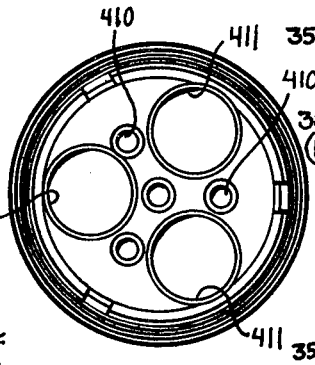
Figure 12:
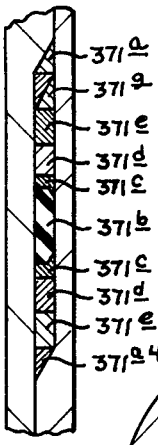
Figures 13A, 13B, 14, 15, 16:
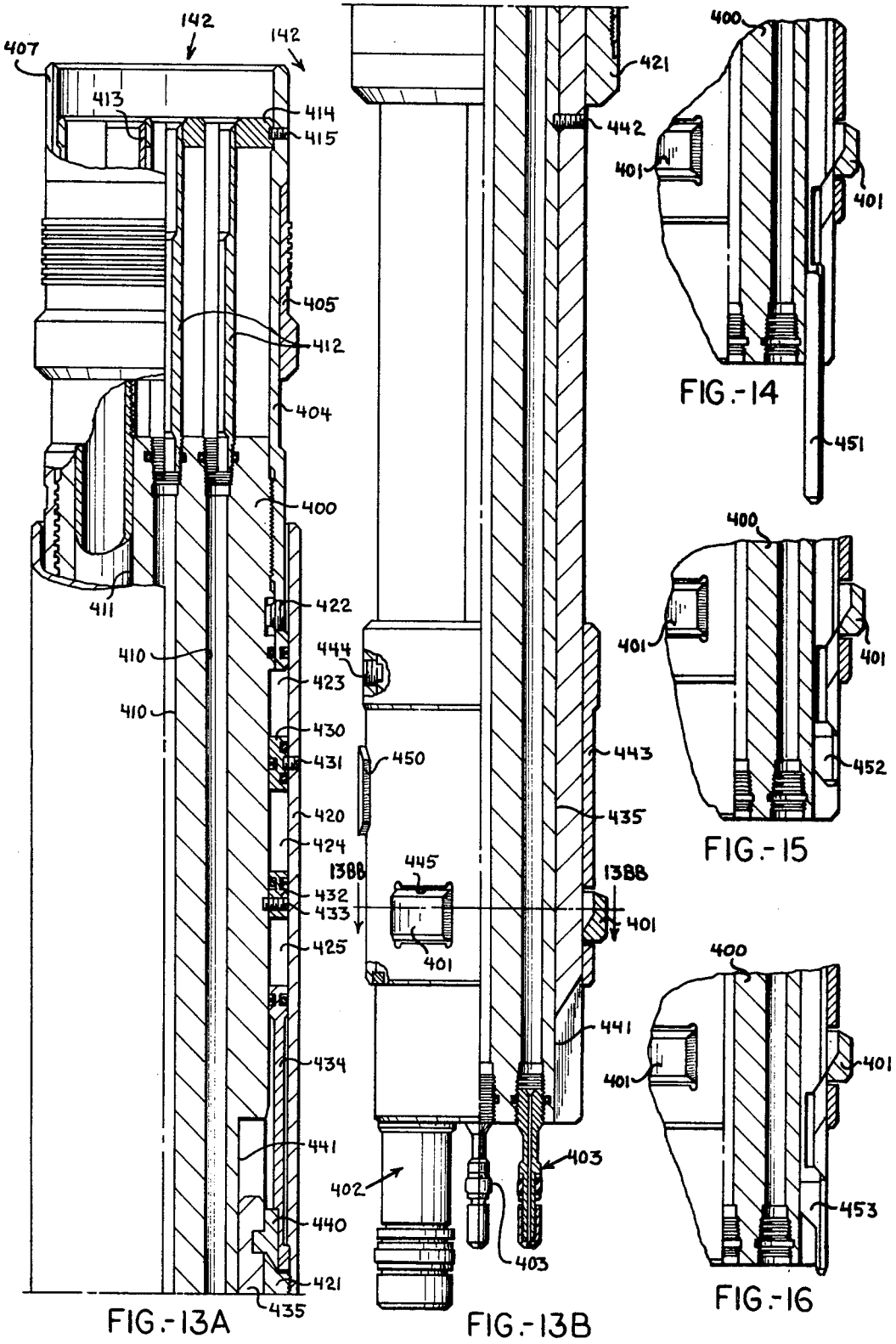
Figure 26:
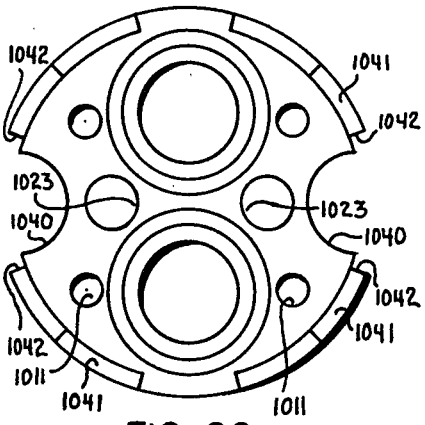
Figure 29:
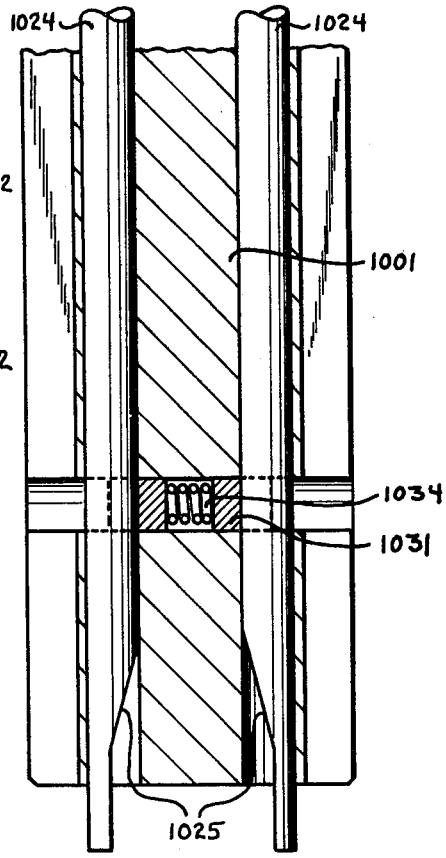
Figure 27:
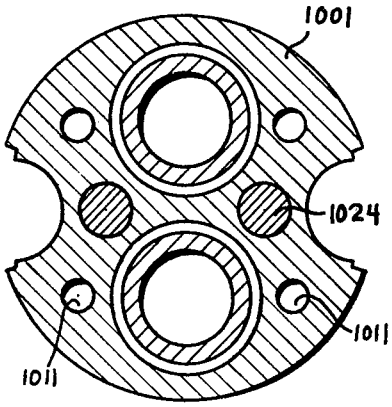
Figure 13B:
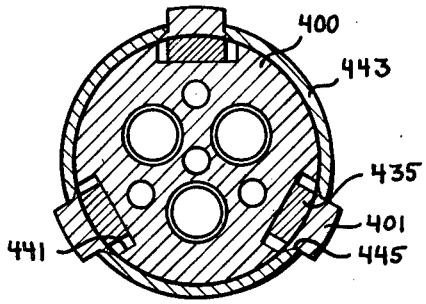
Figure 28:
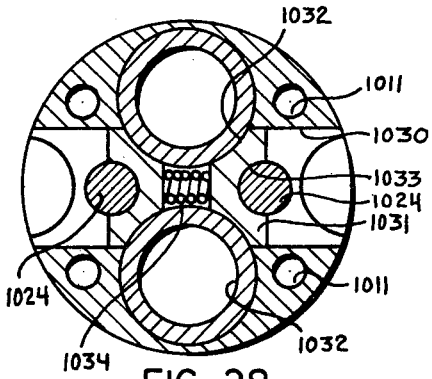
Figure 17A:
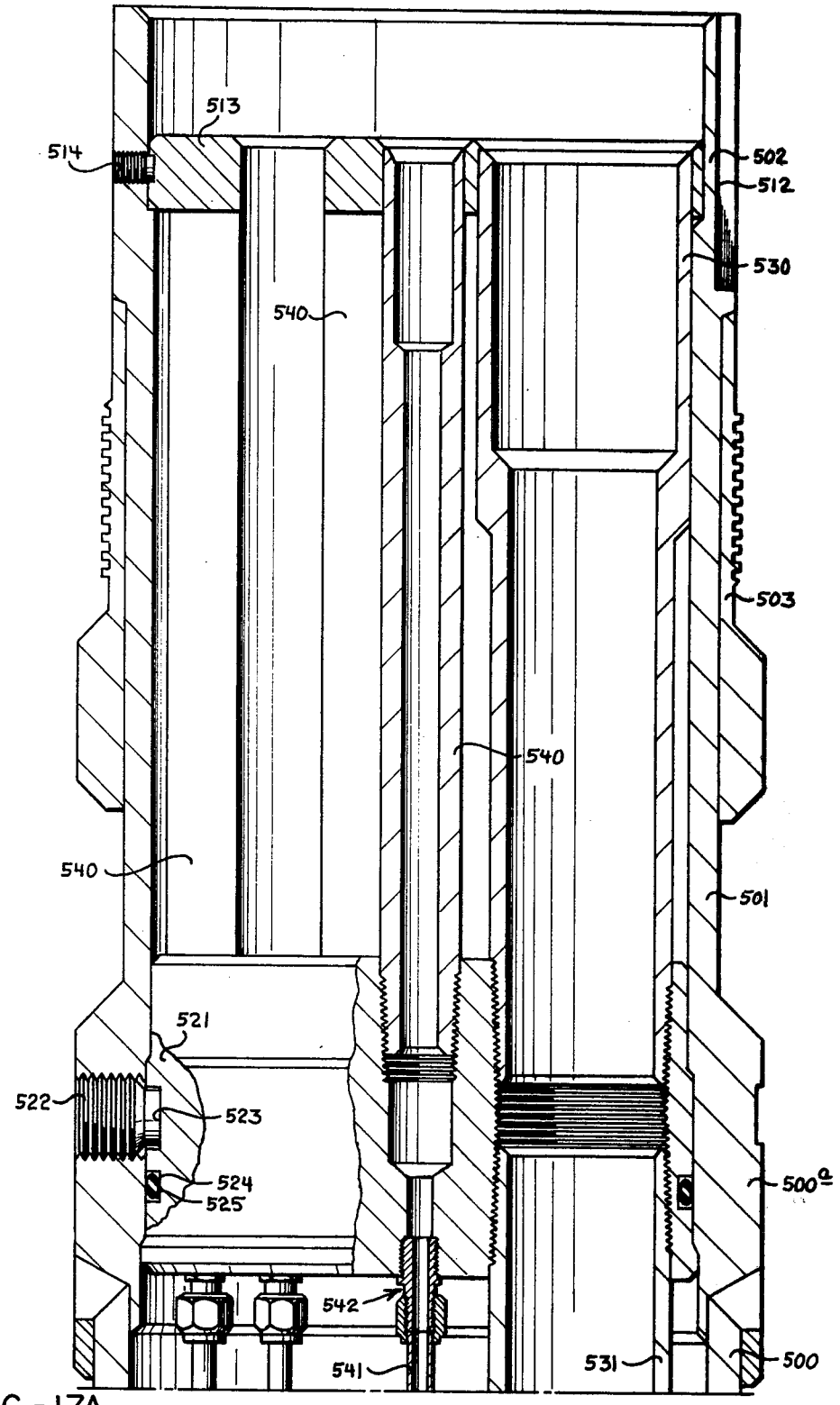
Figure 17B:
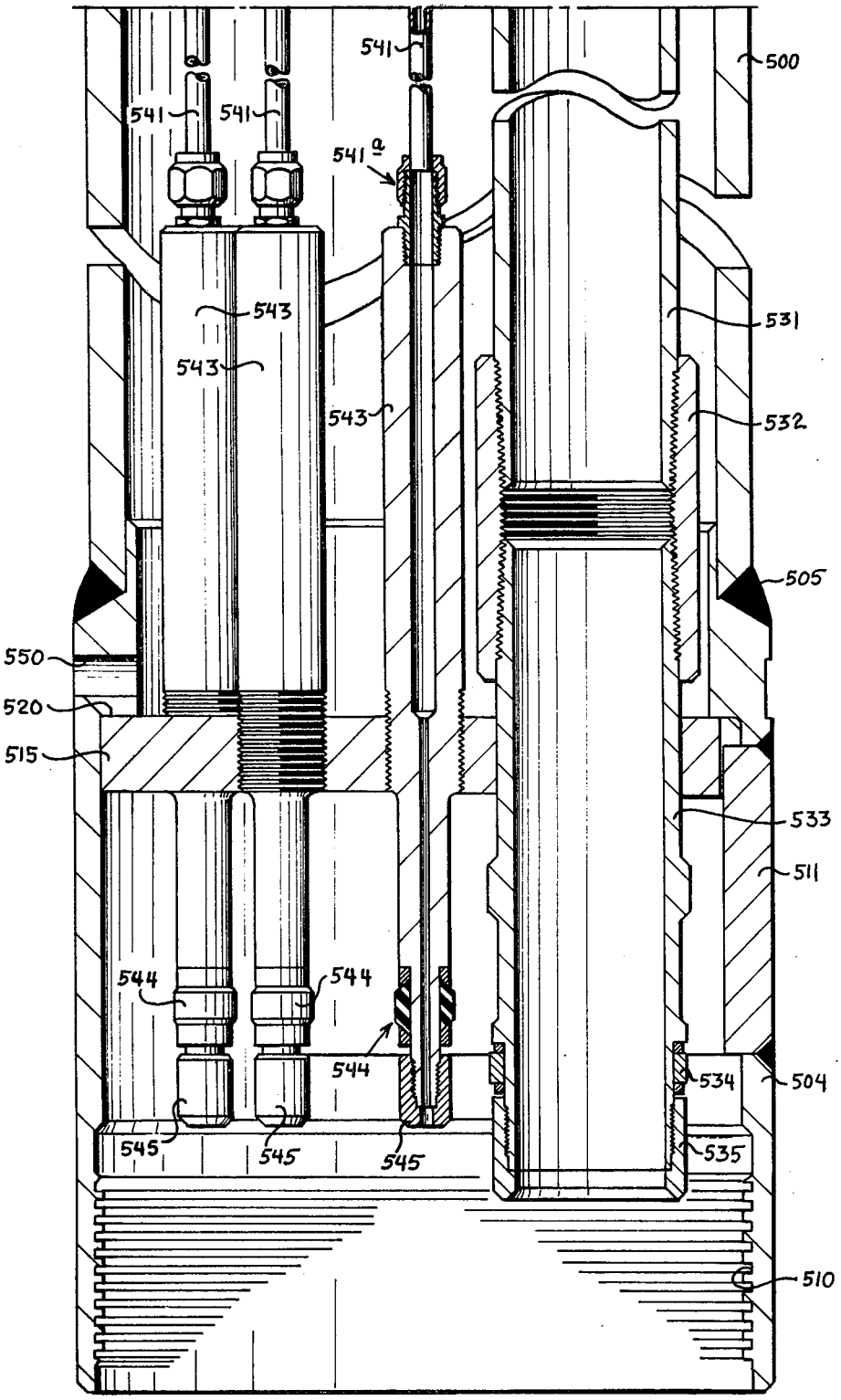
Figures 18A, 18B:
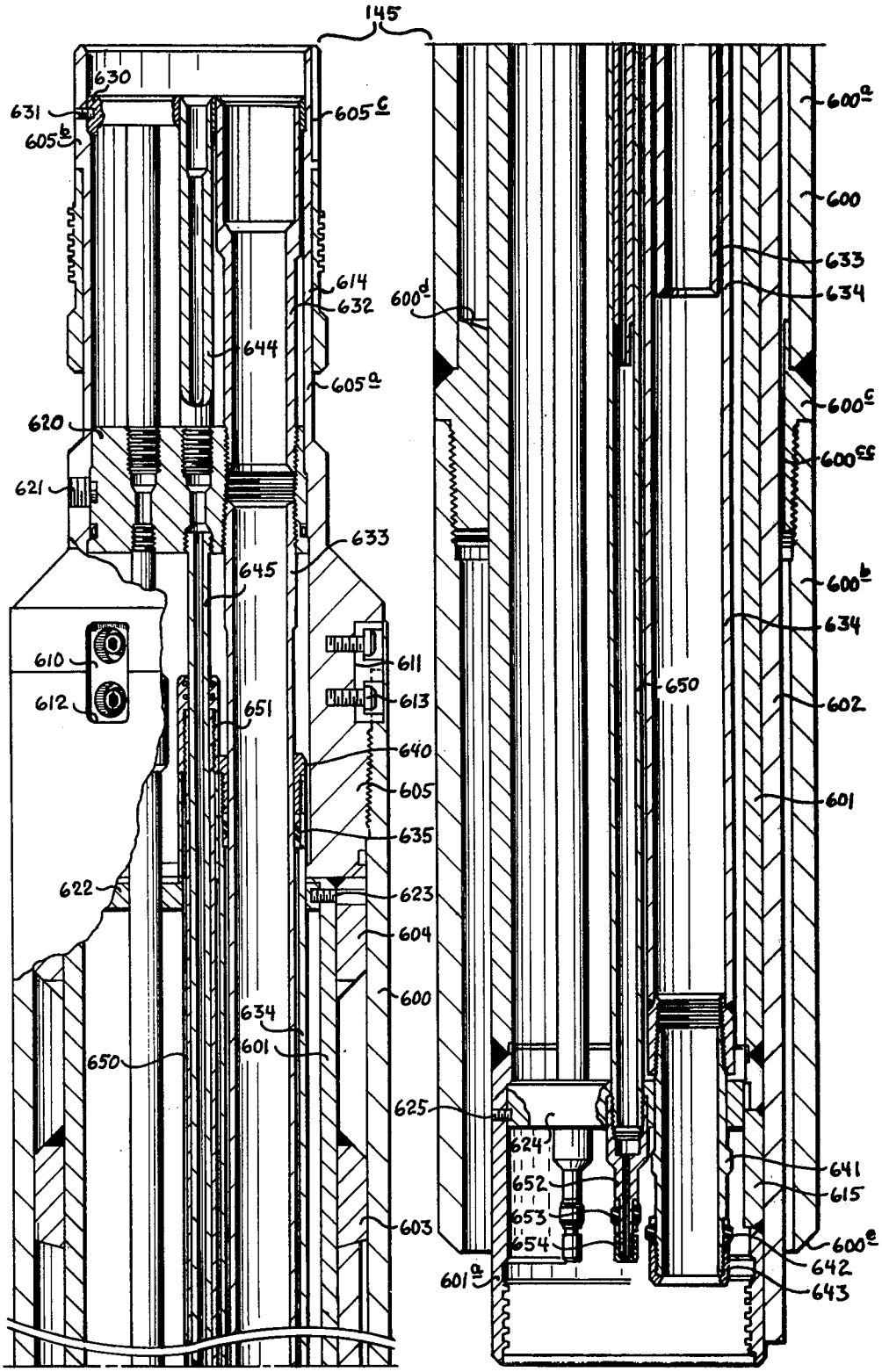
Figure 19A:
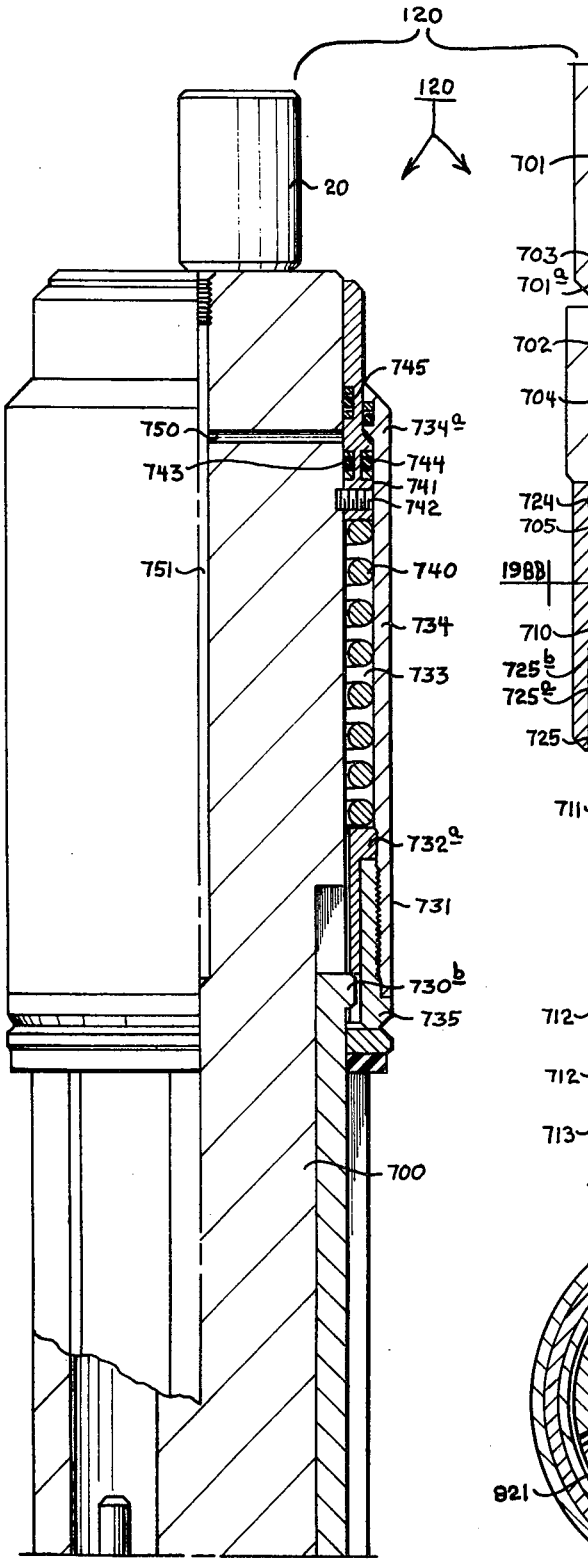
Figure 19B:
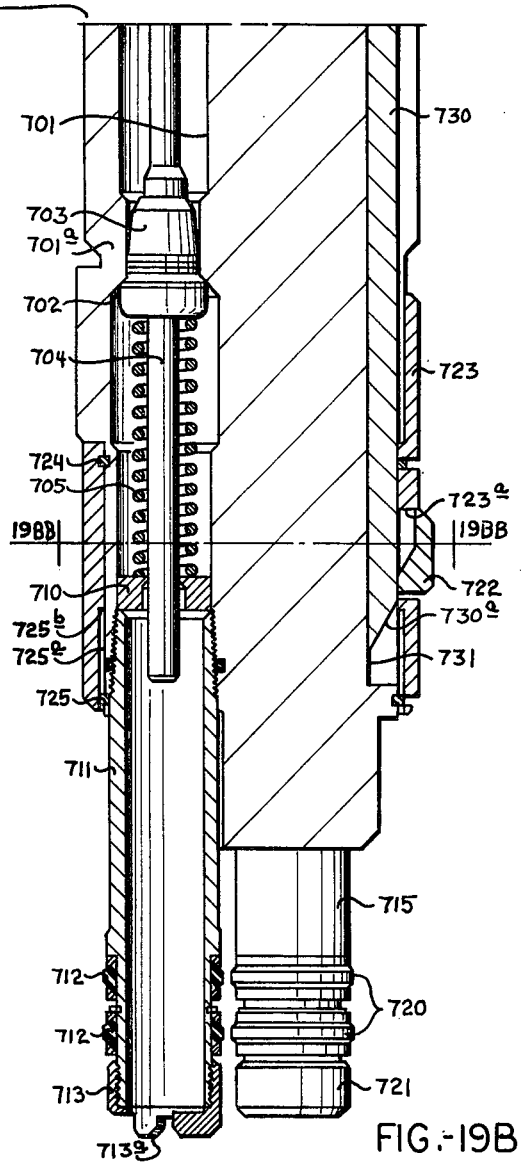
Figure 21B:
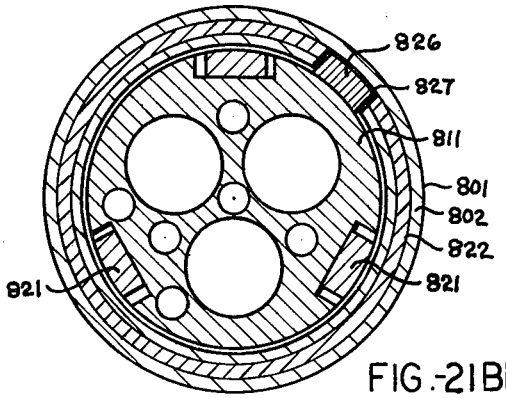
Figure 19A:
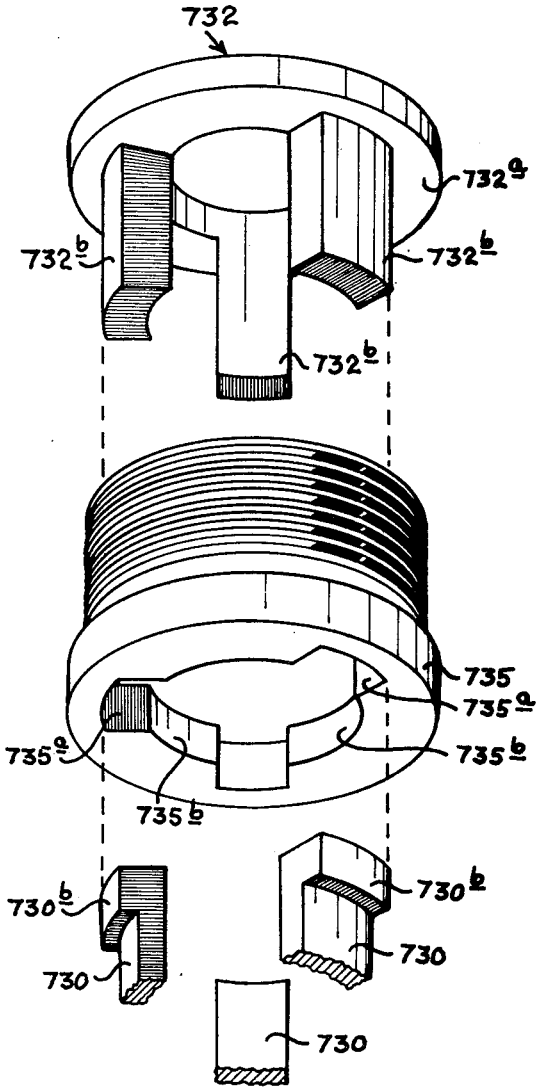
Figure 37A:
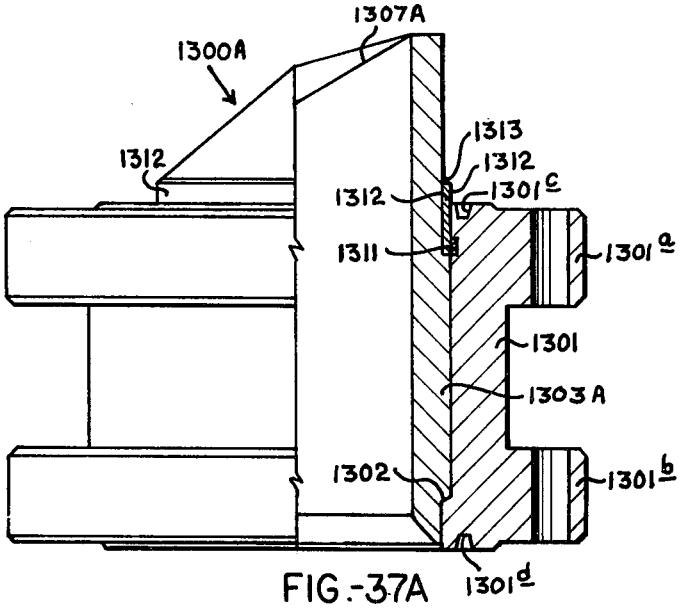
Figure 19B:
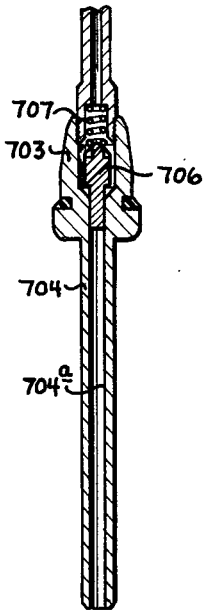
Figure 19B:
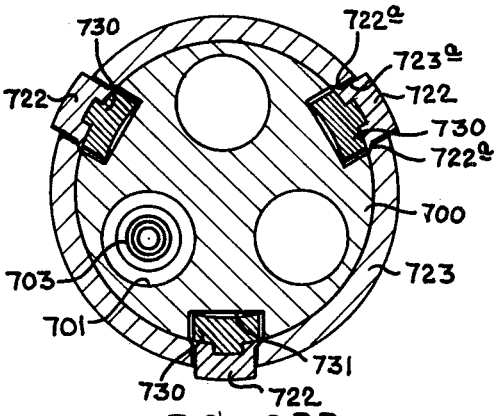
Figure 24:
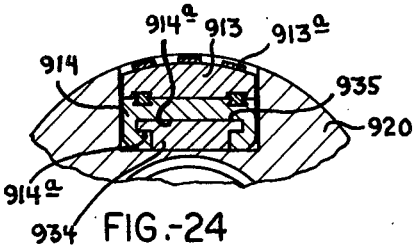
Figure 21A:
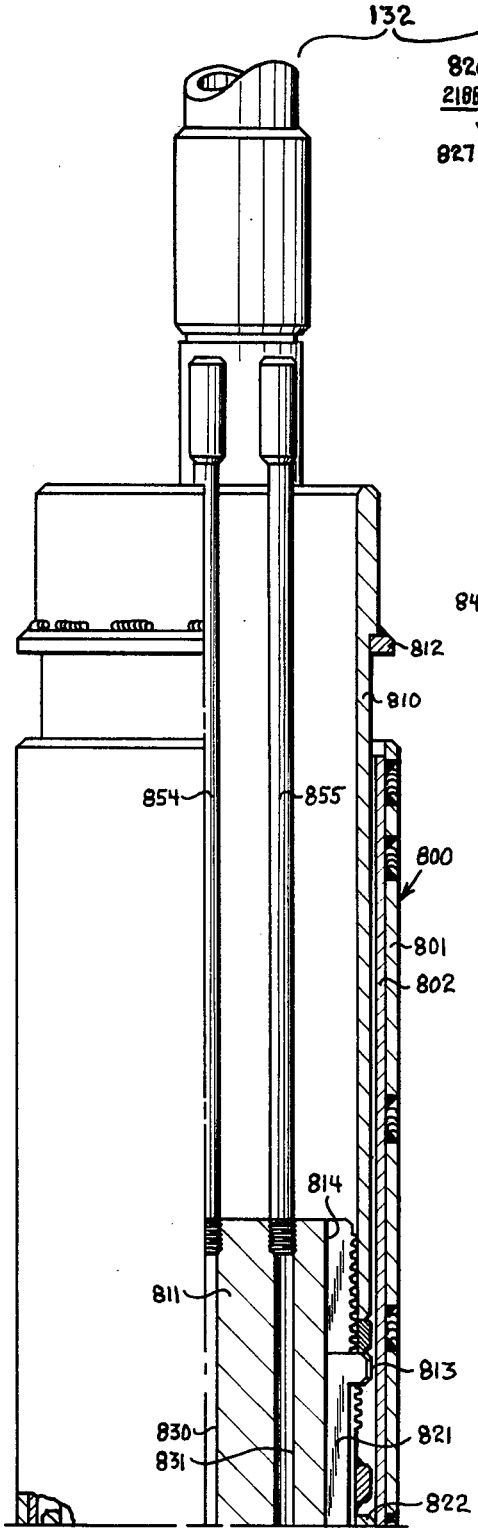
Figure 21B:
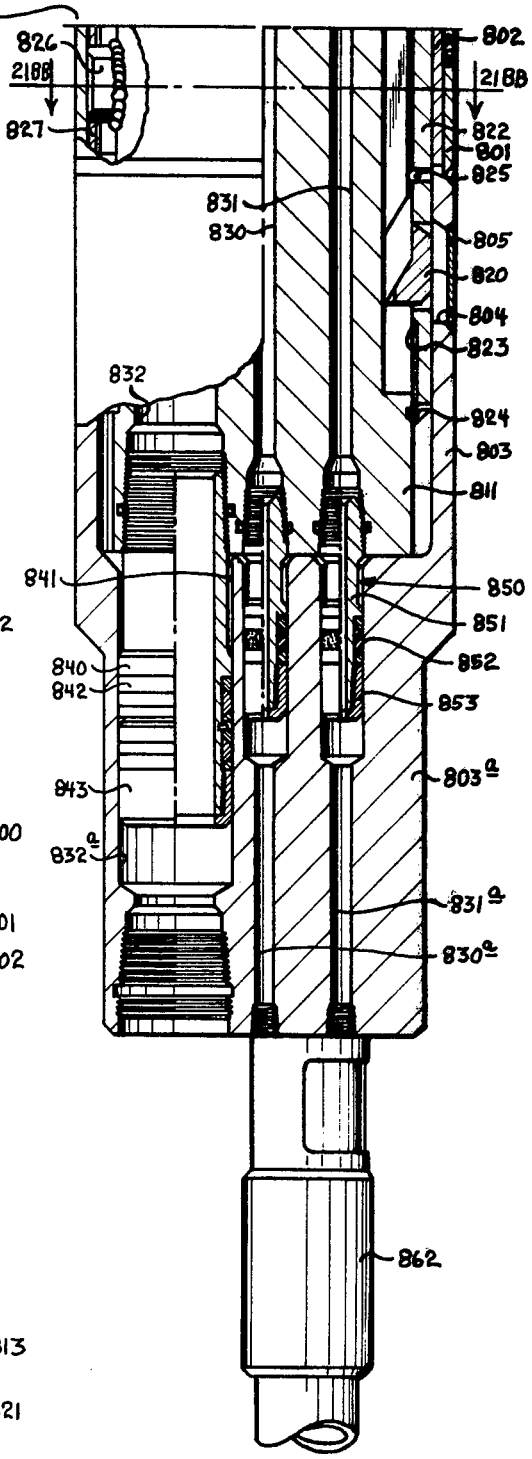
Figures 22A, 22B:
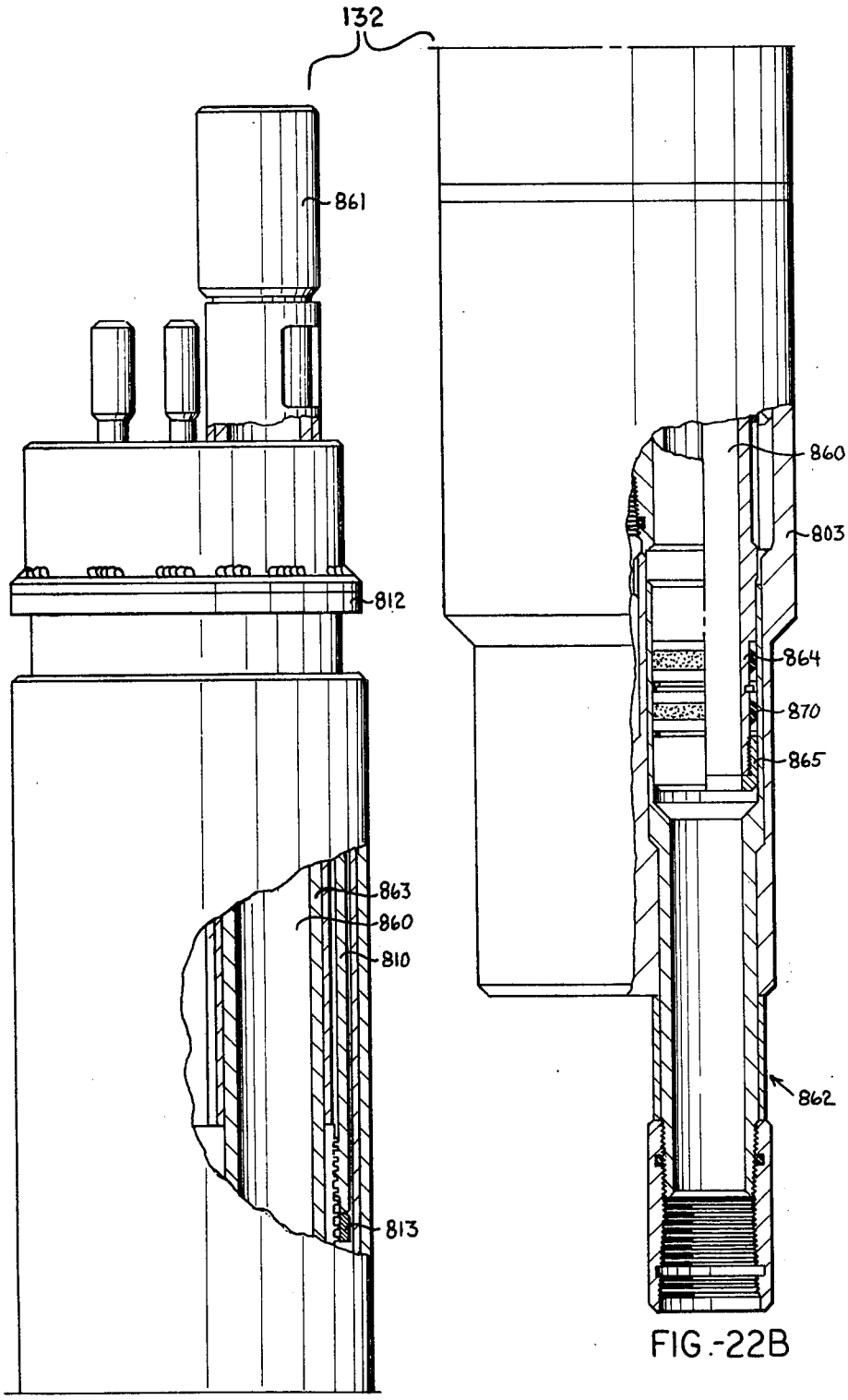
Figure 23A:
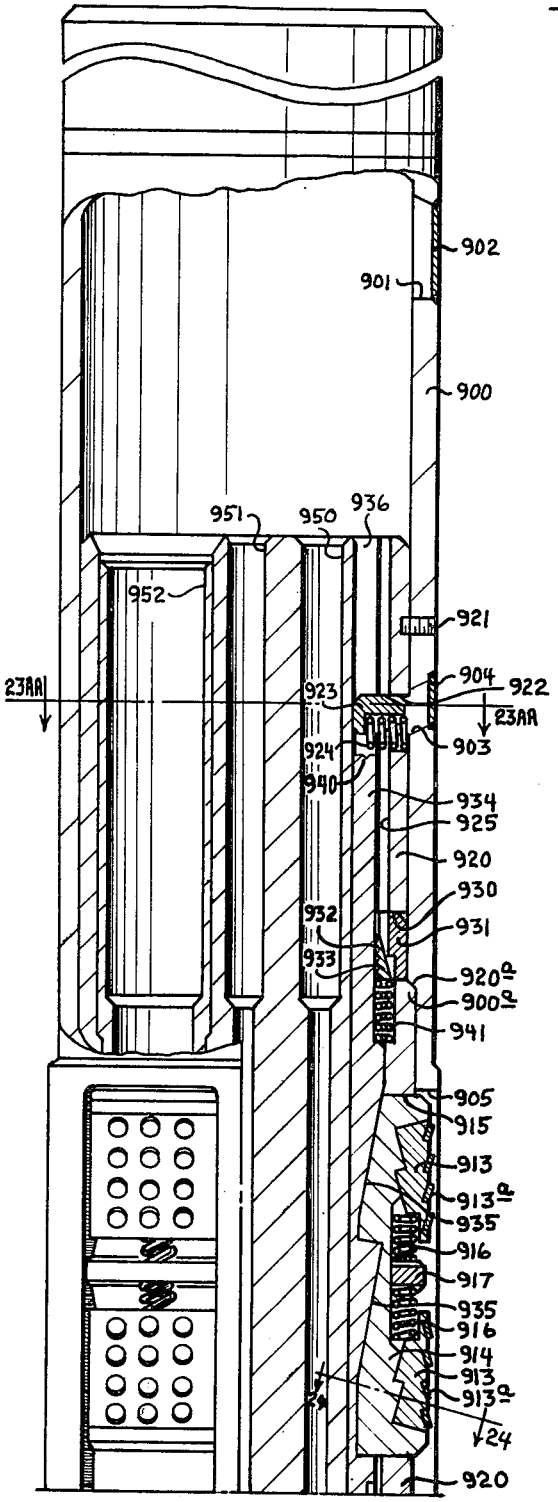
Figure 23B:
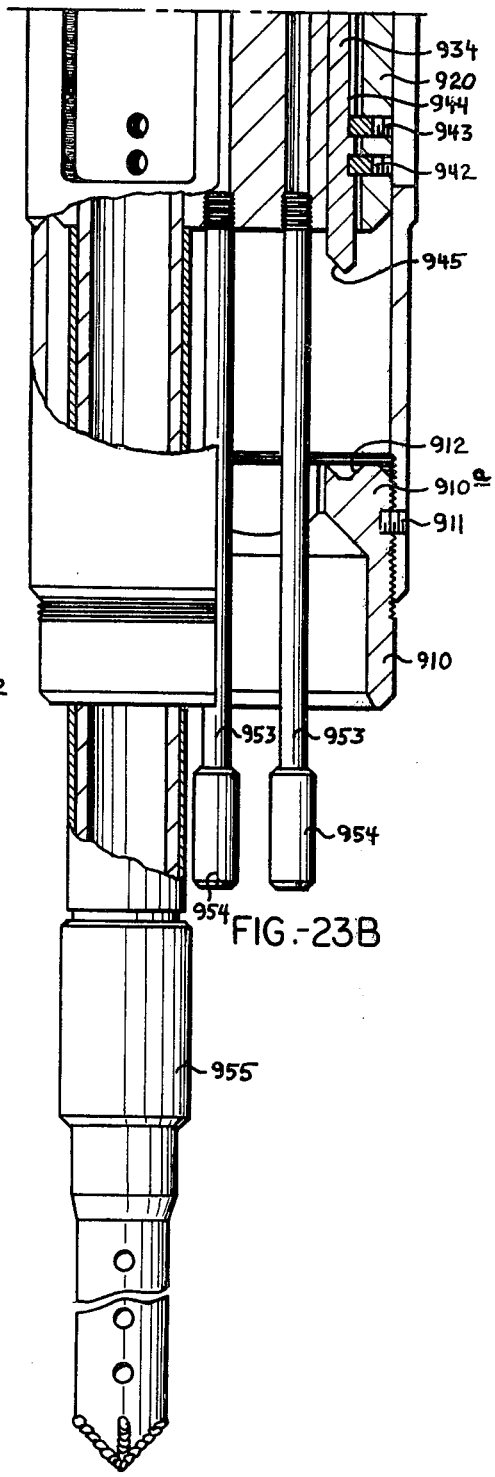
Figure 25A:
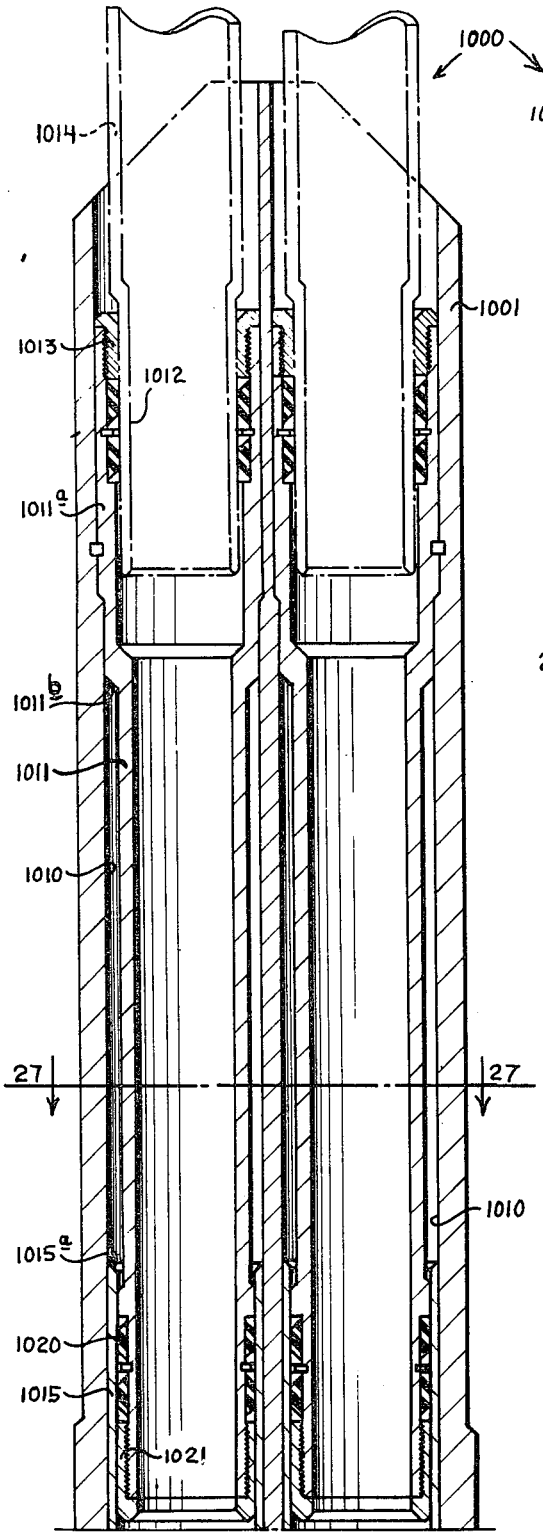
Figure 25B:
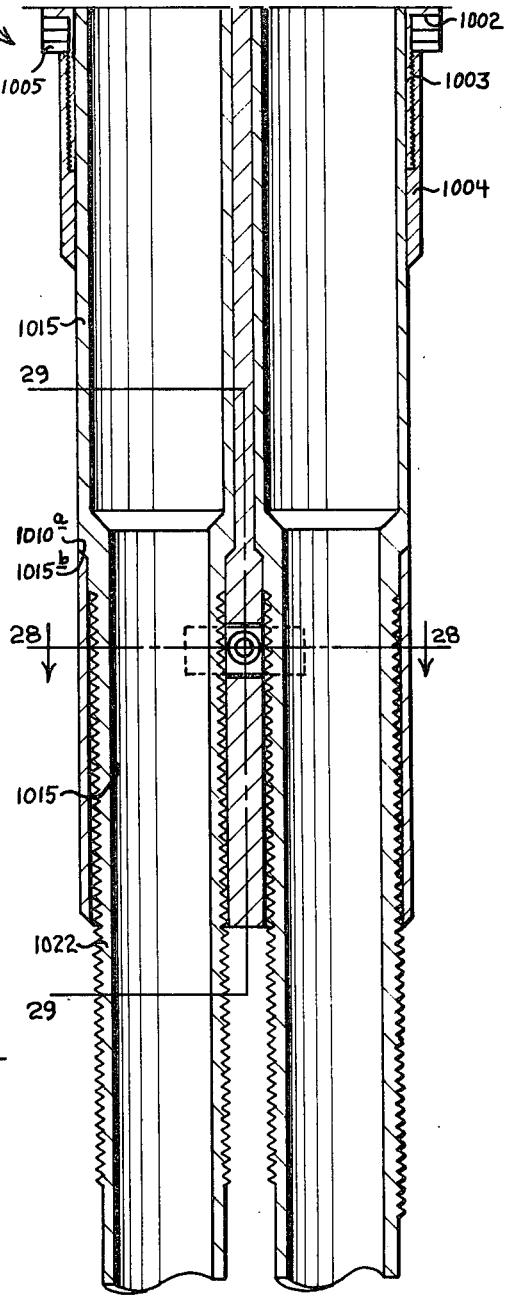
Figure 30:
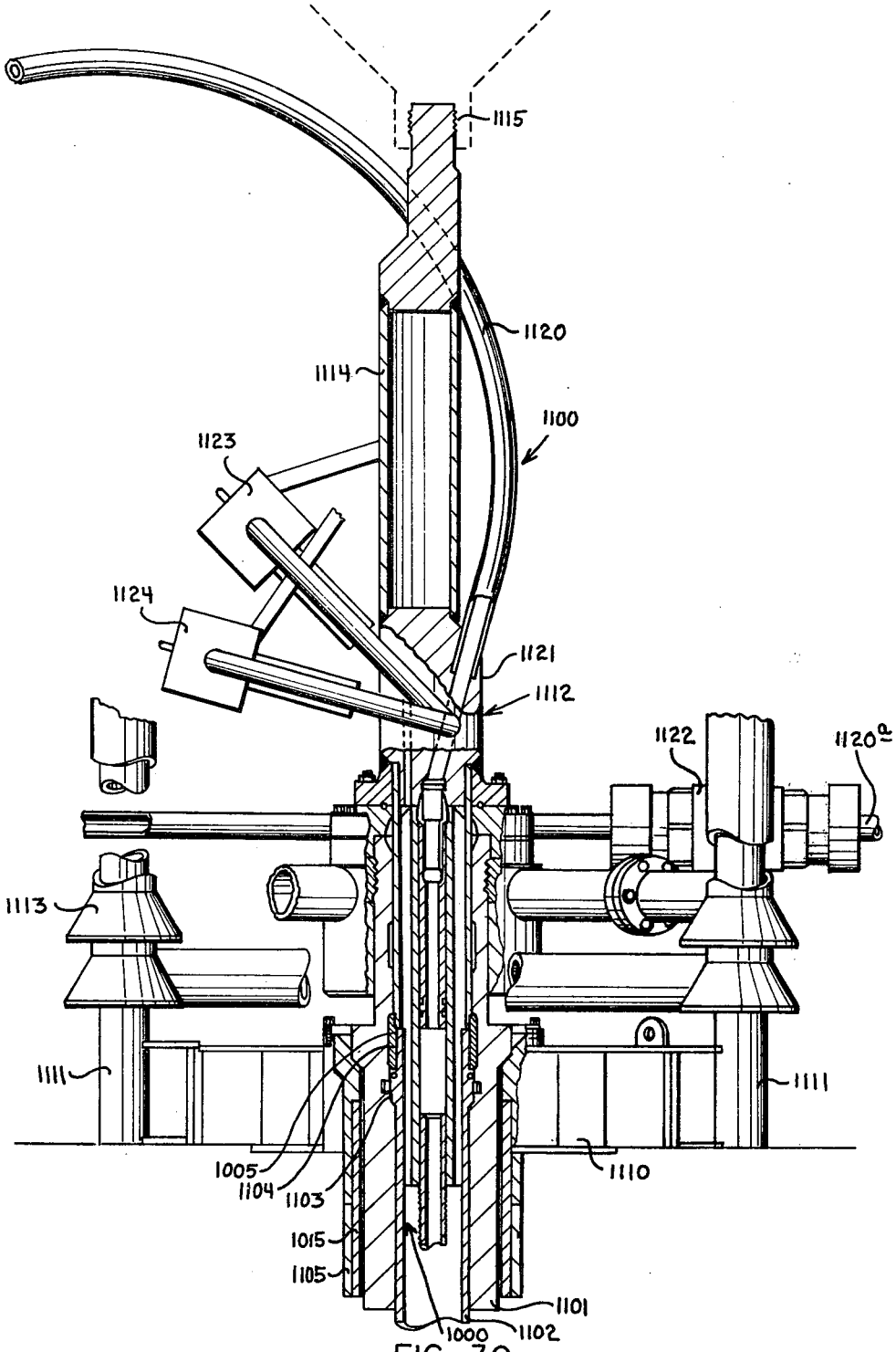
Figure 31:
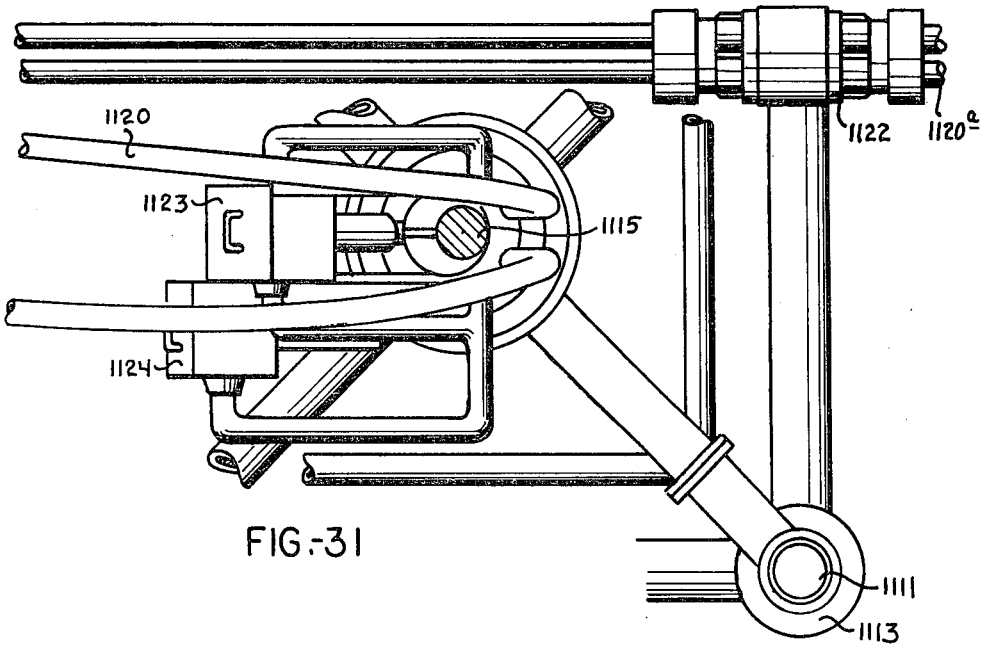
Figure 33:
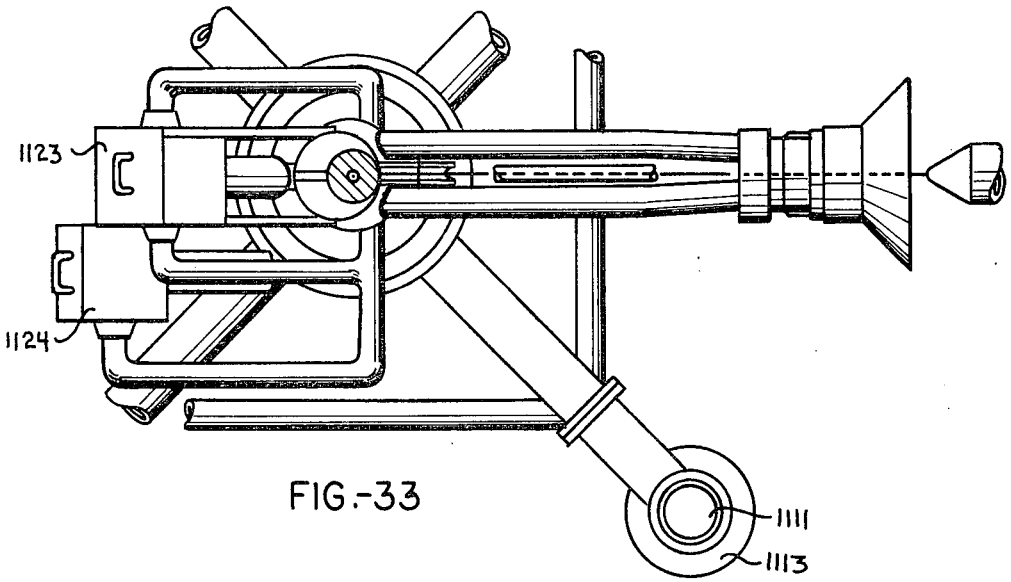
Figure 32:
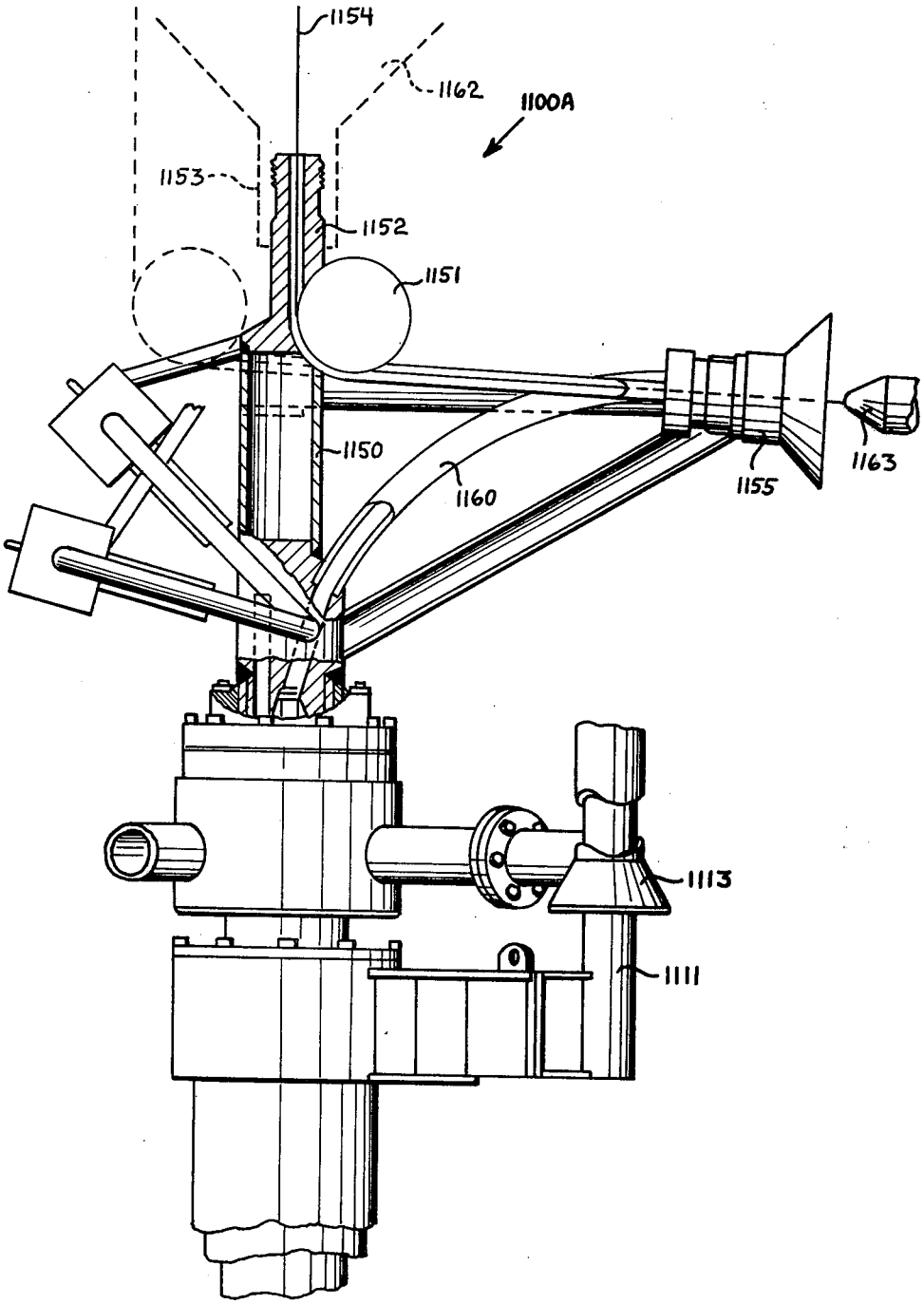
Figure 34:
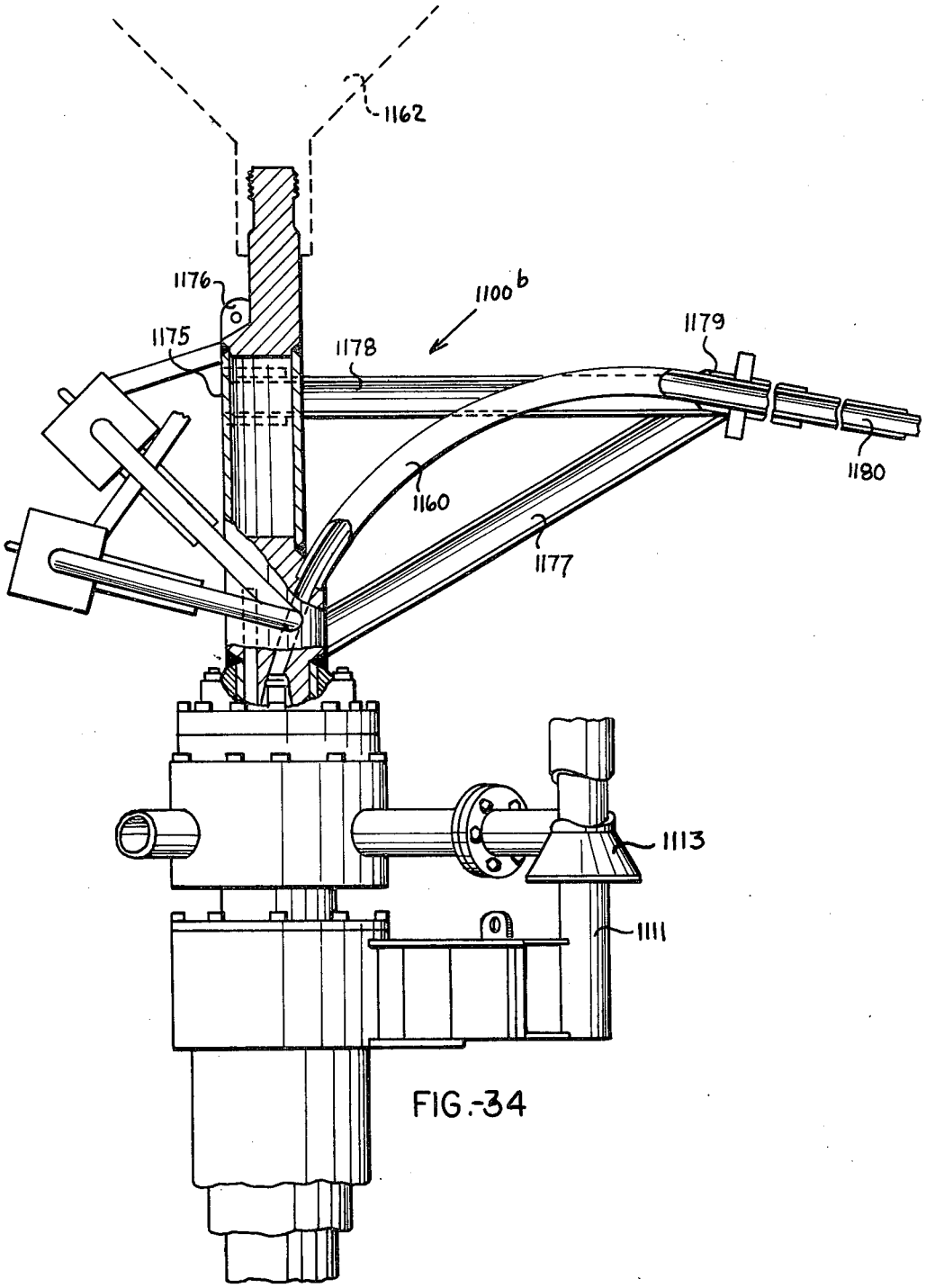
Figure 35:
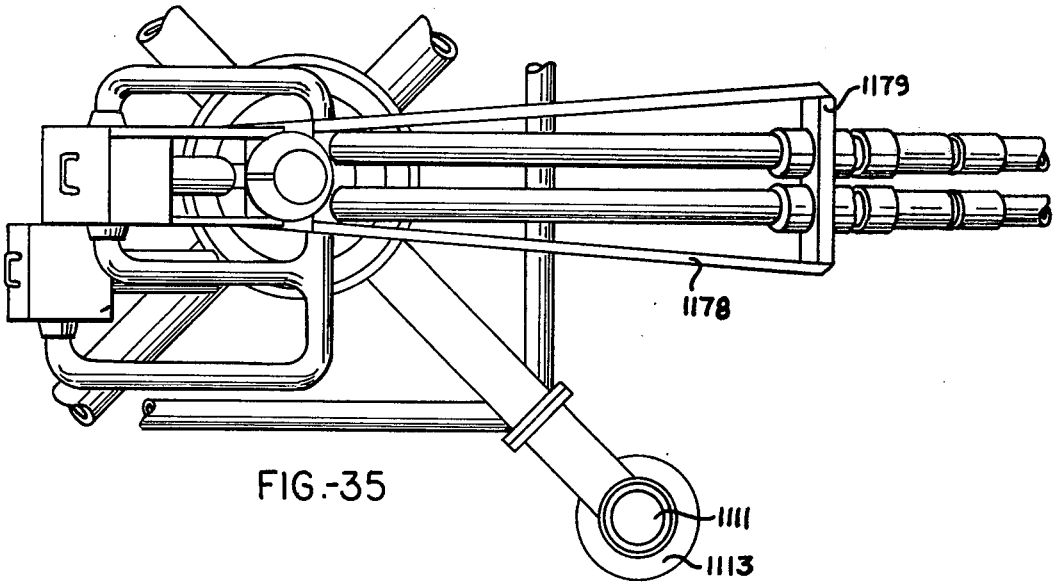
Figure 37:
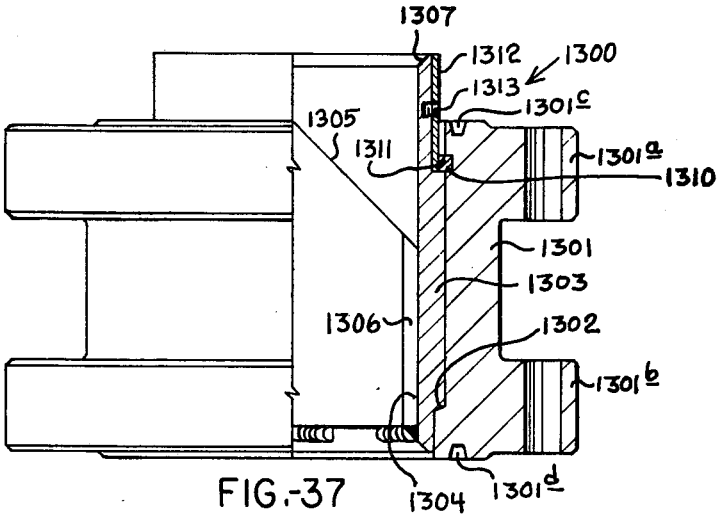
Figures 36A, 36B:
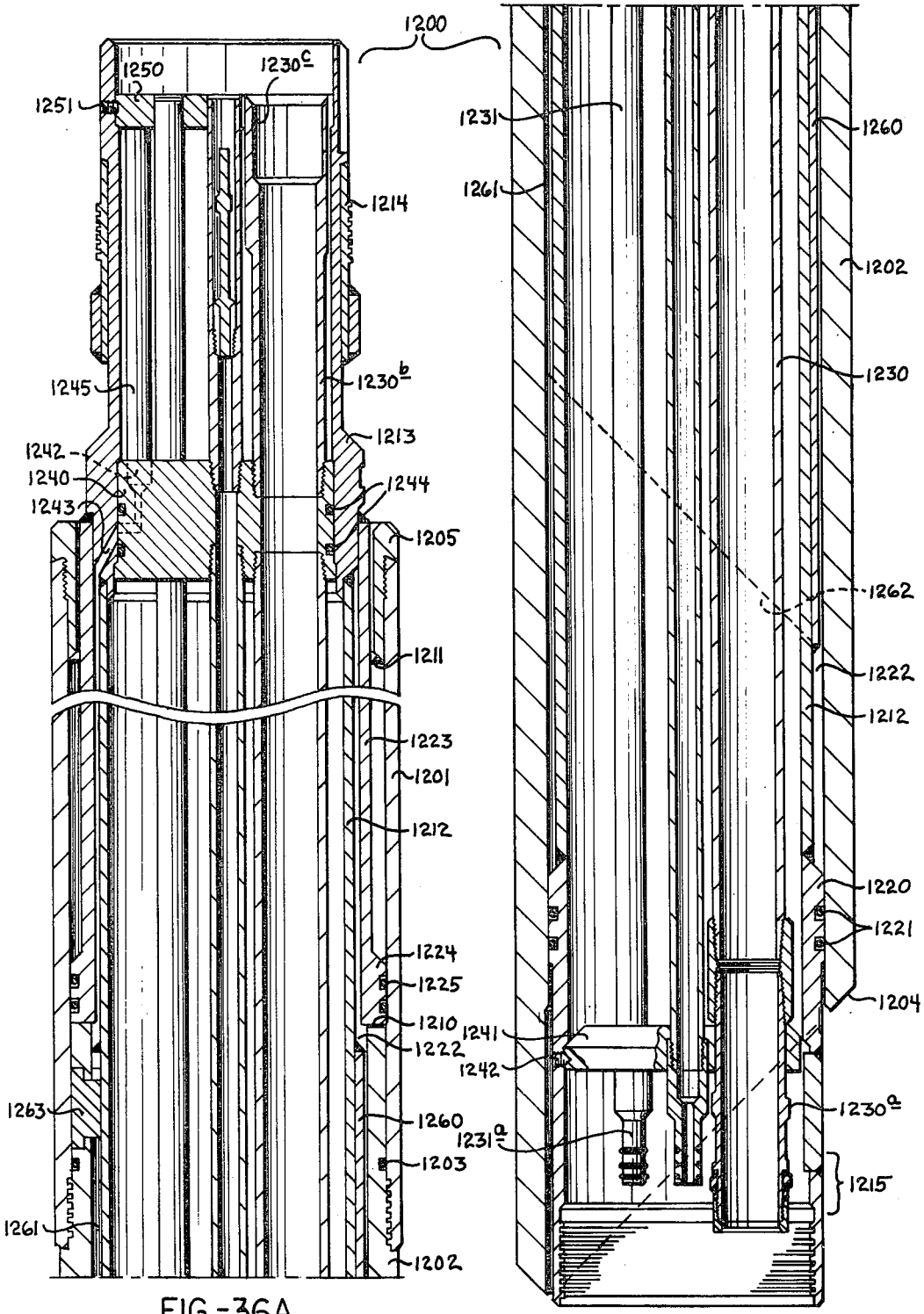

FIG. 12 is an enlarged fragmentary view in section of an inner packing assembly of the tubing hanger encompassed within the lines 12—12 of FIG. 11;

FIGS. 13A and 13B taken together constitute a longitudinal view in section and elevation of a running tool employed in running and pulling the tubing hanber and other components of the well system assembly;

FIG. 13AA is a top plan view of the upper end of the running tool of FIGS. 13A and 13B;

FIG. 13AAA is a fragmentary longitudinal view in section taken along a vertical plane of FIG. 13A revolved from the plane of FIG. 13A to show the vertical and lateral control fluid passage leading to the annular control cylinders of the tool;

FIG. 13BB is a view in section along the line 13BB—13BB of FIG. 13B;

FIG. 14 is a fragmentary view in section and elevation of the running tool illustrating the tool when equipped with three tubing head setting keys;

FIG. 15 is a fragmentary view in section and elevation of the portion of the running tool shown in FIG. 14 when the tool is equipped wit a set of the tubing hanger setting keys;

FIG. 16 is a fragmentary view in section and elevation similar to FIGS. 14 and 15 showing the same portion of the running tool when the tool is equipped with a set of tubing hanger release keys;

FIGS. 17A and 17B taken together constitute a longitudinal view in section and elevation of one of the composite couplers which make up the composite handling string used in the system and illustrated schematically in FIGS. 3, 4, and 5;

FIGS. 18A and 18B taken together constitute a longitudinal view in section and elevation of a slip joint used in the composite string as illustrated schematically in FIG. 3;

FIGS. 19A and 19B taken together constitute a longitudinal view in section and elevation of a ball valve package lock used to couple the tubing string above the tubing hanger into the tubing hanger as illustrated schematically in FIG. 4;

FIG. 19AA is a fragmentary exploded view in perspective of the locking finger operating and retainer assembly of the package lock shown in FIG. 19A;

FIG. 19BB is a view in section along the line 19BB—19BB of FIG. 19B;

FIG. 19BBB is a longitudinal view in section showing a velocity check valve in the check valve of FIG. 19B;

FIG. 20 is a fragmentary view in section and elevation of the lower end of the ball valve package lock taken along another vertical plane from that along which the view in FIGS. 19A and 19B is seen;

FIGS. 21A and 21B taken together constitute a longitudinal view in section and elevation of the safety joint used in the well system and illustrated schematically in FIG. 4 to provide an emergency parting of the tubing string as further represented schematically in FIG. 5;

FIG. 21BB is a view in section along the line 21BB—21BB of FIG. 21B;

FIGS. 22A and 22B taken together constitute a longitudinal view partially broken away in section showing other features of the safety joint illustrated in FIGS. 21A and 21B;

FIGS. 23A and 23B constitute a longitudinal view in section and elevation of a tubing head used in one form of the well system;

FIG. 23AA is a view in section along the line 23AA—23AA of FIG. 23A;

FIG. 24 is a fragmentary enlarged view in section taken along the line 24—24 of FIG. 23A showing the manner of coupling the locking slips with the slip weldment of the tubing head shown in FIGS. 23A and 23B;

FIGS. 25A and 25B taken togehter constitute a longitudinal view in section and elevation of another form of tubing head employed in the system;

FIG. 26 is a top view in elevation of the tubing head as illustrated in FIG. 25A with the tubing strings removed from the upper end of the head;

FIG. 27 is a view in section along the line 27—27 of the tubing head as seen in FIG. 25A;

FIG. 28 is a view in section of the tubing head along the line 28—28 of FIG. 25B;

FIG. 29 is a longitudinal view in section and elevation of a portion of the tubing head as seen along the line 29—29 of FIG. 25B;

FIG. 30 is a fragmentary schematic side view in section and elevation of a wellhead including a 270 degree loop and flow-line connector;

FIG. 31 is a fragmentary schematic top view in elevation of the wellhead shown in FIG. 30;

FIG. 32 is a fragmentary side view in elevation and section of a wellhead including a retrievable flowline cable and connector;

FIG. 33 is a fragmentary schematic top view of the wellhead illustrated in FIG. 32;

FIG. 34 is a fragmentary schematic side view in elevation and section of a wellhead without a flowline connector;

FIG. 35 is a fragmentary schematic top view of the wellhead shown in FIG. 34;

FIGS. 36A and 36B taken together constitute a longitudinal view in section and elevtion of a hydraulic stop and orienting tool for the composite string when used for floating vessels and the like;

FIG. 36C is a fragmentary side view in elevation of the internal orienting sleeve of the tool of FIGS. 36A and 36B;

FIG. 37 is a longitudinal view in section and elevation of a no-go flange used to support the slip joint of FIGS. 18A and 18B;

FIG. 37A is a longitudinal view in section and elevation of a no-go flange used to support the stop and orienting tool of FIG. 36A and 36B; and FIG. 38 is a longitudinal view in section of a wear bushing and a running tool therefor used in protecting the casing hanger when drilling out cement.

Figure 1A:
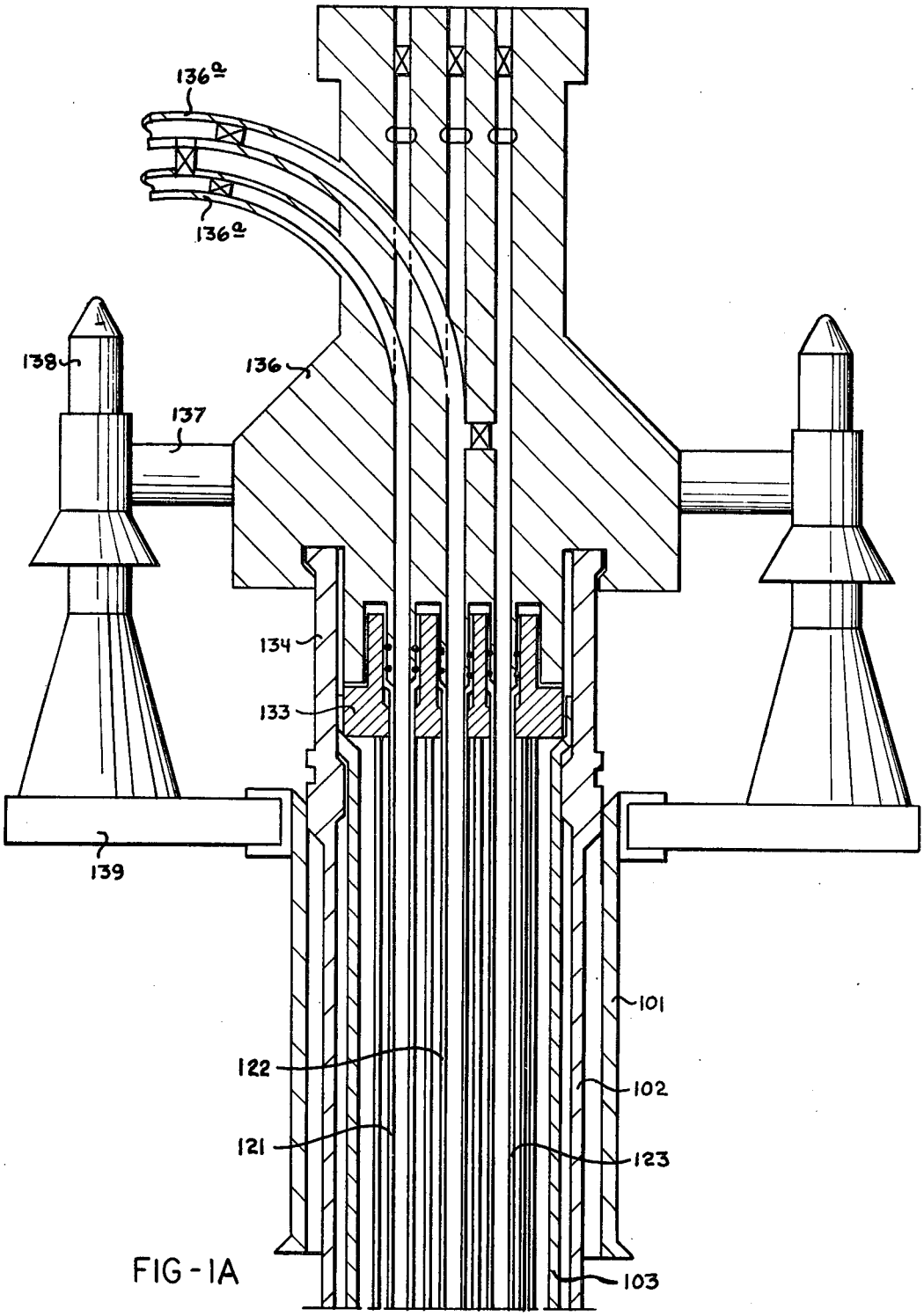
Figure 1B:
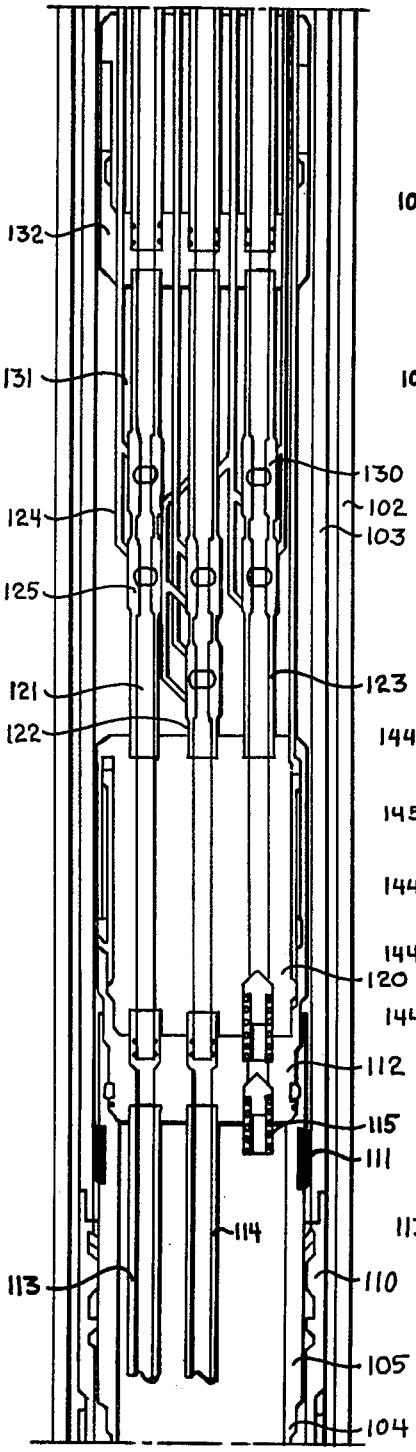
Figure 1C:
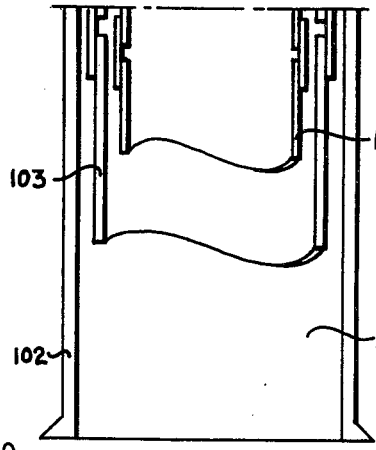

Referring to FIGS. 1A, 1B, and 1C, a well 100 drilled for the purpose of production of petroleum oil and/or gas is lined by a system of concentric casing strings 101, 102, and 103 which line the well from the surface to a desired in the well depending upon the character of the formation pentrated by the well. The casing serves a multitude of functions including preventing caving in of the wall and excluding well fluids from flowing into the well along those formations not to be produced through the well. Where a formation or a portion of a formation is to be produced, the casing is perforated to allow fluid flow into the well bore. The number and size of the casing strings will depend upon the depth of the well and other factors such as the character of the formations through which the well is drilled. For example, the string of casing 101 extends from the surface downwardly only a short distance, such as about 100 to 110 feet. The second string of casing 102 extends to a substantially greater depth. The third string of casing 103 extends from the surface to still a greater depth. A fourth string of casing 104 extends to a still greater depth than the string 103 and rather then extending upwardly to the surface is supported from a section of the casing hanger 105 secured to the upper end of the uppermost section of the casing 104 and supported in a casing hanger nipple 110 connected in the forming a part of the casing string 103. A packer assembly 111 carried by the casing hanger 105 seals the annulus space defined between the concentrically positioned hanger 105 and the casing above the hanger nipple 110. The casing 104 may, for example, extend through the lowermost formation to be produced through the well. A tubing hanger 112 in accordance with the invention locks into casing hanger 105 for supporting a plurality of downwardly extending tubing strings 113, 114, and a short tubing section 115 opening into the casing 104 immediately below the tubing hanger. A pressure seal is formed around the tubing hanger with the casing hanger in which the tubing hanger is locked. A valve package lock 120 is releasably secured with the tubing hanger locking the lower ends of a plurality of upper tubing strings 121, 122, and 123 with the tubing hanger for communication into the lower tubing strings 113, 114, and 115 respectively. The tubing strings 121, 122, and 123 are each provided with valves each of which may be suitable tubing removable valves as designated by the reference numberals 124, 125, and 130 each included in the tubing strings 121, 122, and 123 respectively. For example, suitable valves for such purpose are illustrated at page 4002 of the *Composite Catalog of Oil Field Equipment and Services,* 1974-75 Edition, published by World Oil, Houston, Tex. Such valves may be retrieved with the valve package and are controlled by fluid pressure communicated to the valves through separate control lines as, for example, by the control line 131 extending downwardly in the casing annulus along the tubing string 121 to the valve 124. The other valves 125 and 130 are similarly equipped as illustrated for remote control of the valves from the surface end of the well. The tubing strings 121, 122, and 123 connect above the valves into a safety joint 132 which in turn is connected with upper end sections of the tubing strings 121, 122, and 123 as best illustrated in FIG. 1A. Such upper portions extending upwardly to a tubing head 133 supported in a well housing 134 at the upper end of the well connected with the casing 102 as illustrated in FIG. 1A. The well housing 134 has a head 136 connected with a guide frame 137 which engages guide posts 138 on a platform 139 mounted on the surface casing 101. Lateral flowlines 136*a* are connected into the head 136. The guide posts and guide frame are standard systems for wellhead installations on ocean bottom wellheads. It will also be understood that the tubing strings may extend to a casing supported tubing head as in FIGS. 23A and 23B. The strings of upper tubing 121, 122, and 123 with the valve package lock 120 at the lower end and the tubing head 133 at the upper end and including the safety joint 132 may be run and retrieved as a unit. The safety provides means for emergency parting of the tubing strings above the valves without damage to the valves and the remainder of the well system below the valves. The well may thereby be damaged at the surface and the well system above the safety joint replaced without interference with the well below the safety joint. The seal arrangement of the tubing hanger 112 below the valve system establishes an effective wellhead which is below the mudline in of offshore well and substantially below the frost zone in a well such as in the Arctic areas. The seal point in the well around the tubing hanger is thereby removed from the surface end of the well substantially downwardly to a much safer zone below the mudline. The weight of the lower tubing strings 113, 114, and 115 and the weight of the lower casing string 104 are all supported from a point substantially down the well below the mudline rather than from the surface end of the well or from a platform in such areas as offshore wells.

The well system illustrated in FIGS. 1A-1C is installed and serviced as broadly represented in the schematic showings of FIGS. 2, 3, 4, and 5. The casing strings 101, 102, and 103 are installed by suitable standard procedures which form no part of the present invention. The casing string 104 is inserted into and suspended in the well from the casing hanger nipple 110 by the procedure illustrated in FIG. 2. A casing hanger and packer 135 is connected with the upper end of the top section of the casing string 104. The hanger and packer 135 is releasably coupled with a packer and hanger running tool 140 which is suspended in the well bore by handling string which may be formed of conventional drill pipe. The casing 104 will be run into and set within the casing 103 by locking the casing hanger and packer 135 in the casing landing nipple 110. While the running tool 140 is in place, the casing 104 will be cemented in place by pumping cement through the drill pipe and handling tool in a suitable conventional manner. It is understood that the packer is set only after the cementing procedure. The drill pipe handling string is then disengaged from the casing hanger and packer 135 and the running tool 140 and drill pipe handling string are retrieved from the well bore.

At this stage, it is necessry to drill out the cement to prepare the well for completion. In carrying out this step, the bore surfaces of the casing head of FIGS. 6A and 6B, or the emergency seal of FIGS. 8A and 8B, are protected by the wear bushing of FIG. 38 which is run and pulled by means of the handling tool shown also in FIG. 38.

The next step in the installation of the well system is illustrated schematically in FIG. 3. This step involves the running into the well of the tubing strings 113 and 114 on the tubing hanger 112 and locking the tubing hanger in the casing hanger 105. The tubing strings and tubing hanger are run into the well on a handling tool 142 supported on and controlled by a composite string 143 made up of a plurality of identical composite string sections 144 coupled together to form the string and including a slip joint 145 or a hydraulic stop and orienting tool 1200 located along the length of the composite string to place the tool through a set of blowout preventers, not shown, at the wellhead as the composite string is supporting the running tool 142 for setting the tubing hanger 112. The slip joint of FIGS. 18A and 18B, or the hydraulic stop of FIGS. 36A and 36B, perform three functions. First, the gross orientation of the composite string and supported equipment is effected by landing the slip joint or stop and orientating tool at a supporting flange assembly. The flange assembly of FIG. 37 is used with the slip joint. If the hydraulic stop is used, this step includes use of the flange assembly of FIG. 37A. Secondly, the vertical travel function of the slip joint of hydraluic stop is used to land the supported completion equipment. Thirdly, the weight of the system is transferred from the drilling vessel to the slip joint or hydraulic stop to prevent relative motion caused by heave resulting from wave action and related motions. If using the slip joint, it is fully landed in the flange of FIG. 37 to carry the weight above it. If using the hydraulic stop, it is pressured sufficiently to carry the weight above and below the stop. The tubing strings 113 and 114 may be fitted with suitable packers, not shown, where the strings will extend to separate producing formations. Such packers may be hydraulically set when the tubing strings have been secured at the proper depth in the well bore. Such arrangements which typically may be made are illustrated, for example, at pages 3918 and 3919 of the 1974-75 Edition of the *Composite Catalog of Oil Field Equipment and Services* published by World Oil, Houston, Texas. After the tubing strings and the tubing hanger have been installed at the proper depth, such packers and other related equipment may be actuated in a standard manner. Subsequent to the complete installation of the tubing strings, the hanger, and any related equipment connected thereto the running tool 142 is disengaged and retrieved by means of the composite string.

The next step in the installation of the well system is the running of the assembly comprising the valve package lock 120, the upper tubing strings 121, 122, and 123, the slip joint 132, and the tubing head 133. This assembly is lowered as a unit as illustrated in FIG. 4 supported by the composite string and the handling tool 142 for lowering the tubing assembly into place in the well bore. The assembly is run into the well until the valve package lock 120 is coupled into the tubing hanger 112 and the tubing head 133 is landed and locked in the well housing 134. All connections, valves, etc., are pressure and function tested; well flow may be effected for testing and the like; and the well is killed by standard practices including pumping in completion fluids. Plugs may be used to prevent contamination of the producing zone. With the well so controlled, the handling tool is then disconnected from the tubing head and the composite string is withdrawn. Such connections as desired are then made with the wellhead housing for producing and servicing the well.

As suggested in FIG. 5, the safety joint 132 provides a coupling at which the tubing string system may be severed or broken in the event of damage to the well system at the wellhead housing, such as being struck by a ship. Such an accident will pull the tubing string system apart at the safety joint. The composite string including the handling tool 142 may then be run into the well bore with the handling tool coupled into the safety joint for removing the upper tubing strings 121, 122, and 123 along with the associated valves down through the package lock 120 which is disconnectible from the tubing hanger 112. The assembly of the tubing strings and related equipment is thus removed down through the package lock for repair at the surface and reinsertion to restore the well to normal operating condition. If desired, the entire tubing string assembly extending from the tubing head 133 downwardly through the safety joint 132, the tubing strings 121, 122, and 123 with associated valves and the package lock 120 may be removed as a unit for servicing and replacement. Effectively a downhole wellhead has thus been established at the tubing hanger 112 below the mudline and below the removable valves in the upper tubing strings.

While the general organization of the well system of the invention illustrated in FIGS. 1A–1C, and the procedural steps of handling the system are shown schematically in FIGS. 2–5, the specific details of the various units which make up the system are shown in FIGS. 6A through 38. Thus, the specific details of both the apparatus and function of the preferred forms of units comprising the system will be discussed in terms of such drawings.

FIGS. 6A–6C show the details of the casing hanger and packer 105 used to support the casing 104. The casing hanger and packer has a tubular body defined by a seal mandrel 150 and a lock mandrel 151. As shown in FIG. 6B, the lower end of the seal mandrel is threaded into the upper end of the lock mandrel. The upper end of the seal mandrel is provided with internal threads 152 which are employed for coupling the casing hanger and packer with the running tool 140. As shown in FIG. 6A, a tubular handling weld 153 is engaged in the upper end of the seal mandrel for the purpose of protecting the upper end of the mandrel and handling the casing hanger and packer preliminary to coupling the hanger and packer with a string of casing and running the casing into the well bore. The handling weld is removed when the hanger and packer is to be connected to the running tool which must engage the internal threads 152. A locking sleeve 154 is secured around an upper portion of the seal mandrel 150 projecting some distance above the upper end of the seal mandrel when the handling weld 153 is removed as will be understood from FIG. 6A so that the locking sleeve may be driven downwardly by the running tool to expand the hanger seals and hold the locking keys expanded. The seal mandrel 150 is reduced in diameter along a lower portion 150*a*. The locking sleeve 154 is fitted for sliding movement on the seal mandrel 150. Below the locking sleeve a slip retainer ring 155 is fitted in sliding relationship on the seal mandrel for movement along the reduced diameter portion 150*a* of the mandrel. The slip retainer ring has an upwardly opening slot 160 which opens into a triangular internal annular recess 161 housing a slip retainer or locking ring 162 provided with internal teeth to grip the outer surface of the reduced diameter portion 150*a* of the seal mandrel. The slip ring 162 is a split ring which is insertable into the internal recess 161. The ring 162 is urged downwardly by a wave spring 162*a*. The lower end of the locking sleeve 154 is tack welded at a plurality of locations 163 to the upper end edge of the slip retainer ring 155. Thus, the locking sleeve 154, the slip ring 162, and the slip retainer ring 155 are movable downwardly as seen in FIG. 6A on the seal mandrel 150. The slip retainer ring 155 is releasably secured to the seal mandrel by a plurality of circumferentially spaced shear screws 164. An expandable annular seal is formed on the seal mandrel portion 150*a* by end members 165 and central members 170, as shown in FIGS. 6A and 6B. Metal rings 171 are positioned between the several members 165 and 170 forming the expandable seal. The opposite ends of the seal are confined by a backup ring 172 and a retainer 173. An annular wedge wing 174 is secured in overlapping relationship on the upper end of the lock mandrel 151 and the lower end of the seal mandrel 150. The wedge ring is releasably secured on the lock mandrel by a plurality of circumferentially spaced shear screws 175. As shown in FIG. 6B the wedge ring has an internal downwardly opening annular recess portion 174*a* which permits the wedge ring to move downwardly on the upper end portion of the lock mandrel. The wedge ring 174 fits along a reduced diameter upper end portion 151*a* of the lock mandrel with the shear screws 175 holding the wedge ring in a spaced relationship above the lower end of the reduced diameter upper end portion of the lock mandrel. A hold-down lock ring 180 is mounted on the reduced upper end portion 151*a* below the wedge ring 174. The lock ring 180 has upwardly opening circumferentially spaced slots 180*a* defining upwardly extending fingers 180*b* which may be spread outwardly into a nipple recess to perform a hold-down function. The lock mandrel 151 has an external annular recess portion 151*b* around which are a plurality of circumferentially spaced locking keys 181, each of which is biased outwardly by a leaf type spring 182 disposed behind the key within the recess. The keys are held on the lock mandrel by a retainer sleeve 183. The sleeve 183 has circumferentially spaced windows 184 through which the external bosses of the keys extend for locking the casing hanger and packer within the nipple 110. Each of the keys 181 has a downwardly extending fin foot portion 181*a* which extends below the window 184 in which the key is disposed and inside of or behind the sleeve 183 to keep the key from falling out of the window. The sleeve 183 is held on the lock mandrel 151 by a plurality of circumferentially spaced screws 185. A weld ring 190 is secured on the lock mandrel 151 in an external annular recess 151*c* below the ring 183 to hold the ring 183 against downward movememt on the mandrel. The keys 181 and the sleeve 183 are fitted along a reduced diameter portion 151*d* of the mandrel 151 which provides a downwardly facing stop shoulder 151*e* limiting upward movement of the sleeve 183 on the mandrel to a position at which the keys 181 will extend along the reduced diameter mandrel portion above the recess 151*b* to lock the keys outwardly once the hanger and packer is set within the landing nipple in a well. Referring to FIG. 6C, the lower end portion of the lock mandrel 151 is internally threaded at 151*f* for securing the upper end of the string of casing 104 into the casing hanger and packer. The casing hanger and packer 105 provides support for the casing 104 and seals the upper end of the annular between the casing 104 and the casing 103.

The details of the casing hanger and packer running tool 140 are shown in FIGS. 7A and 7B. The tool 140 has a tubular mandrel 200 which basically provides the body of the tool and is threaded along a lower end portion 201 into a tubular bottom sub 202 provided with a threaded lower end portion 203 for securing a suitable tool such as a rubber cement plug, not shown, to the lower end of the handling tool. The upper end of the mandrel 200 is internally threaded at 204 for connection with the handling string 141 for supporting the running tool in a well bore. The tool mandrel 200 has a graduated bore 205 having an upper end portion 205*a* defined above an internal stop shoulder 205*b*. The bore through the handling tool is temporarily plugged during operation of the tool to provide the required hydraulic pressure to actuate the tool by means of a drop plug 210 which is retained in the bore against downward movement by a shear sleeve 211. The drop plug carries an external annual ring seal 212 for sealing around the plug within the bore of the shear sleeve 211. The plug 210 is reduced in diameter along a lower end portion providing a downwardly facing external annular stop shoulder 213 for supporting the plug in the shear sleeve. The shear sleeve is internally splined along a lower end portion of the sleeve bore providing circumferentially spaced internal keys 214. The upper end edges of the keys 214 are engageable by the stop shoulder 213 on the drop plug to support the drop plug within the shear sleeve. The shear sleeve is releasably secured within the bore of the tool mandrel 200 by a shear screw 215 which is fitted through the mandrel with a short inward end portion extending into a shallow external recess of the shear sleeve. Two longitudinally spaced external O-ring seals 220 and 221 are disposed in external annular recesses in the shear sleeve to seal between the shear sleeve and the bore of the mandrel 200 above and below a radial control fluid port 222 formed in the wall of the mandrel. With the drop plug 210 positioned as illustrated in FIG. 7A, fluid pressure on top of the plug within the mandrel bore 205 will force the plug downwardly shearing the screw 215 carrying the shear sleeve 211 downwardly until the lower end edge of the sleeve engages the stop shoulder 205*b* in the mandrel. At this lower end position of the shear sleeve, the upper seal 220 on the sleeve is below the side port 222 sufficiently for fluid pressure to be applied from the bore of the tool mandrel outwardly through the fluid port 222 for purposes of operating the handling tool as described in more detail hereinafter. A stop sleeve 223 is threaded into the bore 205 of the handling tool above the shear sleeve 211 to limit upward movement of the shear sleeve, retain the shear sleeve within the tool mandrel, and keep larger objects out of the shear sleeve to prevent inadvertent shearing of the shear sleeve.

Referring to FIG. 7A, the handling tool mandrel 200 is reduced in diameter along an upper central portion 224 providing a downwardly facing external stop shoulder 225 which prevents upward movement of an annular member 230 supported on the mandrel 200. The mandrel 200 is further reduced in diameter along a portion 231 defining between the member 230 and the tool mandrel an annular fluid operating cylinder 232. An internal O-ring seal 233 is carried in an internal annular recess of the member 230 at a location to position the seal above the mandrel control fluid port 222 to seal the annular cylinder 232 above the port 222 so that operating fluid passing outwardly from the mandrel bore through the port 222 will enter the annular cylinder 232 and flow downwardly therein. The annular member 230 has an external annular O-ring seal 234 positioned in an external annular recess along the lower end portion of the member for sealing with an annular piston member 235 which is slidably positioned around the member 230 on the mandrel 200 for downward movement responsive to operating fluid forced outwardly through the side port 222. The piston 235 has a side wall 235*a* which defines a cylinder, the inside wall surface of which is in a sealed relationship with the ring seal 234. The piston 235 also has an integral lower end portion 235*b* in the form of an annular flange which fits below the lower end of the member 230 and carries an internal annular ring seal 240 forming a seal with the outside wall surface of a retainer sleeve 241 which is formed by a cylindrical portion 241*a* and an integral lower end external annular flange portion 241*b*. The upper end edge of the wall portion 241*a* engages an internal annular triangular shaped flange 230*a* formed within the lower end portion of the member 230 so that the wall portion 241*a* of the sleeve 241 holds the annular member 230 against downward movement. The internal annular flange 230*a* of the member 230 is an integral part of the member 230. The member 230 has a plurality of circumferentially spaced longitudinal bores 230*b* which are drilled into the member from the bottom face of the member through the internal stop flange 230*a* to communicate the operating fluid delivered into the annular cylinder 232 downwardly to the bottom face of the member 230 so the pressure of the operating fluid may be applied to the annular piston 235. The member 230 also has a vertical bore 242 drilled the full length of the member and pluged at the upper end by a closure screw 243. The bore 242 permits the imposition of a fluid pressure downwardly through the member 230 for testing the tool. A spacer sleeve 244 is positioned on the mandrel 220 below the sleeve 241 with the upper end edge of the sleeve 244 engaging the lower end edge of the sleeve 241 to hold the sleeve 241 upwardly against the lower end of the member 230. As external annular ring seal 245 carried by the mandrel 200 seals between the sleeve 244 and the outer surface of the mandrel. An annular piston member 250 is positioned on the mandrel 200 around the sleeves 241 and 244. The piston 250 has an outer cylindrical wall portion 250*a*, an internal annular flange portion 250*b*, and a dependent cylindrical operating skirt portion 250*c*. The top face of the flange portion 250*b* is engageable with the bottom face of the external flange portion 241*b* on the sleeve 241. An external O-ring seal 251 in an external annular recess in the sleeve flange 241*b* seals with the inner wall surface of the annular piston wall 250*a*. An internal annular O-ring seal 252 carried within an internal annular recess in the internal flange 250*b* of the annular piston 250 seals with the outer wall surface of the spacer 244 providing a sealed annular cylinder space within the piston 250 below the sleeve flange 241*b* so that the piston 250 is forced downardly responsive to control fluid introduced beneath the flange portion 241*b* between the ring seals 251 and 252 so that the piston flange 250*b* is forced downwardly by the control fluid pressure. Such control fluid pressure is communicated into the piston 250 beneath the flange 241*b* through vertical internal circumferentially spaced slots 241*c* provided within the sleeve wall portion 241*a* and communicating with flow passages 241*d* provided in the flange portion 241*b* of the sleeve 241. An operating fluid pressure communicated through the side port 222 in the mandrel 200 enters the annulus 232 applying a downward force on the piston flange 235*b* and simultaneously flows downwardly through the vertical slots 241*c* in the sleeve 241 to the passages 241*d* applying a downward force to the piston flange 250*b* so that simultaneously the annular piston member 235 and the annular piston member 250 are forced downwardly applying downward operating force to the skirt portion 250*c* which forces the operating sleeve 154 downwardly on the casing hanger and packer 105 when the running tool 140 is coupled with the casing hanger and packer 105.

The lower end of the spacer sleeve 244 on the mandrel 200 of the running tool 140, as shown in FIG. 7B, engages the top face of an annular retainer ring 260 on the mandrel above a sleeve shaped spline body 261 which carries a longitudinal key 262. An externally threaded latch nut 263 is slidably disposed on the spline body 261. The nut 263 has an internal longitudinal slot 263*a* which received they key 262 so that when the spline body is rotated the nut is turned by the key while being free to move vertically or longitudinally on the spline body. The spline body has internal longitudinal splines 261*a* which fit within external longitudinal recesses 200*a* in the mandrel 200 so that when the mandrel is turned the spline body is rotated. The latch nut 263 is externally threaded to fit the internal threads 152 in the casing packer and hanger 105 for latching the running tool to the casing packer and hanger. A bottom retainer ring 264 is mounted on the mandrel 200 below the spline body 261. A spacer sleeve 265 is engaged on the mandrel 200 below the retainer ring 264 and held by an annular spacer sub 270. The spacer sub 270 has an internal flange portion 270*a* which is engaged by the upper end edge of the bottom sub 202 holding the spacer sub flange against the bottom edge of the sleeve 265. A supporting ring and seal assembly 272 is supported on the bottom sub 202 for sealing around the handling tool within the apparatus supported on the tool such as the casing hanger and packer 105. The seal assembly includes a ring member 273 supported on a stop shoulder 274 on the bottom sub 202. The ring member 273 has an upper end annular lip or rim 273*a* which defines a recess at the upper end of the member supporting the thrust bearing 271. A pair of external O-ring seals 274 are carried in spaced external annular recesses in the member 273. A pair of internal O-ring seals 275 are similarly supported in spaced internal annular recesses within the ring member 273 for sealing between the member and the bottom sub 202. A ring seal 280 is fitted in an external annular recess along the lower end portion of the portion 201 of the mandrel 200 sealing between the mandrel and the sub 202. The ring 273 lands on the no-go shoulder 150*b* of the tool 105, FIG. 6A, to support the weight of the running string while rotating the nut 263 out of the threads 152, FIG. 6A, to release the tool 140 from the packer 105 or the emergency seal unit 280. All parts of the tool 140 rotate as a unit in the ring 273. The tool remains vertically stationary as the nut unscrews upwardly to release the tool for retrieval.

The running tool 140 is employed for manipulating apparatus such as the casing hanger and packer 105 utilizing the latch nut 263 for coupling the running tool with the hanger and packer and the operating sleeve 250 for actuating the expandable seal assembly of the hanger and packer. The skirt portion 250*c* is inserted into the upper end of the hanger sleeve 154. The shoulder 250*e* engages the upper end edge of the sleeve 154 so that the sleeve is driven downwardly to expand the seals 170 and lock the keys 181 outwardly. The drop plug 210 is dropped through the handling string into the upper end of the mandrel 200 on the shear sleeve 211. Applying fluid pressure in the handling string to the drop plug forces the shear sleeve downwardly opening the side port 222 so that the operating fluid pressure is exerted into the annular space 232 through which it flows to apply downward pressure to the pistons 235*b* and 250*b* driving the operating sleeve 250 downwardly. The handling tool is disconnectible from the hanger and packer by rotation of the handling string turning the mandrel 200. The spline 261 coacting with the key 262 turns the nut 263 disengaging the nut from the hanger and the packer. As the nut is turned, it travels upwardly on the running tool mandrel 200 allowing it to unscrew from the hanger and packer head end.

FIGS. 8A, 8B, and 8C show an emergency seal unit which may be run with the running tool 140 and coupled into the casing hanger and packer 105 in the event that the seal on the hanger and packer does not effectively seal around the tool in the hanger landing nipple. The seal unit 280 has a body formed by an upper tubular seal mandrel 281 and a lower latch and seal mandrel 282 which threads onto the bottom of the upper seal mandrel. As illustrated in FIG. 8A a tubular handling weld 283 is threaded into the upper end of the mandrel 281 for protecting the threads at the upper end of the mandrel and the operating sleeve and handling the seal unit at the surface when preparing it for running into the well. An operating sleeve 284 is slidably mounted on the upper end portion of the mandrel 281. An upper end portion of the sleeve 284 extends above the upper end of the mandrel when the handling weld 283 is removed. The sleeve 284 is engageable at the upper end by the lower end of the operating cylinder sleeve 250 on the running tool 140 and is secured at the lower end with a slip retainer sleeve 285. The slip retainer sleeve has a slot 290 at the upper end thereof opening into an internal annular triangular shaped recess 291 in which a split slip ring 292 is disposed for locking the slip retainer 285 on the mandrel 281 against upward movement. The slip ring is biased downwardly by a wave spring 292*a* to lock the slip ring downwardly when the seal 301 is expanded. The upper end of the slip ring 285 is tack welded at a plurality of circumferentially spaced locations 293 with the lower end edge of the sleeve 284. The slip retainer ring is held on the mandrel by a plurality of shear screws 294 which are sized to release when a predetermined force is applied to the retainer ring by the sleeve 284. The lower end of the retainer ring engages a backup ring 295 fitted against an element retainer 300 which prevents the extrusion of the upper element of a seal assembly 301 formed by an upper element 302, intermediate elements 303 and 304, and a lower element 305. Annular rings 310 are fitted between the elements to aid in uniformly expanding and retaining the shape of the seal assembly. An annular retainer element 311 and a backup ring 312 are secured at the lower end of the seal assembly to prevent extrusion of the lower element 305 when the seal assembly is expanded. A spacer retainer ring 313 is fitted on the mandrel 281 below the seal assembly. The upper end edge of the mandrel 282 limits downward movement of the ring 313 on the upper mandrel when the seal is driven downwardly against the ring during expansion of the assembly. A shear sleeve 314 is secured by a plurality of shear screws 315 to the lower mandrel 282 for holding in a compressed condition a split nut 320 mounted on an externally threaded portion 321 of the lower mandrel. The shear sleeve has an external annular tapered stop shoulder 322 which is engageable with a stop shoulder 150*b* in the hanger and packer 105, FIG. 6A, when the emergency seal unit 280 is landed in the hanger and packer. When such a landing of the seal unit is effected in the hanger and packer, the screws 315 are sheared so that the mandrel 282 is driven downwardly in the shear sleeve 314 exposing the split nut 321 which collapses sufficiently to stab into the threads 152 of the hanger and packer 105. After the split nut is stabbed into the threads the nut expands to latch with the threads coupling the emergency seal unit with the hanger and packer mandrel. The seal unit may be rotated to disengage the threads of the split nut from the hanger and packer threads. After the seal unit is so latched with the hanger and packer, seals 323 can be tested and then the sleeve 284 is driven downwardly forcing the slip retainer 285 downwardly expanding the seal assembly 301. Referring to FIG. 8C, a pair of identical annular seals 323 are mounted on the lower end portion of the lower mandrel 282 of the emergency seal unit. A SPIR-O-LOX ring is secured on the mandrel between the seals 323. An annular end cap 325 is threaded on the lower end of the mandrel 282 below the lower seal 323. The seals 323 seal with the bore surface of the hanger and packer 105 along the mandrel portion 150*a* below the stop shoulder 150*b*. It will be understood that the emergency seal unit 280 is only used in the event of failure of the seal assembly on the hanger and packer 105. Should such seal assembly on the hanger and packer not fail, there will be no need for use of emergency seal unit 280.

FIGS. 9A, 9B, 9BB, 9C, 10, 11, 11A, 11B, and 12 illustrate the tubing hanger 112 of the invention used to support the tubing strings 113 and 114 in a well from the casing hanger and packer 105. The tubing hanger has a body 330 which has a slightly reduced upper tubular portion 330*a* and a lower portion 330*b* which is vertically bored to provide three longitudinal separate spaced apart flow passages for communication into the three tubing connections 113, 114, and 115 secured into the lower end of the hanger. The upper portion 330*a* of the body is slightly reduced in diameter and contoured along an upper end edge 331 leading to a vertical slot 323 to provide a guide and orienting surface for coupling and properly aligning the valve package lock 120 in the hanger. A tubular sleeve 333 is secured on the reduced body portion 330*a* providing a wall at the upper end of the hanger above the guide surface 331. The upper end edge of the reduced body portion 330*a* is defined by two diametrically opposite guide surfaces 331 which lead to a vertical slot 332 formed in the portion 330*a* for orientation purposes of such other tools as are coupled with the tubing hanger including the valve package lock. The sleeve 333 is welded at 334 to the body 330 at the lower end of the upper body portion 330*a*. The sleeve 333 has a pair of diametrically opposed internal centralizing guide lugs 335 which centralize the mating tool such as a running tool or the valve package lock guiding the tool to a proper rotational position relative to the guide surface 331 as the tool is telescoped into the upper end of the tubing hanger. The guide surfaces 331 are helix shaped for guiding the mating tool downwardly and rotating the tool to the proper orientation at which a guide lug on the tool enters the slot 332. The body 330 has internal locking windows 340 which are closed at the outer surface of the tool body by inserts 341 welded in the windows. An expander collet 342, FIG. 11B, is secured by shear pins 343 with the body 330. The member 342 has an upper end annular ring 344 which slides within the bore of the body 330 and is held within the body by the pin 343. Formed integral with and extending downwardly from the ring 344 are a pair of support fingers 345 and an expander finger 350. The expander fingers 345 and the locking finger 350 are circumferentially spaced evenly about and formed integral with the ring 344 extending downwardly in the ring as seen in FIGS. 9B, 11, and 11B. The body 330 is provided with circumferentially spaced longitudinal channels or slots 351 which are spaced and sized each to receive one of the fingers 345 and 350. One of the slots is shown in FIG. 9B and another of the slots is shown in FIG. 11. Such slots open at upper ends into the upper portion of the body 330 so that the fingers may connect with the ring 344 allowing the ring to be within the upper portion of the body while the fingers extend down the channels along the outer face of the lower portion of the body. The fingers 345 and 350 coact with a locking ring 352 which is a split ring disposed in an external annular recess 353 in the body 330 around the lower portion 330*b* of the body. The lower end portions of the channels 351 intersect the annular recess 353 and are somewhat deeper than the recess so that the fingers 345 may move along the channel behind the ring 352. The ring 352 has an upwardly extending flange portion 352*a*, which projects behind a retainer ring 354 which is welded around the body portion 330 projecting downwardly over the upper portion of the recess 353 to hold the split ring 352 within the recess 353 while allowing expansion and contraction of the split ring 352. The split ring 352 is oriented in the recess 353 to align the spaced ends of the ring within the channel 351 occupied by the locking ring 350, FIG. 10, so that when the member 342 is driven downwardly the fingers 345 move behind the split ring supporting it outwardly while the finger 350 is driven between the spaced ends of the ring 352 to expand the ring to a locked condition. A plurality of socket head set screws 355 are threaded through the body portion 330*b* circumferentially aligned with the fingers 345 and 350 and, as shown in FIGS. 9B and 11, engageable with the outer surfaces of the fingers and with a bottom edge of the ring 344 when the member 342 is driven downwardly to limit the downward movement of the ring after the lock ring 352 is expanded. The finger 350 has a release recess 350*a*. The fingers 345 have similar release recesses 345*a*. When the member 342 is driven downwardly below the lock position, the release recesses 350*a* and 345*a* align with the ring 352 allowing contraction of the ring.

As shown in FIGS. 9B and 11, the body portion 330*b* of the tubing hanger 112 has circumferentially spaced longitudinal bores 360 and 361. There is one bore 360 which communicates with the annular space in the well below the tubing hanger and there are two bores 361, one of which communicates with the tubing string 113 while the other communicates with the tubing string 114, both strings being supported from the tubing hanger. The bore 360 has a reduced diameter portion 360*a* providing a downwardly facing valve surface 360*b* which is engageable by a check valve 362. The check valve is mounted on a valve rod 362*a* which extends downwardly through a spacer and guide member 363 held in the bore by a nipple 364 threaded into the lower end of the bore. A spring 365 confined between the check valve 361 and the spacer and retainer 363 biases the check valve to a closed position against the valve surface 360*b*. A junk catcher 376 having perforations 377, as shown in FIGS. 9, 9C, and 11, is connected to the nipple 364 for communication from the bore 360 into the well below the tubing hanger responsive to downward pressure while the check valve 362 prevents upward flow through the bore from the well below the hanger. A tubular support mandrel 370, FIG. 11, is positioned in each of the bores 361 for supporting the tubing strings 113 and 114 from the hanger. Each of the mandrels 370 is provided with an external stop flange 370*a* for holding the mandrel against downward movement within the bore 361. The bore 361 is reduced in diameter along a lower end portion defining a stop shoulder 361*a*. A seal assembly 371 is confined within the bore 361 around the mandrel 370 between the mandrel flange 370*a* and the stop shoulder 361*a* along the bore 361 so that the weight of a tubing string on the support mandrel 370 compresses and expands the seal assembly 371. The seal assembly 371 is shown in detail in FIG. 12. The seal assembly includes wedges 371*a* at each end of the assembly, a central seal 371*b* which is confined between retainer rings 371*c*, identical upper and lower seals 371*d*, identical upper and lower seals 371*e*, and a seal 371*g* made of different rings of triangular cross section. The central seal 371*b* forms an interference fit between the bore wall of the bore 361 and the outer surface of the mandrel 370 and thus does not require weight for sealing though it is to be understood that the weight of the tubing string on the mandrel compressing the seal assembly does tend to radially expand the central seal 371*b*. The seal components 371*g*, 371*e*, and 371*d* each have different characteristics whereby the components are responsive to different pressures with the cumulative effect being that even at maximum annular pressure no extrusion may occur of the seal materials. When one of the materials tends to extrude, for example, the seal element 371*b*, the seal is held by the seal member 371*d* and when the pressure is high enough to extrude the seal member 371*d*, the seal member 371*e* will still resist extrusion. A pressure which will tend to extrude the seal member 371*e* is resisted by the seal member 371*g*. By the use of mandrels 370 which are sufficiently smaller in diameter than the bores 361, the mandrels may move slightly permitting the stabbing-in of a running tool more easily than possible in a tool where the mandrels are fixed within the tubing hanger body. The slight movement permitted each of the mandrels compensates for some variations in relative dimensions between the tubing hanger and the running tool in those areas of the tools where they are stabbed together. A further benefit of the use of mandrels 370 which are rotatable is that the mandrels can be rotated for facilitating the securing of tubing strings with the tubing hanger. The tubing hanger body portion 330*b* has a lower end external annular recess 372 in which external annular seals 373 are positioned for sealing around the tubing hanger body within the casing hanger 105. An annular spacer ring 374 is positioned along the recess on the body between the seals 373. A seal retainer cap 375 is secured on the lower end of the body portion 330*b* by circumferentially spaced set screws 380. A sleeve 381 is positioned on each of the tubing support mandrels 370 below the cap 375 between the cap and an internally threaded coupling 382 threaded on the lower end portion of the mandrel 370 below the sleeve 381. The coupling 382 is used to connect a tubing string with the support mandrel. Since there are two tubing support assemblies including a mandrel 370 in the tubing hanger, one of such mandrels supports the tubing string 113 while the other supports the tubing string 114. The retainer cap 375 has downwardly and inwardly tapered support shoulder surface 375*a* which is engageable with the internal annular stop shoulder 150*b* of the casing hanger 105, FIG. 6A. When the tubing hanger is so landed in the casing hanger body, the split locking ring 352 on the tubing hanger body is expandable into the internal annular locking recess 150*c* in the tubing hanger body, FIG. 6A. The seals 373 then seal around the tubing hanger body portion 330*b* with the bore wall surface along the casing hanger body 150 above the stop shoulder 150*b*.

The tubing hanger 112 as well as the valve package lock 120 are handled by the composite string supported from the running tool 142 which comprises the bottom unit of the composite string. The running tool 142 is illustrated in FIGS. 13A, 13B, and 14–16. The running tool 143 performs the multiple function of supporting the tubing hanger and providing communication to the various control fluid and other functional flow lines for such purposes as engaging and disengaging the running tool with the tool being handled by the running tool and for setting packers, packer testing, removing and setting plugs, testing stab seals, checking perforations, and other completion procedures which are standard conventional steps in well operations for preparing wells for production. The running tool has a main body 400 through which the various lines are formed and which supports the operating apparatus of the tool including radially expandable and contractible locking keys or lugs 401, FIG. 13B, which are engageable with the windows 340 in the tubing hanger 112 for coupling the running tool with the tubing hanger. The body 400 also supports a plurality of stab seal assemblies 402 which are insertable into the tubing string and annulus flow passages of the tubing hanger for communication through the handling tool into such passages of the hanger. Similarly, the body 400 supports stab seal assemblies 403 which communicate with control fluid flow passages through the body and are insertable into control fluid flow passages of whatever unit is supported from the handling tool to carry out the various previously enumerated well servicing procedural steps.

Referring specifically to FIG. 13A, the body 400 of the running tool 143 is threaded at the upper end thereof into a tubular head member 404 on which an externally threaded coupler 405 is mounted for connection of the running tool with the lower end of the bottom unit 144 of the composite string 143. The head member has alignment slots 407 for an alignment lug in a composite string coupler connected into the running tool to rotationally align the tools with each other. The body 400 is provided with a plurality of longitudinal control fluid flow passages 410 and flow passages 411 for communication with the tubing string and annulus flow passages in the tubing hanger. The number of the passages 410 correspond with the required control fluid passages through the tool body. A tubing connector 412 is threaded into the body 400 communicating with each of the longitudinal flow passages 410 through the body. Similarly a tubular seal mandrel receiver 413 is connected into the body leading to each of the flow passages 410 through the body for communication with the annulus and tubing string flow passages. A support plate 414 is secured within the head 404 by circumferentially spaced set screws 415. The plate 414 is provided with an appropriate number of openings properly spaced and sized to accommodate the various tubular members extending through the plate such as the connectors 412 and the mandrel receivers 413 leading to the flow passages through the body. The plate supports the upper ends of these members and secures them at the head end of the tool.

The running tool 142, as illustrated in FIGS. 13A and 13B, has a tubular operating cylinder 420 which is supported in spaced relation with the body 400 to define a plurality of annular operating fluid control chambers spaced along the body for moving the operating cylinder longitudinally on the body to control such functions as the expansion of the locking keys 401. The lower end of the cylinder 420 is secured on a nut 421 which is slidable on the body to permit vertical movement of the cylinder. The head 404 is secured on the body both by threading and by circumferentially spaced set screws 422. The spacing of the cylinder 420 along the body 400 defines upper, intermediate, and lower operating chambers 423, 424, and 425, respectively. An annular piston 430 is secured between the cylinder 420 and the body 400 and separating the chambers 423 and 424. The piston 430 is connected with the cylinder 420 by set screws 431 so that the piston 430 drives the cylinder 420 upwardly and downwardly. The annular chambers 424 and 425 are separated by an annular cylinder barrier 432 which is secured with the body 400 by set screws 433. An annular piston 434 is positioned in the annular chamber 425 for raising and lowering the control fingers such as the expander fingers 435 used to radially expand the locking keys 401. A drive lug 440 is coupled between the piston 434 and the upper end of each of the expander fingers 435. The body 400 has circumferentially spaced longitudinally extending external slots or recesses 441, each of which accommodates one of the control fingers such as the expander fingers 435. Each of the fingers is secured by a shear pin 442 to the body 400 so that the finger may not slide in the slot 441 until sufficient force has been applied to the head end of the finger by the drive lug 440. As shown in FIG. 13B, the expandable locking keys 401 are held on the body 400 by a retainer 443 which is secured with the body 400 by a plurality of circumferentially spaced shear screws 444 and shear ring segments 444*a*. The retainer 443 has a window 445 for each of the locking keys 401. The keys 401 and the windows 445 are shaped to hold the keys in the windows so that they will not drop out even at expanded positions as shown in FIGS. 13B and 13BB. The retainer 443 is provided with an external guide lug 450 which is engageable with the helical guide surface 331 and the orienting slot 332 in the head end of the tubing hanger 112 for properly aligning the running tool in the tubing hanger head when the running tool is run into the well to connect with and retrieve the tubing hanger. Fluid flow passages 423*a*, 424*a*, and 425*a*, FIG. 13AA, connect between the control fluid passages 410 in the body of the running tool and the control fluid chambers 423, 424, and 425, respectively, for raising and lowering the operating cylinder 420 to extend and retract the control fingers such as the expander fingers 435 of the running tool. Control fluid pressure applied into the upper chamber 423 and the lower chamber 425 applies a downward force on the piston 430 and on the piston 434 forcing the cylinder 420 downwardly and the piston 434 downwardly which drives the lugs 440 downwardly extending downwardly the expander fingers 435 behind the locking keys 401 when the running tool is to be locked in a coupled relationship in the head end of the tubing hanger 112. When retraction of the fingers 435 is desired, the control fluid pressure is applied into the central chamber 424 applying an upward force on the annular piston 430 which by virtue of its connection by the screws 431 to the cylinder 420 raises the cylinder 420. Upward movement of the cylinder 420 lifts the retaining nut 424 applying an upward force on the operating lugs 440 and raising the piston 434 so that the keys 435 are lifted to a position at which they are no longer behind the locking keys 401 so that they may collapse inwardly to release the running tool from the tubing hanger.

FIGS. 14, 15, and 16 are fragmentary views of the lower end portion of the running tool 142 illustrating the use of alternate forms of operating keys for various functions of the running tool 142. FIG. 14 shows the employment of a tubing head set key 451. FIG. 15 shows the use of a tubing hanger set expander key 452. FIG. 16 shows the running tool equipped with a tubing hanger release key 453. These various keys 435, 451, 452, and 453 are interchangeable in the tool. The keys are held by the lugs 440 which are retained by the sleeve 434 and the nut 421. The shear screws 442 are used to restrain the keys against accidental release. The specific functions of the several keys will be explained more fully in connection with a detailed description of the operation of the complete system of the invention.

FIG. 13AA illustrates the arrangement of the flow passages 441 through the handling tool body 400 leading to the annulus and to the two tubing strings 113 and 114. The arrangement and location of the control fluid flow passages 410 are also illustrated in FIG. 13AA, while the functions of these passages may be varied depending upon the steps to be performed with the handling tool. In the particular arrangement of units disclosed, one of the passages 410 carries control fluid to release the valve package lock 120 from the tubing hanger 112; three of the passages 410 carry control fluid for control of the tubing string valves in the strings 121, 122, and 123; and two of the passages 410 conduct fluid for operating the running tool by raising and lowering the cylinder 420 of the tool.

FIGS. 17A and 17B illustrate one of the coupler units 144 which make up the composite handling string 143 for handling the installation of the tubing strings, the package lock, and related well structure. The coupler 144 has a tubular body 500 which has a head portion 501 enlarged along an upper end portion 502 which retains a threaded nut 503 on the head portion providing a male connection for securing the coupler with the lower female end of an identical coupler 144. The coupler body is provided with a lower end section 504 which is secured by welding at 505 with the main central portion of the body 500. The lower end section 504 has internal female threads 510 for connection with the male threads on the nut 503 of an adjacent coupler 144. The lower end 504 of the coupler body has guide lugs 511 which extend internally of the coupler body. The lugs 511 and the matching slots 512 are unevenly spaced about the couplers so that connecting will fit together only in proper rotational orientation. Orientation slots 512 are provided in the upper body section 502 above the nut 503. The lug 511 of one coupler fits the slot 512 of an adjacent connected coupler. The coupler body houses a plurality of tubing assembly sections corresponding in position and number to the tubing strings 113 and 114 and the annulus tubing section 115 connected into the tubing hanger 112 for communicating through the composite string to the tubing strings in related well equipment below the tubing hanger. Also, the coupler housing encloses tubing section assemblies for communication with the control fluid passages 410 in the running tool 142. A support plate 513 is provided for holding the tubing assemblies in proper position within the head end of the coupler housing. The support plate 513 has openings sized and positioned to communicate with the several tubing assembly sections 502 of the coupler body by set screws 514 which are spaced circumferentially around the body head. At the lower end of the coupler body a similar tubing guide 515 is secured within the bore of the lower body portion 504 against a downwardly facing stop shoulder 520 in the body portion 504. A central tubing support member 521 is secured within the bore of an enlarged central body portion 500*a* of the body held in position by circumferentially spaced set screws 522 each of which engages an external recess 523 in the tubing support. A ring seal 524 in an external annular recess 525 of the plate 521 seals between the plate and the enlarged body portion. Each of the larger tubing sections through the coupler body for well and servicing fluids includes a tubular seal mandrel receiver 530 which is threaded at a lower end into the plate 521, a length of tubing 531 threaded at an upper end into the plate 521 aligned with the receiver 530, a tubular coupling 532 threaded on the lower end of the tubing 531, and a tubular seal mandrel 533 threaded into the coupler in alignment with the tubing 531. The seal mandrel 533 is disposed through the plate 515. An external annular seal 534 is held on each of the seal mandrel 533 by an end cap 535. Each of the three tubing assembly sections designed to communicate with the tubing strings 113 and 114 and the annulus communicating nipple 115 are identically constructed within the coupler body 500. The smaller control fluid tubing section assemblies through the coupler each includes: a tubular valve cylinder 540 threaded along the lower end portion into the plate 521; a length of tubing 541 connected into the plate 521 communicating with the valve cyclinder 540 is secured in place by a coupling 542; a tubular cylinder 543, FIG. 17B, connected with the lower end of the tubing 541 by a coupling 541*a* and threaded through the plate 515; a seal 544 along the lower end portion of the cylinder 543; and a seal retainer cap 545 threaded on the lower end of the cylinder 543. Each of the control fluid tubing assemblies in the coupler is so constructed, as indicated along the left side of the FIGS. 17A and 17B.

Each composite coupler 144 is typically about 40 feet long, and a sufficient number of the couplers are used in the well system to provide a composite handling string approximately 200 feet in length to reach to the depth of the tubing hanger 112 in the well. The composite string is both a communication vehicle and mechanical support for the units of the well system manipulated by the running tool 142. A particular feature of the composite couplers is that as the composite string is lowered, if it is necessary to close the blowout preventers around the composite string, the string is subjected to burst rather than collapse pressure. With the preventers closed around the composite string, well pressure is admitted to the string through a side port 550, FIG. 17B, in the lower body section 504 of each of the coupler sections. Along the length of the composite coupler the pressure that is admitted into the coupler housing around the various tubing strings is held longitudinally at the ring seal 524 in the plate 521. By admitting well pressure into the coupler housing, the housing is not subjected to collapse pressure but rather those coupler sections below the blowout preventers would have a balanced pressure across the housing wall while the particular coupler around which the rams of the blowout preventers are closed would have a bursting pressure along that portion of the housing which might project above the preventers.

The composite string 143 includes, in addition to the composite couplers 144, a slip joint 145 to provide adjustability in length, orientation, and stabilized vertical motion to eliminate heave problems of the composite string when manipulating the running tool 142. The slip joint is illustrated in detail in FIGS. 18A and 18B. The slip joint 145 is a telescoping unit having an outer upper housing section 600 and a lower inner housing section 601. An elongated guide lug 602 is secured along the side of the inner housing section 601 between the inner and outer sections of the housing. The outer housing section includes an upper portion 600*a* and a lower portion 600*b* connected by a central coupler 600*c* the upper end edge of which defines a stop shoulder 600*d*. The central coupler 600*c* includes an orientation and guide slot 600*cc* through which the guide lug 602 slides to keep the telescoping inner and outer sections of the slip joint properly oriented relative to each other as they extend and contract. The stop shoulder 600*d* is engageable by an upper stop member 603 around the inner housing 601 and to the upper end of the extension weld 602 when the inner housing 601 is telescopically extended relative to the outer housing 600. Such extension involves a movement of approximately three feet in a typical slip joint employed in the system of invention. An upper end guide member 604 is secured with the upper end of the inner housing section 601 forming an upper end stop and guide on the inner housing section. The upper end of the upper outer housing 600 is threaded on a head member 605 provided with a reduced upper end portion 605*a* which has an end portion 605*b*. A plurality of circumferentially spaced torque lugs 610 are secured in recesses 611 in the head member 605 overlapping the joint between the housing member 600 and the head member 605. The lower half of each of the torque lugs extends into an upwardly opening recess 612 formed in the upper end portion of the housing member 600. The recesses 612 each correspond in size, spacing, and position with the recesses 611. The lugs 610 are each secured by two screws 613 which are threaded into the head 605. The lugs lock the housing member 611 against rotation and thereby prevent the housing members from becoming unscrewed from the head member. A threaded coupling or nut 614 is slidably disposed on the neck portion 605*a* of the head 605 retained on the head by the end portion 605*b*. The threads on the coupler nut 614 are sized and designed to engage the lower end threads 510 in one of the composite string couplers 144 for connecting the upper end of the slip joint with a composite coupler immediately above the slip joint. The lower end of the inner housing section 601 is formed by an integral tubular member 601*a* which is internally threaded to connect with the male threads on the coupler nut 503 at the upper end of a composite coupler 144 or the running tool 142 connected immediately below the slip joint. A guide lug 615 is secured through the wall of the inner lower housing portion 601*a* projecting into the bore of the housing sufficiently to engage the orienting slot 512 at the upper end of an adjacent composite coupler 144 so that the slip joint and coupler are brought together properly oriented to connect together the correct control fluid lines and well flowlines within the coupler and the slip joint and to transmit torque. Similarly, the upper end of the neck portion 605*a* at the head of the slip joint is provided with an orientation slot or recess 605*c* which receives the guide lug 511 of the composite coupler 144 connected with the upper end of the slip joint.

The slip joint 145 is fitted with telescoping well fluid flowline tubing assemblies and control fluid tubing assemblies to accommodate the necessary control fluid and well fluid flow functions performed through the composite string. Such tubing assemblies correspond in number and position as well as function with the tubing assemblies through the composite coupler sections 144. The tubing assemblied through the slip joint are held in position at the head end of the joint by a tubing support 620 secured within the head 605 by circumferentially spaced screws 621. Another tubing support and spacer plate 622 is secured within the upper end of the inner housing section 601 held by set screws 623. At the lower end of the slip joint the tubing assemblies are secured in position by a tubing guide 624 held in the lower end portion 601*a* of the inner housing section by screws 625. Each of the tubing assemblies in the slip joint is arranged to telescope to accommodate the tubing assembly to the various lengths of the slip joint. The top ends of the tubing assemblies are held by a support plate 630 secured by set screws 631 in the upper end portion of the head 605, FIG. 18A.

Each of the well fluid flow line tubing assemblies through the slip joint 145 includes a tubular seal mandrel receiver 632 secured at the upper end thereof through the plate 630 and threaded at the lower end into the plate 620. An upper tubular member 633 is threaded along an upper end into the plate 630 coaxial with the member 632 forming an upper part of the tubing assembly and telescoping into a lower tubing member 634. An annular seal assembly 635 is secured in the upper end portion of the tubing 634 held by an end cap 640 to provide a sliding seal within the upper end of the tube 634 with the outer surface of the tube 633 allowing the tube sections to telescope with the changing length of the slip joint. The seal 635 and cap 640 engage the inner upper tube 633 sufficiently above the lower end of the tube to provide enough overlap for the tubing assembly to extend to the maximum length required of the slip joint. The lower end of the lower outer tube 634 is connected with a lower tubular seal mandrel 641 secured through the plate 624 at the lower end of the inner housing section 601 of the slip joint. An external annular seal 642 is secured on the lower end portion of the seal mandrel 641 by an end cap 643. The seal mandrel 632 at the upper end of the slip joint is designed to accomodate the stab seal 634 of the corresponding tubing assembly through the composite coupler 144 connected with the upper end of the slip joint shown in FIG. 17B. Similarly, the seal 642 at the lower end of the slip joint is designed to stab into the tubular seal mandrel 530 at the upper end of the composite coupler 144 as shown in FIG. 17A. The slip joint is provided with three such tubing assemblies sized and positioned to communicate with the tubing strings 113 and 114 and the annulus flow fitting 115, respectively.

As shown in FIG. 18A, each of the control fluid tubing assemblies through the slip joint has a tubular valve cylinder 644 extending from the plate 630 downwardly and threaded at a lower end into the plate 620. A length of tubing 645 is threaded along an upper end into the plate 620 aligned coaxial with the tubular member 644 and extending downwardly in telescopic relationship into a lower tubing length 650 which is secured at a lower end, FIG. 18B, into the lower guide plate 624 in the lower slip joint housing 601. The tubing sections 645 and 650 are coupled to telescope in overlapping relationship sufficiently to permit maximum extension and contraction of the control fluid tubing assembly within the slip joint during the operation of the slip joint. The upper end of the outer tubing 650 is provided with an end cap 651 which carries internal seals providing a sliding seal between the outer tubing 650 and the inner tubing 645 for sealing between the two tubing lengths as they move in telescopic relationship. The lower end of the tube 650 is connected into a seal sub 652 provided with an external seal 653 held on the sub by an end cap 654. The control fluid tubing assembly is coupled with a corresponding tubing assembly in the composite coupler 144 at the upper end of the slip joint by insertion of the stab seal 544, FIG. 17B, of the composite coupler into the valve cylinder 644. The seal sub 652 with the seal 653 at the lower end of the slip joint stabs into a corresponding valve cylinder member 540 at the upper end of the composits coupler 144 connected with the lower end of the slip joint, FIG. 17A. The other control fluid tubing assemblies through the slip joint are identically constructed to provide control fluid communication through the slip joint between the composite couplers connected with the opposite ends of the slip joint. The guide lug 602 coacts with a helical guide surface and an orienting slot in a landing and orienting no-go flange assembly illustrated in FIG. 37. The downwardly and inwardly tapered lower end edge surface **600*e* is engageable with a stop shoulder in the coupling for supporting the slip joint at the blowout preventers. The flange assembly is connected with the blowout preventers to position the slip joint through the preventers during the operation of the composite handling string 143. The slip joint, therefore, is located along the length of the composite string 143 at a position between adjacent connected composite couplers which will place the slip joint through the blowout preventers when the running tool 142 is at a proper downhole position to carry out the particular function required of it. The telescoping construction of the housing and the tubing assemblies through the housing of the slip joint allow extension and contraction of the slip joint between the limits allowed by its particular design. As shown in FIGS. 18A and 18B, the slip joint is fully retracted with the upper end of the extendable inner housing section 601 engaging the lower end edge of the outer housing head 605. When the slip joint is fully extended, the inner housing section and associated tubing assembly members are telescoped downwardly until the lower edge surface of the stop 603 engages the top surface 600*d* of the coupling member 600*c*** in the outer housing of the slip joint.

FIGS. 19A, 19AA, 19B, 19BB, 19BBB, and 20 illustrate in detail the valve package lock 120 which is secured with the lower ends of the tubing strings 121, 122, and 123, FIG. 4, for coupling such tubing strings into the tubing hanger 112 for communication with the tubing strings 113, 114, and the annulus flow fitting 115 supported from the tubing hanger. The package lock is the lowermost releasably removeable unit of the well flow system assembly which may be inserted and retrieved as an integral assembly extending from the package lock at the bottom end to the tubing head 133 at the top in the wellhead housing. The package lock 120 has a body 700 which is provided with a plurality of spaced longitudinally bores for control fluid flow operation of the latching and release mechanism of the package lock and for conducting fluids through the body to the several tubing strings connected with the package lock such as the strings 121, 122, and 123, as shown in FIG. 4. The first of such bores 701, as shown in FIG. 19B, has a reduced portion **701*a* providing a downwardly facing valve seat surface 702. A check valve 703 is mounted on a valve rod 704 within the bore 701 for engagement with the valve seat 702 to shut off flow through the bore. A spring 705 is compressed between the valve 703 and a spacer 710 is secured in place by the end edge of a seal mandrel 711 threaded into the lower end portion of the bore 701 in the body. As shown in FIG. 19BBB, the valve 703 and the valve rod 704 has a bore 704*a* in which a velocity check valve 706 is disposed. The valve 706 is biased open by a spring 707 and closed by a predetermined upward flow rate. A pair of annular seal assemblies 712 are mounted on the lower end of the seal mandrel held by a guide cap 713 which is open through the central portion thereof to permit fluid flow into a well bore through the cap. The cap 713 and seal 712 on the seal mandrel 711 are adapted to stab into a mating female fitting within the tubing hanger 112. The cap has dependent fingers 713*a* which engage the check valve 362 in the tubing hanger 112 for propping the check valve open when the package lock is landed and locked in the hanger. A velocity check valve 706 is supported in the check valve 703 biased open to allow flow and adapted to close responsive to upward flow in excess of a given value. The upper end of the bore 701 in the body 700 is fitted to receive a tubing string such as the string 123 shown in FIG. 4 for fluid communication to the package lock. The other bores through the body 700 such as the bore 714, FIG. 20, are fitted with a tubing section 715 having a coupling 20 at the upper end thereof for connection of a tubing string and at the lower end being provided with a pair of annular seal assemblies 720 held on the lower end of the tubing by an end cap 721. The end cap 721 and seals 720 are adapted to stab into the upper end of a flow passage in the tubing hanger 112, such as into the upper end of the tubing section 370 shown in FIG. 11**.

The body 700 of the valve package lock 120 has a guide lug 700*a*, FIG. 19B, to coact with the tubing hanger lug 335, guide surface 331, and slot 332, FIG. 9A, for orienting the package lock at the correct rotational position as the package lock is telescoped into the tubing hanger.

The valve package lock 120 is releasably locked in the tubing hanger 112 by expandable keys 722 which are held on the body 700 by a key retainer 723 secured on the body by a plurality of circumferentially spaced shear wire segments 724 and a retainer ring 725. The retainer 723 has an internal annular recess 725*a* extending upwardly from the retainer ring 725 to a shoulder 725*b*. The shear wire segments and retainer ring provide for secondary release of the keys 722 as discussed hereinafter. Three of the keys 722 are employed circumferentially spaced around the tool each in a window 723*a* formed through the wall of the retainer 723. Each key has lateral ears 722*a* holding each key in each window as seen in FIG. 19BB. The keys 722 are each expanded by a key expander finger 730 disposed in and movable longitudinally along a longitudinal recess 731 formed along the body 700. Each of the fingers 730 has an inclined lower end expander surface 730*a* which is engageable with the inside face of the key 722 for expanding the key outwardly in the window 723*a*. The corresponding key windows and key expander fingers are disposed equally spaced about the tool body. The upper end of each of the fingers as shown in FIG. 19A has an outer operating flange 730*b* engaged in an annnular chamber 733 defined between the body 700 and an annular cylinder 734. The cylinder 734 is threaded on an annular retainer cap 735. The upper end of the cap 735 engages an external flange 732*a* on a spacer assembly provided with dependent fingers 732*b*. In assembling the package lock, the key expander fingers 730 are inserted upwardly in the retainer 735 through the circumferentially spaced slots 735*a*. The fingers are then moved around the ring until each flange 730*b* on each finger rests on the top face of one of the retainer flange sections 735*b*. The spacer assembly 732 is inserted downwardly into the retainer 735. The flange fingers 732*b* are aligned with the slots 735*a* so that the fingers enter the slots and the flange 732*a* rests on the top edge of the retainer 735. The fingers 732*b* hold the finger flanges 730*b* spaced around the retainer 735 on the flange 735*b* so that the fingers 730 are held and lifted by the retainer. The top surface of the flange 732*a* on the ring 732 is engaged by the lower end of a spring 740 which is retained at the upper end by a ring 741 secured to the body between the body and the cylinder 734 by circumferentially spaced screws 742. Inner and outer ring seals 743 and 744 seal between the ring 741 and the outer surface of the body 700 and the inner surface of the cylinder 734. The spring 740 urges the ring 732 along with the cap 735 and the cylinder 734 downwardly so that the expander fingers 730 are biased downwardly toward positions behind the keys 722 for expanding the keys outwardly to locking positions. The cylinder 734 has an upper internal end flange 734*a* which carries an internal seal 745 providing a sliding seal between the cylinder flange and the outer wall surface of the body 700. The body 700 is provided with a radially extending control fluid passage 750 which is connected with a central blind bore 751 opening through the upper end of the body for directing control fluid into the body and outwardly through the passage 750 into the annular chamber 733 between the ring 741 and the cylinder flange 734*a*. Control fluid pressure introduced into the chamber 733 above the ring 741 and below the cylinder flange 734*a* lifts the cylinder 734 along with the ring 732 and cap 735 connected within the lower end of the cylinder to raise the expander fingers 730 to a position in which the lower expander surfaces 730*a* are high enough to allow the keys 722 to fully collapse inwardly.

The secondary release feature provided by the shear wire 724 connection of the retainer 723 is used if the hydraulic release of the keys 722 by pressure in the cylinder 733 fails to lift the finger 730. The body 700 is pulled upwardly. The expanded locked keys 722 holds the retainer 723 down so that the wire segments 724 shear releasing the body 700 from the retainer 723. The body is pulled upwardly lifting the fingers 730 due to the connection of the body head through the cylinder 734 to the finger retainer ring 735. When the release surface 730*a* on the fingers 730 moves above the keys 722 the keys collapse inwardly. Engagement of the ring 725 on the body with the shoulder 725*b* in the retainer 723 prevents the retainer and keys from falling off the body.

In running the package lock into the tubing hanger 112 the control fluid is directed into the package lock operating chamber 733 for raising the finger 730 so that the keys 722 may collapse inwardly to allow the keys to be aligned within the tubing hanger 112 with the windows 340 in the upper end of the hanger, FIG. 9A. When the package lock is seated in the tubing hanger, relaxation of the control fluid pressure permits the spring 733 to expand returning the cylinder 734 downwardly forcing the key expander finger 730 downwardly to expand and lock the locking key 722 outwardly in the locking windows of the tubing hanger. In raising the expander fingers 730 for release of the keys 722, the upward movement of the keys and the cylinder 734 is arrested by the engagement of the upper end of the fingers 730 with the upper ends of the body slots 731 as evident in FIG. 19A.

FIGS. 21A and 21B taken together and FIGS. 22A and 22B taken together form two longitudinal views along different vertical planes of the safety joint 132 which provides a safety function of separating the flowlines above the ball safety valves in the event of a disaster which applies an excessive tension force to the assembly of flowlines above the safety joint. The separation at the safety joint leaves an upwardly facing profile which accepts the running tool 142 to permit retrieval of the flowline string below the safety joint down through the ball valve package lock 120. The safety joint has an outer tubular body weld 800 formed by an upper outer sleeve portion 801, an upper inner sleeve portion 802, and a lower portion 803 which has a reduced internally bored threaded lower end portion 803*a*. The upper body weld portions 801 and 802 and the lower portion 803 are secured together to form an outer tubular body which supports the lower control fluids and well fluids flow strings extending downwardly from the safety joint. For example, as shown in FIG. 4, lines 121, 122, and 123 leading to the safety valves are coupled into the lower end of the safety joint. The lower outer body portion 803 has a plurality of circumferentially spaced inwardly opening locking windows 804 each closed at the outer wall surface of the body member by a plate 805 to exclude foreign matter. The windows each receive a locking key for holding the separable portions of the safety joint together.

The safety joint 132 includes a removable internal locking assembly which telescopes into an external body and is connected with tubing strings extending up the well bore from the safety joint. The internal assembly of the safety joint includes a cylindrical upper body portion 810 threaded along a lower end onto a lower body portion 811 which telescopes into and releasably locks in the outer safety joint body 800. A backup ring 812 is welded on the head end portion of the body 810. A thrust ring 813 is secured on the body portion 811 at the lower end of the body 810. The body 811 has circumferentially-spaced longitudinal slots 814 aligned with the windows 804 each accommodating a longitudinal key expander 815 for operation of expandable and contractible locking keys 820. One locking key 820 is disposed in each of the slots 814 behind a window 804 for outward movement into the window to releasably couple the safety joint together. The locking keys 820 are each expanded and locked outwardly by a longitudinal key expander 821 fitted within a longitudinal slot 814 aligned with a window 804. The locking keys 820 and key expanders 821 are held in position by a retainer sleeve 822 which is counterbored along a lower end portion providing a downwardly facing stop shoulder 823 engageable by an annular retainer wire 824 secured around the lower end portion of the body 811. Each of the key expanders 821 is held with the retainer sleeve 822 by a shear wire 825. The wires 825 are sized to shear in response to a predetermined upward force on the flowline assembly above the safety joint to release the key expanders to allow the locking keys 820 to collapse inwardly. Such an upward force might come from a damaging blow by a ship which lifts the string above the safety joint. The telescoping inner body sections 810 and 811 are lifted upwardly, and after release by the inward collapse of the keys 820, the entire telescoping inner portion of the safety joint is raised upwardly from the outer body 800 leaving the outer body and the lines connected with the lower end of the body in the well while the remaining inner portion of the safety joint connected with the upper lines is pulled upwardly severing the flow string assembly at the safety joint. The upward movement of the inner body 811 after the wires 825 are sheared lifts the retainer wire 824 which engages the shoulder 823 within the key retainer 822 raising the key retainer with the body 811.

As shown in FIGS. 21B and 21BB, the telescoping upper inner body section of the safety joint 120 has a guide lug 826 which engages a guide recess 827 in the sleeve portion 802 of the lower outer section to properly orient the upper inner section as it is telescoped into the lower outer section of the joint.

The inner body 811 of the safety joint 132 has vertical control fluid bores 830 and 831 and well fluids bore 832 as shown in FIGS. 21A and 21B. The lower outer body portion 803 is provided with control fluids passages defined by bores **830*a* and 831*a* which are positioned and sized to align and communicate with the bores 830 and 831 in the removable body 811 telescoped into the body 800. The lower body section 803 also has a vertical well fluids bore 832*a* which is aligned and communicates with the bore 832 of the removable body 811. A well fluids stab assembly 840 is secured into the lower end of the body 811 for insertion in sealed relationship into the lower outer body bore 823*a*. The stab assembly 840 includes a mandrel 841 threaded along an upper end portion, an annular seal assembly 842, and a lower end cap 843. Similarly, a stab assembly 850 is connected into the lower end of the body 811 communicating with each of the bores 830 and 831 for connection into the upper end portions of the bores 830*a* and 831*a* of the lower outer body section 803. Each of the stab assemblies 850 includes a mandrel 851 threaded along the upper end portion, an annular seal assembly 852, and a lower end cap 853. The stab mandrels 840 and 850 fit in sealed relationship into the appropriate bores of the lower body section 803 when the upper telescoping assembly portion of the safety joint is connected with the lower portion of the joint. Conduits 854 and 855 are connected, respectively, into the control fluid bores 830 and 831 of the body 811. Each of these conduits is provided with an upper end coupling for connecting with appropriate lines of the tubing string assembly running upwardly from the safety joint. As shown in FIGS. 22A and 22B and 21B, the safety joint has another vertical well fluids flow passage 860 which communicates with a coupling 861 at the upper end of the safety joint for connection with an appropriate conduit above the safety joint and a coupling 862 at the lower end of the safety joint for connecting with a conduit extending below the safety joint. A conductor 863 connects the coupling 861 with the body 811. The couplings 861 and 862 and the conduits connected thereto defining the flow passage 860 through the safety joint are rotatable in the body sections of the joint to relieve torsional stresses developed along the completion system due to any twisting during installation and service of the system. If not so relieved, such stresses can build up to produce substantial torsional forces. At the lower end of the safety joint, the flow passage 860 is defined by a stab seal assembly 864 which includes a lower end cap 865 and an annular seal assembly 870 which fit into the lower body section 803 communicating with the lower coupling 862. A suitable conduit forming a part of the flow string assembly below the safety joint is connectible into the threaded lower end section of the bore 832*a*, FIG. 21D**. The safety joint, thus, permits emergency separation of the flow string assembly while providing for controlled access back into a well after such emergency parting has occurred.

The next unit of the well system in the flow string assembly above the safety joint 132 is the tubing head 133 which is connected with the safety joint by suitable conduits as required for operating the equipment and for flowing the well.

The tubing head 133, FIGS. 23A and 23B, includes a tubular housing 900 having a head portion provided with inwardly opening running tool locking windows 901. A closure plate 902 is secured along the outer face of the housing 900 over each of the windows 901. Spaced below the windows 901, the housing 900 also has circumferentially-spaced locking key windows 903 which open inwardly and are closed along the outer housing wall by plates 904. Below each locking key window 904, the housing 900 has an elongated locking slip window 905. A support ring 910 is threaded into the lower end of the housing 900 held by socket head set screws 911 threaded through the housing into the support ring. The support ring 910 has an internal annular support flange **910*a* provided with an upwardly facing V-shaped recess 912. As seen in FIGS. 23A and 24, a set of identical upper and lower locking slips 913 is mounted in a slip carriage 914 supported in each housing window 905. Each slip carriage is closely fitted for lateral movement in a window 915 provided within an inner body 920 fitted within the housing 900**.

Each of the locking slips 913 has carbide inserts 913*a* which bite into an inner casing wall to lock the tubing head rigidly against movement both upwardly and downwardly within a well. The body 920 is closely fitted within the housing 900 with sufficient tolerance being provided between the sleeve and housing to permit longitudinal relative movement between such members. A lower portion of the body 920 is enlarged in diameter providing an upwardly facing stop shoulder 920*a* which engages a corresponding downwardly facing stop shoulder 900*a* within the housing 900 thereby limiting upward movement of the body 920 within the housing 900. The body 920 is releasably locked with the housing 900 by a plurality of circumferentially-spaced shear screws 921. The body 900 has a plurality of circumferentially-spaced laterally opening slots 922 each containing a locking lug 923 which is spring-biased inwardly by a spring 924 captured within a recess in the lug and confined between the bottom of the recess and the inner surface of the housing 900. The lateral depth of each locking lug 923 is sufficient to permit it to be cammed outwardly into a locking window 903 of the housing 900 by an operating finger of the running tool 142 to provide an additional interlock between the body 920 and the housing 900 when running the tubing head. The body 920 has internal longitudinal slots 925 opening from the upper end of the body running the full length of the body and aligned circumferentially with and intersecting each slot 922. A key lock 931 having an upwardly and inwardly sloping surface 932 is fitted through the body 920 aligned with each slot 925. A locking key 933 is disposed along each key lock 931 in the slot 925 for engagement with a slip expander 934 in the slot 925. Each longitudinally-movable slip expander 934 within the body 920 in each slot 925 behind each of the slip carriers holds each of the three sets of slips 913 for expanding the slips into the casing wall to lock the tubing head in the casing. As shown in FIG. 24, each slip expander has downwardly and inwardly sloping T-shaped expander surfaces 935 on which the slip carrier 914 is seated as shown in FIGS. 23A and 24. The expander surface 935 on each slip expander fits in a corresponding T-shaped recess 914*a* along the slip carrier 914. The slip carrier is positioned in the window 915 of the sleeve 920 so that the carrier can move only laterally; and, therefore, downward movement of the slip expander 934 forces the slip carrier 914 laterally outwardly to engage the slips 913 with the wall surface of casing. The upper end surface 940 of each slip expander 934 is engageable by an operating finger of the running tool to drive the slip expander downwardly when setting the slips 913. The operating fingers of the running tool enter the upper ends 936 of the slots 925 camming the lugs 923 outwardly into the windows 903 interlocking the inner and outer bodies of the bore while setting the slips 913. A spring 941 confined between each slip expander 934 and the body 920 in the slot 925 biases each locking key 933 upwardly against the sloping surface 932 of each key 931 urging the locking key 933 against the outer surface of the slip expander 934 so that when the slip expander is driven downwardly sufficiently to expand the locking slips 913, the locking key 933 will lock the slip expander at a lower position for holding the slips 913 outwardly against the casing wall.

Each pair of slips 913 in each of the slips carriers 914 is urged apart by springs 916 confined between the slips 913 and a spring retainer 917. The slips are each held on the slip carrier 914 by dove-tailed locking keys 918 as shown in FIG. 24 so that the slips are secured along the slip carrier being longitudinally movable along the face of the carrier. As understood from FIG. 24, the T-shaped expander surfaces 935 holding each slip carriage 914 on the expander allow upward sliding movement along the expander for expansion of the slips. Each slip expander 934 is locked against longitudinal movement in the body 920 by a shear screw 942 threaded through the body into the slip expander. A second locking screw 943 threaded through the body 920 into a longitudinal recess 944 provided along the outer surface of the slip expander 934 limits the longitudinal movement of the slip expander so that in setting the slips 913 the slip expander can move downwardly only a sufficient distance to fully set the strips 913. The lower end surface 945 of each slip expander 934 is shaped to fit the upwardly opening recess 912 in the support ring 910 so that in pulling the tubing head as the housing 900 is lifted upwardly the ring 910 supports and raises the slip expanders 934 for retracting the slips 913 to release the head from the casing wall. The upward travel of the housing 900 initially shears screw 921. When the enlarged bore below the shoulder 920*a* is aligned with each locking key 933, the keys move outwardly releasing the slip expanders 934 which are then picked up by the ring 910 after further travel.

The body 920 is provided with suitable vertical bores, including bores 950 and 951 for control fluids and a bore 952 for well fluids. A sufficient number of such bores are provided to communicate with all of the necessary conduits in the tubing string assembly for handling both the control and the well fluids. As shown in FIG. 23D, conduits 953 having lower end couplings 954 are connected through the ring 910 into the lower end of the body 920 to provide connection of control fluid conduits into the well head. Similarly, a coupling 955 connected on a conduit 960 secured into the body provides for connection with well fluid conduits below the tubing head. Each of the well fluids conduits below the tubing head are connected into and through the tubing head body 920 in the same manner as illustrated in FIG. 23B.

The tubing head 133 is run by means of the running tool 142 which is illustrated in FIGS. 13A and 13B using the control finger 451 as shown in FIG. 14. The running tool is coupled with the tubing head by insertion of the running tool into the upper end of the tubing head telescoping the seal mandrels 402 and 403 into the appropriate body flow passages 950–952 to provide fluid communication from the running tool into the tubing head. The control fingers 451 are inserted into the vertical slots 925 in which the slip expanders 934 are disposed. The control fingers 451 cam the locking keys 923 outwardly into the housing windows 903 interlocking the housing 900 with the body 920 to insure against relative movement between the housing and the body during the running and setting of the tubing head. The locking keys 401 of the running tool are expanded into the windows 901 of the tubing head housing 900 for interlocking the running tool with the tubing head. When the tubing head is at the proper depth in the well casing, the running tool is activated forcing the control fingers 451 downwardly so that the lower ends of the control fingers engage the upper end surfaces 940 of the slip expanders 934. When sufficient force is applied to the slip expanders, the screws 942 holding the expanders are sheared releasing the expanders for downward movement. As the expanders are driven downwardly by the control fingers, the expander surfaces 935 force the slip carrier 914 laterally outwardly driving the slips 913 against the casing wall to lock the tubing head against both upward and downward movement within the casing. The locking slips 913 move radially straight outwardly so that the carbide inserts 913*a* bite into the casing wall surface. When the slips 913 are fully engaged with the casing wall, the downward force on the control fingers is relaxed and the spring 941 urges each of the locking keys 933 upwardly against the tapered surface 932 of the key locks 931 urging the locking slips 933 against the outer surface of each of the slip expanders 934. The locking keys 933 thereby lock the slip expanders 934 at downward positions holding them against upward movement so that each slip carrier 914 is held outwardly at the position at which the locking slips 913 engage the casing wall holding the tubing head in place.

The locking arrangement shown in the tubing head 133 is effective for firmly locking the tubing head in a static condition even under extremely high loads. Loads imposed on such a tubing head often may be as high as 60 to 70 thousand pounds. It is important that the tubing head be held static so that the seals between the stab seals and the seal bores do not permit leakage of fluids in both the well fluids passage and the control fluids passages. The shear screws 942 hold the slip expanders 934 against accidental downward movement during running so that the tubing head is not accidentally set at the wrong location in the casing. The limit screws 943 permit sufficient downward movement of the slip expanders to obtain the desired full expansion of the slips while holding the slip expanders against downward movement to the extent that the slip carriages could be pushed outwardly so far that the carriages and slips fall from the body and housing of the tubing head.

After fully setting the tubing head as described, the running tool is withdrawn and the locking lugs 923 are forced back inwardly out of the windows 903 by the springs 924. The shear screws 921 then hold the body 920 against movement within the housing 900.

When the tubing head is to be pulled, the running tool 142 is reinserted into the upper end of the tubing head interlocking the running tool with the tubing head as previously described. The running tool, for pulling purposes, is equipped with the operating keys 435. The running tool is lifted upwardly with the upward force on the running tool being applied through the keys 401 to the housing 900 at the windows 901. The upward pull on the housing 900 is transmitted through the shear screws 921 to the body 920 which is held against upward movement by the engagement of the locking slips 913 with the casing wall surface. When the upward force on the housing 900 exceeds the shear strength of the screws 921, the screws break releasing the housing 900 to move upwardly. The length of the windows 905 in the housing permit the housing to move upward while the locking slips 913 remain engaged with the casing wall. After shearing the screws 921 releasing the housing 900 to be lifted by the running tool, the upward movement of the housing aligns the enlarged portion of the housing below the shoulder 900*a* with the keys 933 so that each key moves outwardly away from the surface of the slip expander 934. The outward movement of the keys 933 releases the grip of the keys along the surface of the locking slip expanders 934 so that the expanders are free to move upwardly. The outer housing 900 and the ring 910 are lifted upwardly relative to the inner body 920 and the conduits connected to the body 920 which are held locked with the casing wall by the locking slips 913 until the slips are retracted to release positions. After the release of the slip expanders 934 as described, the upwardly moving ring 910 lifts the slip expanders 934 when the lower ends 945 of the slip expanders are engaged in the recess 912 of the ring 910. At that time, the lifting force on the housing 900 raises the slip expanders 934 releasing the slip carriages 914 to move radially inwardly backing the locking slips 913 inwardly away from the casing wall. When the slips 913 are retracted from the casing wall, the tubing head 133 is fully released from the casing, for pulling the tubing string assembly from the well bore. The upward movement of the housing 900 with the ring 910 returns the several parts of the tubing head to the relative positions illustrated in FIGS. 23A and 23B except that the housing 900 and the ring 910 are at an upper end position at which the ring 910 engages the lower ends of the slip expanders 934 while the upward force on the slip expanders is applied to the slip carriages 914 the upper end of which engages the top surface of the window 915 in the body 920 so that the body along with the conduits below the head are lifted by the tubing head.

It will be apparent that in removing the tubing head 133, except in cases of disaster which cause a parting of the tubing string system at the safety joint, the entire system down through and including the ball valve package lock 120 is removed when the tubing head is pulled. Thus, simultaneously with the releasing of the tubing head following the described steps, the particular control line leading to the ball valve package lock 120 which directs control fluid under pressure into the annular cylinder 733 is pressured-up for lifting the annular piston 734 to raise the control fingers 730, see FIGS. 19A and 19B, which releases the locking keys 722 on the package lock to collapse inwardly thereby freeing the package lock from the tubing hanger 112.

The well system thus far described and operated in conjunction with the tubing head 133 is normally used where the tubing head is set in a wet tree operated with the assistance of a diver or, alternatively, in a cellar in which personnel may work, both approaches providing manual access to the tubing head. The tubing head 133 does require long stab seal mandrels which essentially require manual access in manipulating the connections into the tree.

FIGS. 25A, 25B and 26 through 29 illustrate another form of tubing head 1000 which eliminates some of the problems found in using the long stab seal mandrels necessary in the tubing head 133 so that the head 1000 is adaptable to remote operations rather than requiring manual manipulation by personnel actually on the job at the tubing head. The tubing head 1000 is shown in FIG. 30 installed in a Vetco housing 1100 adapted for remote installation with flowlines through which pumpdown procedures may be carried out. The tubing head 1000 has both orienting and spacing-out capabilities. Referring to the drawings, the tubing head has a body 1001 which is reduced in diameter along a central section defining a stop shoulder 1002. The body has a central external threaded section 1003 on which a nut 1004 is secured for holding a plurality of thrust or bearing plates 1005 against the shoulder 1002. The bearing plates vertically support the tubing head permitting rotation when installed in a well housing as discussed hereinafter. The tubing head body 1001 as illustrated includes a pair of spaced, large vertical bores 1010 and four small vertical bores 1011*x*, FIGS. 26–28. The large bores accommodate conductors for well production fluids while the small bores are used for control fluids flow. Each of the bores 1010 is fitted with a conductor sleeve 1011 having an enlarged upper end portion 1011*a* provided with an internal annular seal assembly 1012 held in the conductor sleeve by a nut 1013 threaded into the upper end of the sleeve. The seal assembly 1012 in each of the conductor sleeves is adapted to seal with a wellhead stab 1014 for fluid communication with the conductor sleeve in the tubing head. The lower end portion of each of the conductor sleeves 1011 telescopes into a slidable lower conductor sleeve 1015 which is movable in a telescoping relationship with the upper sleeve 1011 between extreme end positions providing substantial vertical spacing out tolerance for the tubing head. The lower end portion of the sleeves 1011 which are fitted into the sleeves 1015 includes an external annular seal 1020 held on the sleeve 1011 by a nut 1021. The seal 1020 forms a fluid-tight connection between the telescoping conductor sleeves 1011 and 1015. Each of the lower outer conductor sleeves 1015 is telescoped between an extended position shown in FIGS. 25A and 25B to a collapsed position, not illustrated, at which the upper end edge 1015*a* of the lower outer sleeve engages an external annular stop shoulder 1011*b* provided on each of the upper inner conductor sleeves 1011. The extended position of each of the lower outer conductor sleeves 1015 is limited by the engagement of an external annular stop shoulder 1015*b* on each of the conductor sleeves 1015 which is engageable with an internal annular stop shoulder 1010*a* provided in each of the bores 1010 as shown in FIGS. 25B. Each of the conductor sleeves 1015 has a plurality of longitudinally-spaced external annular locking teeth 1022 to lock the conductor sleeves 1015 rigidly against longitudinal movement after the tubing head is properly spaced-out and landed in a wellhead. The tubing head body 1001 has a pair of vertical locking rod bores 1023 each of which receives a vertical longitudinally movable locking rod 1024 provided with a sloping operator surface 1025 as shown in FIG. 29. The body 1001 has laterally outwardly opening vertical slots 1030 each containing a laterally movable locking dog 1031. Each of the locking dogs is located between a locking 1024 and the two lower conductor sleeves 1015. As seen in FIGS. 28, the two locking dogs are located on opposite sides of and between the lower conductor sleeves 1015. Each of the locking dogs 1031 has inner arcuate locking surfaces 1032 which are each provided with a tooth surface similar to that shown along the locking teeth 1022 of the conductor sleeve 1015. Each of the locking dogs 1031 has a semi-cylindrical recess 1033 along the side of a locking dog opposite the locking surfaces 1032 to receive a locking rod 1024. A spring 1034 is between the locking dogs 1031 to bias the dogs outwardly against the rods 1024 away from the locking teeth 1022 on the conductor sleeves 1015. When the locking rods 1024 are raised to positions at which the sloping operating surfaces 1025 are above the locking dogs 1031, as viewed in FIG. 29, the spring between the locking dogs spreads the locking dogs farther apart disengaging the surfaces 1032 of the locking dogs from the teeth 1022 on the movable lower conductor sleeves 1015.

The tubing head 1000 is run with a running tool, not shown, having operating fingers which enter in the locking rod bores 1023 to engage the upper ends of the locking rods 1024 for moving the rods downwardly. The tubing head is installed with the locking rods at upper release positions at which the locking dogs 1031 are biased apart away from the lower flow conductor 1015 so that the lower sleeves are free to move vertically for proper spacing-out as the tubing head is lowered into the wellhead housing. As the tubing head comes to rest in the wellhead housing on the thrust plates 1005, the lower flow conductor sleeves 1015 which are connected with production strings extending downwardly in the well bore are raised, telescoping upwardly on the upper conductor sleeves 1011 to properly accommodate the tubing head to the vertical spacing available in the well. After the tubing head is seated on the plates 1005, the running tool is activated to drive the locking rods 1024 downwardly so that the operating surfaces 1025 force the locking dogs 1031 inwardly against the teeth 1022 to firmly lock the lower conductor sleeves in place at the proper spacing.

The body 1001 of the tubing head 1000 has vertical semi-cylindrical annulus flow spaces 1040 down opposite sides of the body for communication through the tubing head with the annular space in the well bore. On opposite sides of the annulus flow spaces, the tubing head body 1001 is provided with sloping orientation guide ramp surfaces 1041 which lead to vertical orientation grooves 1042. The guide surfaces 1041 and grooves 1042 coact with the guide surfaces in the wellhead housing for orienting the tubing head to lock the head at the proper position of rotation within the wellhead housing. The guide surfaces 1041 on the tubing head body 1001 provide means for orientation of the christmas tree and the tubing head in the relationship shown in FIG. 30 as the christmas tree is lowered downwardly telescoping over the tubing head. Guide lugs associated with the christmas tree engage the guide ramp surfaces to rotate the tubing head as the christmas tree is lowered for coupling the tubing head and Christmas tree together in the proper orientation.

FIG. 30 illustrates the wellhead 1100 which is one environment in which the tubing head 1000 may be used in sub-sea installations. The tubing head 1000 is seated in a wellhead housing 1101 which is connected at the lower end with the surface casing, which, in some installations, may be 13⅜ inch casing forming one of the upper casing strings within the well bore. Positioned within the wellhead housing is a string of smaller casing 1102 within 13⅜ inch casing would normally be 10¾ inch casing connected with a casing hanger 1103 supported in the wellhead housing 1101. A nut 1104 is secured in the housing 1101 to pack-off with the 10¾ inch casing. While the scale of the apparatus shown in FIG. 30 is too small to clearly illustrate all of the details of the structure, and thus, what is shown is largely schematic, the position of the tubing head 1000 in the wellhead housing will be understood by reference to the location of the thrust plates 1005 in FIG. 30, inwardly of and near the top of the nut 1104. The tubing head 1000 is oriented such that only one of the lower conductor sleeves 1015 may be seen in FIG. 30. The wellhead housing 1101 is supported at the upper end of a string of surface conduit 1105. A structural template 1110 is mounted around the upper end of the surface conduit 1105 supporting vertical spaced guide posts 1111 which function to guide the Christmas tree 1112 into position as shown in FIG. 30.

In a well system using the tubing head 1000 with the wellhead arrangement 1100, the well completion procedure is carried out in accordance with conventional sub-sea well procedures including the use of a riser pipe which extends to the surface from the ocean bottom to either a platform or a floating vessel. The various procedures through and including the landing of the tubing head 1000 are performed through the riser. At the point where the well head system 1100 is to be installed after landing the tubing head 1000, the well will be fully under control, having been tested, killed by procedures such as using a completion fluid to apply sufficient hydrostatic pressure to the well to keep it under control, and then plugging the well after which the blowout preventers are removed. The Christmas tree structure is lowered using guidelines, not shown, secured from the guide posts 1111 to the platform or floating vessel. Also may use systems not requiring guidelines for deeper water drilling. A guide frame including conical guide sleeves 1113 is used to guide the christmas tree downwardly along the guidelines onto the guide posts 1111. The Christmas tree telescopes downwardly into the wellhead housing over the tubing head 1000 engaging the guide ramps 1041 so that the tubing head 1000 is rotated sufficiently to align the tubing head with the downwardly moving Christmas tree so that the Christmas tree is coupled over the tubing head at the proper position of rotation. The bearing plates 1005 on the tubing head 1000 support the tubing head vertically while allowing it to rotate sufficiently to align the tubing with the christmas tree. This procedure facilitates the remote manipulation required while installing the Christmas tree. During the lowering procedure, the Christmas tree and guide frame are supported from a handling head 1114 having a quick release latching profile 1115 along the upper end portion of the handling head for engagement with a suitable handling tool. The flexible flowlines 1120 are connected with the Christmas tree at the surface and lowered along the Christmas tree to prevent the need for a driver to manually connect the flowlines at the subsea wellhead on the ocean bottom. In the particular form of the Christmas tree illustrated in FIGS. 30 and 31, the flowlines 1120 include a 270° loop which is connected at the wellhead end into the Christmas tree at 1121 leading to one of the conductor sleeves in the wellhead 1000, while the flowlines shown in FIG. 30 extend upwardly around to the left in a 270° arc connecting into a flowline connector 1122 from which a section 1120*a* of the flowline runs to the shore or to the surface where it is connected with such facilities as may be required for well production and servicing. The Christmas tree includes a circulating valve 1123 and an annulus monitor valve 1124, which control communication within the Christmas tree to permit fluid circulation and monitoring procedures to be carried out. The valve 1124 connectes the annulus space within the Christmas tree with one of the flowlines so that circulation from the surface can be obtained allowing communication with the annulus through the flowline for several purposes, including gas lift, monitoring the annulus pressure, and other required or desired well services. The circulating valve 1123, similarly, controls internal flow valving which interconnects the flowlines at the wellhead permitting circulation through the flowline equipment from the surface to the wellhead. During normal production of the well, both of these valves would be closed isolating the flowlines from each other at the wellhead.

FIGS. 32 and 33 illustrate another form of underwater wellhead 1100A which includes a number of identical components illustrated in the wellhead 1100 of the FIG. 30, such components being identified by the same refernce numerals as used in FIG. 30. The wellhead 1100A is equipped for remote cable connection of a flow conductor from the water surface. Referring to FIGS. 32 and 33, the wellhead 1100A is equipped with a handling head 1150 provided with a pulley 1151 supported in association with a quick-release profile member 1152 having a vertical cable passage 1153 to accommodate a cable 1154 extending from the surface downwardly around the pulley. The pulley is positioned so that the cable 1154 extends laterally through a flowline connector 1155 used for coupling a flowline, not shown, into a conductor 1160 which connects into the wellhead 1100A in the same manner as the conduit 1120 in the wellhead 1100 shown in FIG. 30. In operation, a conductor, not shown, from the surface is coupled by means of a fitting 1162 with the quick-disconnect profile member 1152. A pig, not shown, is connected at the surface with the lead end of the cable 1154 and pumped downwardly in a standard manner pulling the cable downwardly through the conduit connected to the member 1152 so that the pig passes through the passage 1153, around the pulley 1151, outwardly through the connector 1155, and floats to the surface. At the surface, the lead end of the cable is coupled with a flowline connector 1163 on a flowline, not shown, which is then pulled back downwardly by reversing the cable 1154 pulling the connector 1163 downwardly to the wellhead into the connector 1155 which includes suitable standard fittings for coupling the connector 1163 into the connector 1155 so that the flowline connected with the connector 1163 is coupled into the connector 1155 for communication with the wellhead 1100A.

FIGS. 34 and 35 show a still further form of a wellhead 1100B which includes a number of components common to the wellheads 1100 and 1100A. The wellhead 1100B has a quick-disconnect handling head 1175 having a fitting 1176 for the connection of a cable from the surface of the water to lift the wellhead. The handling head is adapted to receive a coupler 1162 for connecting a conduit with the head from the surface. Supported from the handling head 1175 by arms 1177 and 1178 is a flowline support 1179 which is secured with a flowline 1180 communicating with the conduits 1160 which connect into the wellhead in the same manner as the conduit 1120 in FIG. 30. The flowline 1180 leads off laterally to the side of the wellhead from where is either extends along the ocean bottom to a shore facility or upwardly to a floating vessel or platform at the surface of the water. If, after installation of the wellhead, well service is necessary, the wellhead may be picked up by a quick disconnect, not shown, coupled with the fitting 1181 and set over to the side of the well or pulled to the surface to allow vertical access into the well to perform the servicing. During such servicing, the flowline 1180 is left connected with the wellhead.

FIG. 35 shows a top view of the arrangement illustrated in FIG. 34 illustrating the use of two parallel flowlines 1180 so that circulation into the well may be obtained from either the shore or the water surface.

FIGS. 36A and 36B taken together show a longitudinal view in section of a composite string hydraulic stop and orienting tool 1200. FIG. 36C is a fragmentary longitudinal side view in elevation showing an orienting sleeve of the tool 1200. The tool 1200 is particularly useful as an integral part of the composite string 143 in heavy seas where heave energies present a problem due to the rise and fall of drilling vessel from which the composite string is supported. The tool 1200 serves as a hydraulic shock absorber located at the wellhead resting on a supporting flange of the type illustrated in FIG. 37A. The tool 1200 has both orienting and shock absorbing features. Referring to FIGS. 36A and 36B, the tool 1200 has an outer casing or housing formed by an upper member 1201 threaded along the lower end portion to lower member 1201. A ring seal 1203 is supported in an external annular recess along the upper end portion of the lower member 1202 to seal with the inner surface of the lower end portion to the upper member 1201 to provide a fluid tight seal between the two housing members. The lower end edge of the lower member 1202 has a supporting shoulder surface 1204 formed in the shape of an orienting helix which rests on and matches a similar surface in the support flange of FIG. 37A. An annular retainer 1205 is threaded into the upper end of the upper member 1201 for holding the movable portion of the tool in the housing. The upper end edge of the lower member 1202 provides an upwardly facing stop shoulder 1210 which limits downward movement of the movable portion of the tool in the housing and a downwardly facing internal stop shoulder 1211 is provided on the lower end of the retainer 1205 limits upward movement of such movable portion in the housing.

The tool 1200 has an inner housing or body 1212 spaced within the outer housing and welded at an upper end with a head 1213 provided with an externally threaded upper end coupling 1214 which is compatible with the threaded couplings at the lower ends of the other sections of the composite string so that the tool may be connected with the composite string. The lower end of the inner housing 1212 is similarly secured by welding with an internally threaded lower end fitting 1215 which is compatible with the upper end fittings on the other sections of the composite string for connecting the tool 1200 into the composite string at an appropriate location along the length of the string. The lower end portion of the inner housing 1212 is enlarged forming an annular piston portion 1220 having ring seals 1221 which slide fit in the lower end portion of the outer housing section 1202 defining the lower end of a pressure annular chamber 1222 between the inner housing member 1212 and the outer housing. An annular sleeve like piston 1223 is welded to the lower portion of the head 1213 extending downwardly into the annular chamber 1222 between the inner and outer housings of the tool. The piston 1223 has a piston head 1224 provided with ring seals 1225 which form a sliding seal with the inner surface of the upper outer housing member 1201. The internal diameter of the lower outer housing member 1202 is substantially smaller than the internal diameter of the upper outer housing member 1201 so that the difference in the line of sealing of the lower ring seals 1221 and the upper ring seals 1225 with the lower and upper housing members defines a downwardly facing annular area over which fluid pressure within the annular chamber 1222 acts to urge the inner housing upwardly relative to the outer housing.

The tool 1200 is provided with vertical well fluid flow conductors 1230 and control fluid flow conductors 1231 which are equal in number and positioned to couple with the corresponding conductors in the adjacent sections of the composite string connected with the tool. Each of the conductors 1230 has a lower end stab seal 1230*a* while similarly the flow conductors 1231 are each provided with a lower end stab seal 1231*a* for fitting in sealed relationship into the upper ends of corresponding conductors in the section of the composite string coupled into the lower end of the tool 1200. The upper ends of each of the conductors 1230 and 1231 is provided with an upper end coupler, such as the coupler 1230*b*, which has a seal surface 1230*c* sized to receive a stab seal on the section of the composite string coupled into the upper end of the tool 1200. The conductors 1230 and 1231 are secured through and supported by an intermediate spacer 1240 within the head 1213 and a lower spacer 1241 held by set screws 1242 within the lower end portion of the inner housing piston section 1220. Similarly, the coupler member 1214 at the upper end of the tool 1200 as shown in FIG. 26A is secured with the conductors 1230 and 1231 providing additional spacing and support functions to upper portions of the conductors at the head end of the tool 1200. The spacer 1240 has a flow passage 1242 which communicates at a lower end with a downwardly extending flow passage 1243 formed in the head member 1213 opening into the upper end of the annular cylinder 1222 between the inner and outer housings of the tool. Upper and lower ring seals 1244 are supported around the spacer 1240 to seal above and below the opening of the passage 1242 into the passage 1243. The upper end of the passage communicates with the lower end of a control fluid conduit 1245 supported by the spacer 1240 and a top spacer 1250 held in the head of the tool by set screws 1251 supporting and properly spacing the upper ends of the conduits 1230, 1231, and 1245. The flow passage arrangement into the annular cylinder 1222 provides for communication of hydraulic fluid through the composite string into the annular cylinder to permit sufficient hydraulic pressure to support the composite string against downward forces relative to the outer housing of the tool while such housing is supported at the wellhead by the flange assembly of FIG. 35.

The tool 1200 has an internal guide and orienting sleeve 1260 which is disposed within the annular cylinder 1222 and welded at opposite ends to the outer surface of the inner housing 1212. The sleeve 1260 as shown in detail in FIG. 36C has a vertical orienting slot 1261 which opens to a lower end helical guide surface 1262. A guide lug 1263 as shown in FIG. 36A is clamped through the upper end portion of the lower outer housing section 1202 by the overlapping relationship of the upper housing section 1201 with the lower housing section 1202. The lug 1263 has an inner guide head which extends into the space between the inner and outer housing sections defining the annular cylinder 1222 so that the guide lug is engageable with the helical guide surface 1262 and enters the guide slot 1261 when the guide sleeve is moved downwardly sufficiently relative to the outer housing.

The slip joint 145 of FIGS. 18A and 18B is operable with the no-go flange assembly 1300 illustrated in FIG. 37. The assembly 1300 includes a flange member 1300 having upper and lower flange sections 1301*a* and 1301*b* each provided with bolt holes for connecting the flange member in a blowout preventer stack, not shown. The flange member has upper and lower gasket recesses 1301*c* and 1303*d* for gaskets, not shown, used to provide a seal with the member when connecting it in such a stack. The member 1301 is provided with a graduated bore having an upwardly facing internal stop shoulder 1302 which supports a tubular guide weld 1303. A guide sleeve 1304 is welded within the guide weld 1303. The guide sleeve has a top edge helical guide surface 1305 leading to a vertical orienting slot 1306. The member 1301 has an internal lock ring recess 1310 for a lock ring 1311 which engages a lock sleeve 1312 fitted around a reduced upper end portion of the guide weld 1303. The lock sleeve 1312 is secured to the guide weld by set screws 1313. The lock sleeve 1312 holds the lock ring 1311 in position in the recess 1310 thereby clamping the guide weld 1303 between the stop shoulder 1302 and the lower surfaces of the lock sleeve and lock ring. The upper end 1307 of the weld 1303 defines a no-go shoulder engaged by the lower end edge 600*e* of the slip joint housing to support the slip joint.

When the composite string 143 including the slip joint 145 is lowered through the blowout preventer stack including the flange assembly 1300, the guide lug 602 engages the guide surface 1305 in the flange assembly 1300 effecting rotation of the slip joint until the guide lug enters the vertical slot 1306. The lower end edge 600*e* of the slip joint outer housing section 600*b* engages the no-go shoulder 1307 supporting the outer upper section of the slip joint and the section of the composite string above the slip joint on the flange assembly 1300.

FIG. 37A illustrates a flange assembly 1300A which is used with the hydraulic stop and orienting tool 1200 to support the tool at a blowout preventer stack with which the flange assembly 1300A is connected. A number of the parts of the flange assembly 1300A are identical to those of the flange assembly 1300 and, thus, are identified by the same reference numerals previously used and are formed as described in connection with the discussion of the flange assembly 1300 of FIG. 37. The flange assembly 1300A has an orienting and support sleeve 1303A which is supported in the flange 1301 on the shoulder 1302 and locked in place by the lock ring 1311. The sleeve 1303A has a support and orienting upper end edge 1307A which conforms with the lower end edge 1204 on the outer housing 1202 of the hydraulic stop and orienting tool 1200.

When the composite string 143 is operated with the hydraulic stop and orienting tool 1200 included in the string, the string is lowered through a blowout preventer stack including the flange assembly 1300A. The composite string and the well completion equipment supported from the string pass through the flange assembly until the helical guide and supporting surface 1204 on the housing 1202 of the tool 1200 engages the orienting and support surface 1307A on the upper end of the flange assembly sleeve 1303A. Rotation of the tool is effected by the coaction between the two guide surfaces on the flange assembly and the tool until the tool housing comes to rest on the flange assembly with the housing surface 1204 and fully seated on the flange assembly surface 1307A.

As the composite string is lowered, maximum control fluid pressure is applied through the appropriate conduit in the composite string to the hydraulic stop and orienting tool. This pressure is communicated through the passages 1242 and 1243 into the annular cylinder 1222. Such pressure in the cylinder 1222 urges the other housing downwardly to a lower end position on the inner housing at which the piston 1224 engages the shoulder 1211. This pressure is maintained as the lower end surface 1204 on the outer housing comes to rest at the flange assembly 1300A on the helical guide and supporting surface 1307A. Without such pressure, the tool would extend during lowering but the pressure would not be available when the flange assembly was reached to absorb impact. The outer housing of the tool 1200 is urged downwardly due to the difference in the diameters of the seals 1225 at the upper end of the tool and the seals 1221 at the lower end of the tool which effects the downward force on the housing until the tool is seated in the flange assembly 1300.

As the tool 1200 is seated in the flange assembly 1300A, the same maximum hydraulic force tends to lift the inner housing of the tool 1200. As the housing end surface 1204 engages the flange surface 1307A, the housing 1202 is rotated freely on the inner housing orienting the outer housing to fully seat the housing surface 1204 on the flange assembly surface. During this step the lug 1263 is fully below the guide surface 1262 allowing the outer housing to be free to rotate. After fully seating the outer housing in the flange assembly the maximum pressure is continued in the cylinder 1222 and the lug 1263 still remains below the guide surface 1262. The weight of the composite string and equipment connected to it is then transferred through the hydraulic fluid to the flange assembly as the outer housing assumes a weight support function. Impact energy resulting from lowering the string and vessel heave is absorbed in the hydraulic system. The hydraulic pressure is then gradually lowered. The guide surface 1262 on the inner housing engages the lug 1263 in the outer housing rotating the inner housing and composite string until the lug 1263 enters the vertical slot 1261 at which stage the proper string orientation is reached. The slot 1261 is long enough for the string to be further lowered to effect the necessary stabs to install the equipment supported from the composite string. The permissable straight line movement of the lug 1263 in the slot 1261 allows the string the necessary vertical up-and-down action to perform such spacing-out and stabbing as is required by the particular running or pulling step being performed. After those procedures have been completed and the desired well functions are being carried out through the composite string, the pressure is maintained in the annular cylinder sufficient to provide support of the composite string at the wellhead transferring the load from the drilling vessel and absorbing the energy involved in the transfer.

When performing such well operations as drilling out cement in the well being completed with the system, the casing hanger 105 requires protection against damage. Illustrated in FIG. 38 is a protective sleeve or wear bushing 1400 which is installed in and retrieved from the casing hanger 105 by a running pulling tool 1400A. The wear bushing 1400 has an external configuration which is compatible with the internal profile of the casing hanger. The wear bushing has a lower end ring portion 1401 provided with a lower end annular support surface 1402 engageable with a corresponding support surface in the casing hanger. The wear bushing has a plurality of elongated slots 1403 which are circumferentially spaced defining longitudinal collet fingers 1404 each of which has an external locking boss 1405 receivable in a locking recess of the casing hanger. The wear bushing has a ring-shaped head portion 1410 having a downwardly facing external annular support shoulder 1411 and an upper external annular flange 1412. Internally, the head 1410 is provided with a locking recess 1413. The wear bushing 14 is inserted in the casing hanger 105 when protection of the casing hanger is required such as during the above referred to drilling procedure and after such procedure the bushing is removed by means of the running and pulling tool 1400A.

As also illustrated in FIG. 38, the running and pulling tool 1400A for the wear sleeve 1400 has a tubular body 1420 supported on the lower end of a handling string 1421. A collect stop 1422 is threaded on a reduced lower end portion of the body 1420 held by set screws 1423. The top face of the collet stop 1422 supports a sleeve 1424 around which is disposed a collet 1425 having a solid ring-shaped head end 1425*a* and a plurality of circumferentially-spaced downwardly extending dependent fingers 1425*b*. A plurality of set screws 1430 are secured through the head ring portion 1425*a* of the collet. Within the collet ring 1425*a* above the sleeve 1424 is a lock ring 1431. A running ring 1432 is secured on the body 1420 above the collet by a plurality of circumferentially-spaced sheer screws 1433. The head ring 1425*a* of the collet has an internal locking recess 1425*c* to receive the lock ring 1431 for locking the collet at an upper position during the release of the running tool from the wear bushing weld 1400.

During the running of the water bushing 1400 with the tool 1400A, the wear bushing weld is assembled on the tool as illustrated in FIG. 38. The handling string 1421 is inserted downwardly in the well bore until the wear bushing weld 1400 is inserted into the casing hanger and snapped into place with the collet finger bosses 1405 locking the wear bushing weld in the body of the casing hanger. During the running of the wear bushing weld, the heads of the collet 1425 engaged in the locking recess 1413 of the wear bushing weld hold the wear bushing weld on the running tool. When the wear bushing weld is seated in the casing hanger, a downward force on the handling string sheers the screws 1433 allowing the ring 1432 to move upwardly on the body 1420 so that the collet 1425 is free to move upwardly on the body until the collet finger heads are above the lower end flange 1424*a* of the ring 1424 at which position the collet finger heads may spring inwardly to release the collet from the wear bushing weld locking recess 1412. The upward movement of the collet 1425 aligns the internal recess 1425*c* of the collet head ring with the lock ring 1431 which expands outwardly into the recess 1425*c* to hold the collet 1425 at the upper release position at which the heads of the collet fingers may spring inwardly. Thus, the running tool 1400A is removable upwardly from the wear bushing weld 1400.

The tool 1400A may be used to retrieve the wear bushing weld 1400 by removal of the shear screws 1433 and the lock ring 1431 so that the collet 1425 is free to move upwardly to allow entry of the collet into the locking recess 1413 of the wear bushing weld. After the tool 1400 is inserted into the wear bushing weld to the position at which the collet 1425 interlocks with the wellhead, the tool is lifted with the collet 1425 being held downwardly so that the ring 1424*a* moves behind the collet heads on the fingers 1425*b* holding the heads outwardly responsive to upward movement of the tool 1400A. The collet finger heads, thus, lift the wear bushing weld 1400 out of the casing hanger for retrieval to the surface.

It will now be understood from the preceeding description and the accompanying drawings that a new and improved well completion system and method including a tubing hanger has been described and illustrated. In accordance with the method and apparatus, the traditional pack-off, master valve, and weight supporting functions of a wellhead are moved downhole to a safe depth to minimize surface damage effects on offshore wells and wells in other extreme environmental situations such as in the Arctic areas. The orienting and spacing-out features of the apparatus adapts it to remote operation and permit installation under circumstances where accuracy of measurement is not practical within the limits of an inch or two as required in the prior art. The movement of the master valve and other functions downhole provides substantial reduction in the height of the christmas tree.

The well completion system includes a tubing hanger embodying the invention adapted to be landed and locked at a downhole location in a casing hanger for suspending lower tubing strings in a well and providing both a weight supporting function and a pack-off at the casing hanger. A valve package look is provided for releasably coupling into the tubing hanger and connecting with a plurality of upper tubing strings including downhole tubing valves. Connected in the tubing strings is a safety joint comprising releasably coupled sections which part responsive to tension forces caused by surface damage and the like leaving in the well above the tubing valves a known handling profile which may be engaged by a suitable pulling tool for recompleting and otherwise servicing the well. The upper tubing strings extend from the safety joint to a tubing head supported in a well housing at a location such as the ocean bottom in offshore wells and the earth surface in Arctic wells. The downhole completion equipment includes spacing-out and orienting features in each of the units which perform both mechanical and fluid coupling functions.

The well completion system is adapted to preassembling and testing at the factory in such groupings as the tubing hanger, valve package lock, tubing strings, tubing valves, and the lower section of the safety joint in one preassembled combination, and the upper section of the safety joint, the intermediate and upper tubing strings, and the tubing head in a second combination. The necessary fluid control lines are included as needed in each of the preassembled and tested combinations.

The well completion system is, in accordance with further features, run and retrieved by means of a composite handling string including coupler sections having well fluids conduits and control fluids conduits equal in number and position to connect with corresponding conduits in the various components of the well completion system. The composite handling string may include either a slip joint which provides substantial orienting and spacing-out functions and weight support for use from fixed locations such as platforms. The composite handling string may, alternatively, include a hydraulic stop and orienting tool for use from floating vessels and the like to transfer the weight from the vessel to a flange assembly near the ocean bottom. Each of these tools is included in the composite string at a location at the depth of the blowout preventer stack used in completing the well.

What is claimed is:

1. A tubing hanger for supporting a tubing string system in a well bore comprising: a body; means on said body for connecting a tubing string system to said body for extending downwardly from said body in said well bore; means providing a flow passage through said body for communicating with said tubing string system;

means on said body for supporting said body at a landing nipple in a casing string in said well bore; external annular seal means around said body for sealing between said body and a seal surface along said landing nipple to close off the upper end of an annulus within said well bore in said casing around said tubing string system below said hanger; releasable locking means on said body for releasably engaging said landing nipple to selectively lock said body in said landing nipple; means for coupling a fluid communication module into said body to provide fluid communication with said passage means through said body for establishing communication with said tubing string system below said body from a tubing string system above said body; and means on said body for rotationally orienting and locking said communication module with said body responsive to coupling said module into said body.

2. A tubing hanger in accordance with claim 1 wherein said means for releasably locking said hanger in said landing nipple comprises an external annular split locking ring positioned for expansion and contraction in an external annular recess provided around said body and a longitudinally movable locking collet supported with said body, said collet having a plurality of circumferentially spaced operating fingers, one of said operating fingers having a propping probe end for insertion between split ends of said locking ring to expand and lock said ring responsive to insertion of said propping probe between said ends and the remainder of said fingers of said collet being insertable behind said locking ring at said first locking position of said fingers, all of said fingers having a release recess spaced from the free ends of said fingers for movement behind said locking ring at a second release position of said fingers to release said ring for inward movement around said body for releasing said tool from said landing nipple.

3. A tubing hanger in accordance with claim 2 wherein said means for orienting and locking said fluid communication module into said tubing hanger includes a coupling head on said body comprising an open ended sleeve whereby said communication module is telescoped into the open end of said sleeve, locking windows defined at a bottom end of said sleeve circumferentially spaced around said sleeve for receiving locking fingers on either of said communication module or a running tool for running and pulling said tubing hanger, an endwardly facing guide surface and orientation slot in said sleeve for rotationally orienting said communication module or said running tool in said tubing hanger, and a centralizing lug in said sleeve spaced from said guide surface adapted to engage a guide lug on the body of said running tool of said communication module for engaging said guide lug with said tubing hanger for orienting said communication module or said running tool at a desired rotational orientation position with said tubing hanger and locking said module on said running tool against rotation.

4. A tubing hanger in accordance with claim 3 including check valve means in said flow passage means for shutting upward flow through said flow passage means and adapted to be hydraulically and mechanically opened downwardly to permit upward flow in said flow passage means.

5. A tubing hanger in accordance with claim 4 wherein said guide surface comprises a spiral-shaped shoulder connecting with said orientation slot and said orientation slot is a longitudinally extending slot for locking said communication module or said running tool at a predetermined angle of rotation within said hanger.

* * * * *